US011447955B2

(12) United States Patent
Pan et al.

(10) Patent No.: US 11,447,955 B2
(45) Date of Patent: Sep. 20, 2022

(54) RAIL SYSTEM FOR AN OUTDOOR SHELTER

(71) Applicant: Sunjoy Industries Group Ltd., Galena, OH (US)

(72) Inventors: Lianzhang Pan, Huzhou (CN); Qi Zhu, Jiaxing (CN)

(73) Assignee: Sunjoy Industries Group Ltd., Galena, OH (US)

( * ) Notice: Subject to any disclaimer, the term of this patent is extended or adjusted under 35 U.S.C. 154(b) by 0 days.

(21) Appl. No.: 17/008,390

(22) Filed: Aug. 31, 2020

(65) Prior Publication Data

US 2020/0399905 A1 Dec. 24, 2020

Related U.S. Application Data

(63) Continuation-in-part of application No. 16/237,529, filed on Dec. 31, 2018, now Pat. No. 10,760,280,
(Continued)

(51) Int. Cl.
*E04F 10/02* (2006.01)
*E04H 15/34* (2006.01)
(Continued)

(52) U.S. Cl.
CPC ..... *E04F 10/02* (2013.01); *E04H 15/34* (2013.01); *E04H 15/54* (2013.01); *E04H 15/58* (2013.01)

(58) Field of Classification Search
CPC ..... E04H 15/54; E04H 15/58; E04F 10/02
See application file for complete search history.

(56) References Cited

U.S. PATENT DOCUMENTS 711,225 A 10/1902 Putnam et al.
1,061,547 A 5/1913 Kennedy
(Continued)

FOREIGN PATENT DOCUMENTS

CH 635393 A5 3/1983
CN 304975581 S 1/2019
WO WO-2009106024 A1 * 9/2009 ..... E04H 15/54

OTHER PUBLICATIONS

Sunjoy Allen and Roth YouTube https://www.youtube.com/watch?v=QpjYE902oMw&app=desktop Posted May 21, 2018 (Year: 2018).
(Continued)

*Primary Examiner* — Noah Chandler Hawk
(74) *Attorney, Agent, or Firm* — The Law Office of Patrick F. O'Reilly, III, LLC

(57) ABSTRACT

An outdoor shelter and a rail system for the outdoor shelter are described herein. The outdoor shelter may include at least one pair of support post members, each pair of support post members including a first support post member being spaced apart from a second support post member; a first guide rail member coupled to the first support post member; a second guide rail member coupled to the second support post member; and a shade support pole member slidably coupled to the first and second guide rail members, the shade support pole member being coupled to an end portion of a shade member of the outdoor shelter, and the shade support pole member configured to be slidably displaced along the lengths of the first and second guide rail members so as to allow an amount by which the shade member overhangs a side of the outdoor shelter to be user-adjusted.

16 Claims, 36 Drawing Sheets

Related U.S. Application Data which is a continuation-in-part of application No. 15/599,455, filed on May 18, 2017, now Pat. No. 10,214,938.

(60) Provisional application No. 62/339,138, filed on May 20, 2016.

(51) Int. Cl.
*E04H 15/54* (2006.01)
*E04H 15/58* (2006.01)

(56) References Cited

U.S. PATENT DOCUMENTS

| | | | |
|---|---|---|---|
| 2,589,647 | A | 3/1952 | Gelder et al. |
| 2,948,288 | A | 8/1960 | Nelson |
| 3,140,563 | A | 7/1964 | Allen |
| 4,541,214 | A | 9/1985 | Lambert |
| D293,934 | S | 1/1988 | Lambert et al. |
| 5,148,646 | A | 9/1992 | Lutostanski |
| 5,927,311 | A | 7/1999 | Jager |
| 6,006,809 | A | 12/1999 | Williams et al. |
| 6,088,989 | A | 7/2000 | Matsu et al. |
| D464,438 | S | 10/2002 | Skulsky |
| D485,367 | S | 1/2004 | Skulsky |
| D523,969 | S | 6/2006 | Abruzese et al. |
| 7,165,372 | B1 | 1/2007 | Skulsky |
| 7,335,096 | B2 | 2/2008 | Perez et al. |
| D565,198 | S | 3/2008 | Tung |
| D602,602 | S | 10/2009 | Sears |
| D603,058 | S | 10/2009 | Sears |
| 7,665,270 | B1 | 2/2010 | Moffly |
| 7,669,373 | B2 | 3/2010 | Muir |
| 7,900,417 | B1 | 3/2011 | Leines |
| 8,061,106 | B2 | 11/2011 | Clark |
| 8,240,097 | B2 | 8/2012 | Day et al. |
| 8,347,559 | B2 | 1/2013 | Grazioso |
| 8,413,389 | B2 | 4/2013 | Frigerio |
| D687,969 | S | 8/2013 | Randol et al. |
| 8,640,420 | B1 | 2/2014 | Halley |
| 9,016,594 | B2 | 4/2015 | Sheridan |
| 9,243,422 | B2 | 1/2016 | Hunt et al. |
| 9,556,639 | B2 | 1/2017 | Hunt et al. |
| 9,624,689 | B2 | 4/2017 | Bailey et al. |
| D785,814 | S | 5/2017 | Koo et al. |
| D799,062 | S | 10/2017 | Larin et al. |
| D802,797 | S | 11/2017 | Morrison |
| 10,214,938 | B2 | 2/2019 | Pan |
| D856,530 | S | 8/2019 | Oskoui |
| 10,760,280 | B2 | 9/2020 | Pan et al. |
| 2004/0025460 | A1* | 2/2004 | Terrels ..... E04F 11/1812 52/298 |
| 2007/0017646 | A1 | 1/2007 | Zhao |
| 2016/0130836 | A1 | 5/2016 | Shargani |
| 2016/0258182 | A1 | 9/2016 | Xie |
| 2017/0009483 | A1 | 1/2017 | Xie |
| 2017/0022731 | A1 | 1/2017 | Xie |
| 2017/0183876 | A1 | 6/2017 | Bailey et al. |
| 2017/0335595 | A1 | 11/2017 | Pan |
| 2019/0136538 | A1 | 5/2019 | Pan et al. |

OTHER PUBLICATIONS

Sunjoy Pergolas Overstock https://www.overstock.com/Home-Garden/Gazebos-Pergolas/22409/subcat.html?featuredproduct=19976027&featuredoption=33225785&AID=13516709&PID=7494768&SID=460579997&cjevent=16117e4c1fa2fc3db24923f169000317f7393a08b3b73ee7f&entrytrigger=noshow&exittrigger=noshow&fp=F&utm_source (Year: 2018).

Restriction Requirement in U.S. Appl. No. 29/675,398, dated Feb. 26, 2020.

First office action on the merits (Non-Final Rejection) in U.S. Appl. No. 29/675,398, dated Jul. 15, 2020.

Notice of Allowance in U.S. Appl. No. 29/675,398, dated Nov. 24, 2020.

* cited by examiner

Detail "A"

Detail "B"

Detail "C"

Detail "D"

Detail "E"

Detail "F"

Detail "G"

Detail "H"

Detail "I"

Detail "J"

Detail "K"

Detail "L"

Detail "M"

Detail "N"

Detail "O"

Detail "P"

Detail "Q"

Detail "R"

RAIL SYSTEM FOR AN OUTDOOR SHELTER

CROSS-REFERENCE TO RELATED APPLICATIONS

This patent application is a continuation-in-part of application Ser. No. 16/237,529, entitled "Rail System For An Outdoor Shelter", filed Dec. 31, 2018, which is a continuation-in-part of application Ser. No. 15/599,455, entitled "Rail System For An Outdoor Shelter", filed May 18, 2017, now U.S. Pat. No. 10,214,938, which claims priority to U.S. Provisional Patent Application No. 62/339,138, entitled "Rail System For An Outdoor Shelter", filed on May 20, 2016, the disclosure of each of which is hereby incorporated by reference as if set forth in their entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a rail system for an outdoor shelter. More particularly, the invention relates to a rail system for an outdoor shelter that enables a shade member of the outdoor shelter to be adjusted.

2. Background and Description of Related Art

Portable outdoor shelters, such as portable gazebos and pergolas, are useful for a myriad of different applications. For example, outdoor gazebos and pergolas are often used for backyard patio gathering spaces. Because the outdoor gazebos and pergolas are at least partially enclosed, table and chair sets may be arranged underneath the outdoor gazebo or pergola so that the individuals seated around the table may remain cooler by being shaded from direct sunlight. Also, when food is being served outside, a food serving table or tables are often placed underneath the gazebo or pergola to protect the food from direct sunlight and rain.

Although, the shading elements of conventional outdoor shelters are not adjustable so as to allow the amount of shade to be adjusted by a user. For example, conventional outdoor shelters have fixed roof structures that are not capable of being adjusted. As such, conventional outdoor shelters have no means of compensating for the directional differences in the sunlight entering the outdoor shelter throughout the course of the day.

Therefore, what is needed is a rail system for an outdoor shelter that enables the shade member of the outdoor shelter to be readily adjusted by a user so as to permit shading qualities of the outdoor shelter to be modified. In addition, a rail system for an outdoor shelter is needed that allows the shade member of the outdoor shelter to be easily adjusted for the directional differences in the sunlight entering the outdoor shelter throughout the course of the day.

BRIEF SUMMARY OF EMBODIMENTS OF THE INVENTION

Accordingly, the present invention is directed to a rail system for an outdoor shelter and an outdoor shelter including the same that substantially obviates one or more problems resulting from the limitations and deficiencies of the related art.

In accordance with one or more embodiments of the present invention, there is provided an outdoor shelter that includes at least one pair of support post members, each pair of support post members comprising a first support post member being spaced apart from a second support post member; a first guide rail member coupled to the first support post member; a second guide rail member coupled to the second support post member; and a shade support pole member slidably coupled to the first and second guide rail members, the shade support pole member being coupled to an end portion of a shade member of the outdoor shelter, and the shade support pole member configured to be slidably displaced along the lengths of the first and second guide rail members so as to allow an amount by which the shade member overhangs a side of the outdoor shelter to be adjusted by a user.

In a further embodiment of the present invention, the first guide rail member is coupled to the first support post member by a guide rail connector member.

In yet a further embodiment, the guide rail connector member comprises a guide rail aperture extending longitudinally therein, the guide rail aperture configured to receive a longitudinal section of the first guide rail member.

In still a further embodiment, the guide rail connector member comprises a fastener aperture disposed therethrough, the fastener aperture configured to receive a fastener member for securing the guide rail connector member and the first guide rail member to the first support post member.

In yet a further embodiment, the fastener member is configured to pass through the guide rail connector member, through the first guide rail member, and into a side of the first support post member.

In still a further embodiment, the shade support pole member is slidably coupled to the first and second guide rail members by a pair of spaced-apart shade support pole connector members, at least one of the pair of spaced-apart shade support pole connector members being disposed proximate to a longitudinal end of the shade support pole member.

In yet a further embodiment, at least one of the pair of spaced-apart shade support pole connector members comprises a tubular portion and a flange portion, the tubular portion of the shade support pole connector member having a pole receiving cavity formed therein for slidably engaging a respective one of the first and second guide rail members, and the flange portion of the shade support pole connector member extending outwardly from the tubular portion of the shade support pole connector member.

In still a further embodiment, the outdoor shelter further comprises at least one peripheral beam member, the at least one peripheral beam member configured to be disposed between a first pair of the support post members and a second pair of the support post members, the at least one peripheral beam member having a curved configuration such that a center portion of the at least one peripheral beam member is disposed higher than end portions of the at least one peripheral beam member.

In yet a further embodiment, the end portion of the shade member is looped so as to form a longitudinal cavity for receiving the shade support pole member.

In still a further embodiment, the end portion of the shade member comprises at least one handle cutout portion formed in an edge thereof, the at least one handle cutout portion and a longitudinal section of the shade support pole member together defining a handle aperture configured to receive a portion of a hand of the user so as to facilitate the grasping of the shade member and the shade support pole member by the user during the adjustment of the shade member.

In accordance with one or more other embodiments of the present invention, there is provided a rail system for an outdoor shelter that includes a plurality of support post members disposed at respective corners of the outdoor shelter, the plurality of support post members comprising a first support post member and a second support post member disposed at a first longitudinal end of the outdoor shelter, the plurality of support post members further comprising a third support post member and a fourth support post member disposed at a second longitudinal end of the outdoor shelter; a first guide rail member coupled to the first support post member; a second guide rail member coupled to the second support post member; a third guide rail member coupled to the third support post member; a fourth guide rail member coupled to the fourth support post member; a first shade support pole member slidably coupled to the first and second guide rail members, the first shade support pole member being coupled to a first end portion of a shade member of the outdoor shelter, the first shade support pole member configured to be slidably displaced along the lengths of the first and second guide rail members so as to allow an amount by which the shade member overhangs a first side of the outdoor shelter to be adjusted by a user; and a second shade support pole member slidably coupled to the third and fourth guide rail members, the second shade support pole member being coupled to a second end portion of the shade member of the outdoor shelter, the second shade support pole member configured to be slidably displaced along the lengths of the third and fourth guide rail members so as to allow an amount by which the shade member overhangs a second side of the outdoor shelter to be adjusted by the user. In this embodiment, when the amount by which the shade member overhangs the first side of the outdoor shelter is increased by the user, the amount by which the shade member overhangs the second side of the outdoor shelter is decreased.

In a further embodiment of the present invention, the first, second, third, and fourth guide rail members are respectively coupled to the first, second, third, and fourth support post members by one or more guide rail connector members.

In yet a further embodiment, the first shade support pole member is slidably coupled to the first and second guide rail members by a first pair of spaced-apart shade support pole connector members, the second shade support pole member is slidably coupled to the third and fourth guide rail members by a second pair of spaced-apart shade support pole connector members, at least one of the spaced-apart shade support pole connector members being disposed proximate to a longitudinal end of the first and second shade support pole members.

In accordance with yet one or more other embodiments of the present invention, there is provided an outdoor shelter that includes a plurality of corner support members disposed at respective corners of the outdoor shelter, the plurality of corner support members comprising a first corner support member and a second corner support member disposed at a first longitudinal end of the outdoor shelter, the plurality of corner support members further comprising a third corner support member and a fourth corner support member disposed at a second longitudinal end of the outdoor shelter; a plurality of peripheral beam members, a first one of the plurality of peripheral beam members configured to extend in a longitudinal direction between the first and third corner support members, and a second one of the plurality of peripheral beam members configured to extend in a transverse direction between the first and second corner support members; and a shade member, the shade member configured to be slidably coupled to one or more of the plurality of corner support members so as to allow an amount by which the shade member overhangs a side of the outdoor shelter to be adjusted by a user.

In a further embodiment of the present invention, the first one of the plurality of peripheral beam members has a curved configuration such that a center portion of the first one of the plurality of peripheral beam members is disposed higher than end portions of the first one of the plurality of peripheral beam members.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
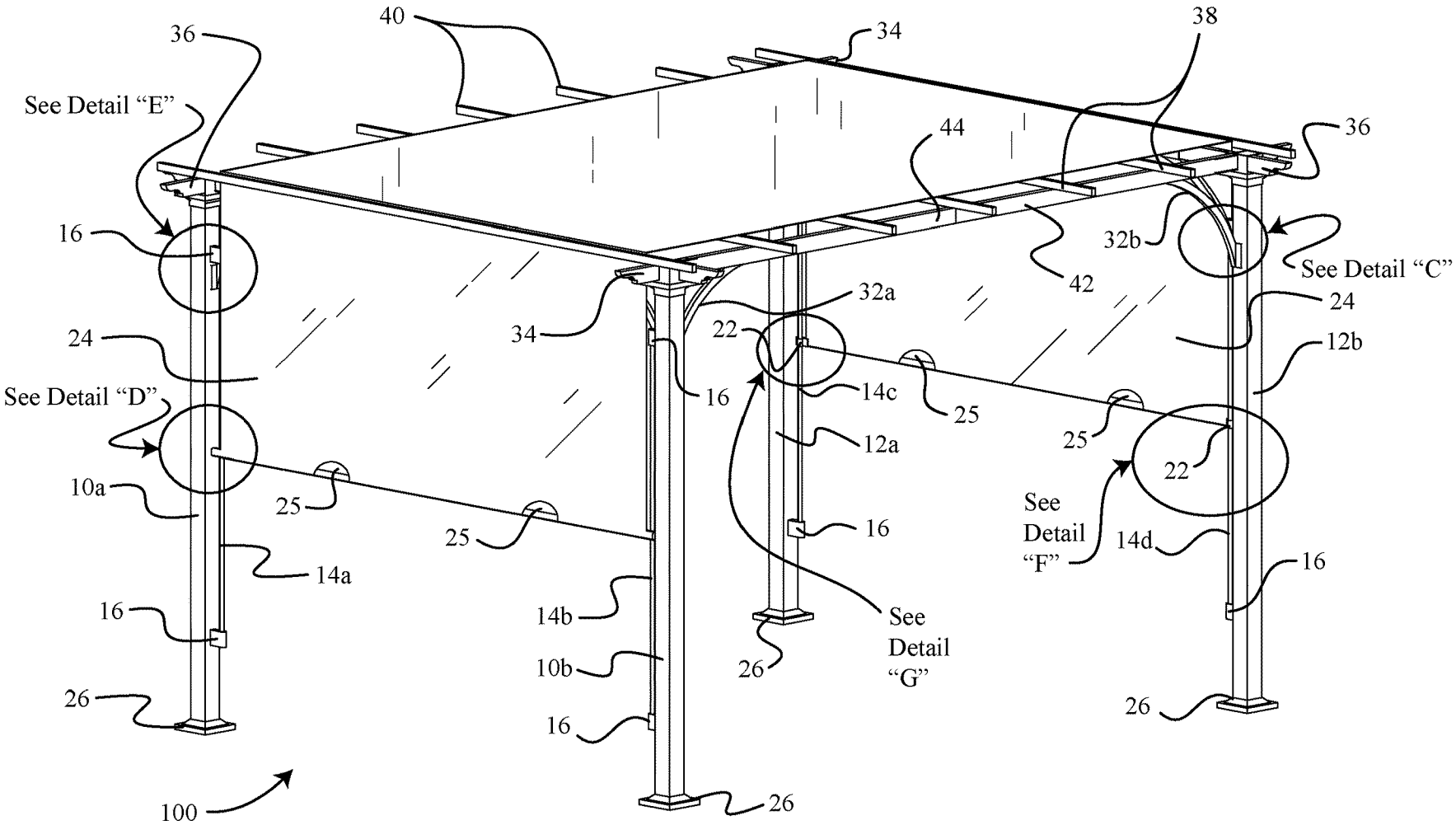
FIG. 1 is an assembled perspective view of an outdoor shelter having a rail system, according to a first embodiment of the invention.
Figure 2:
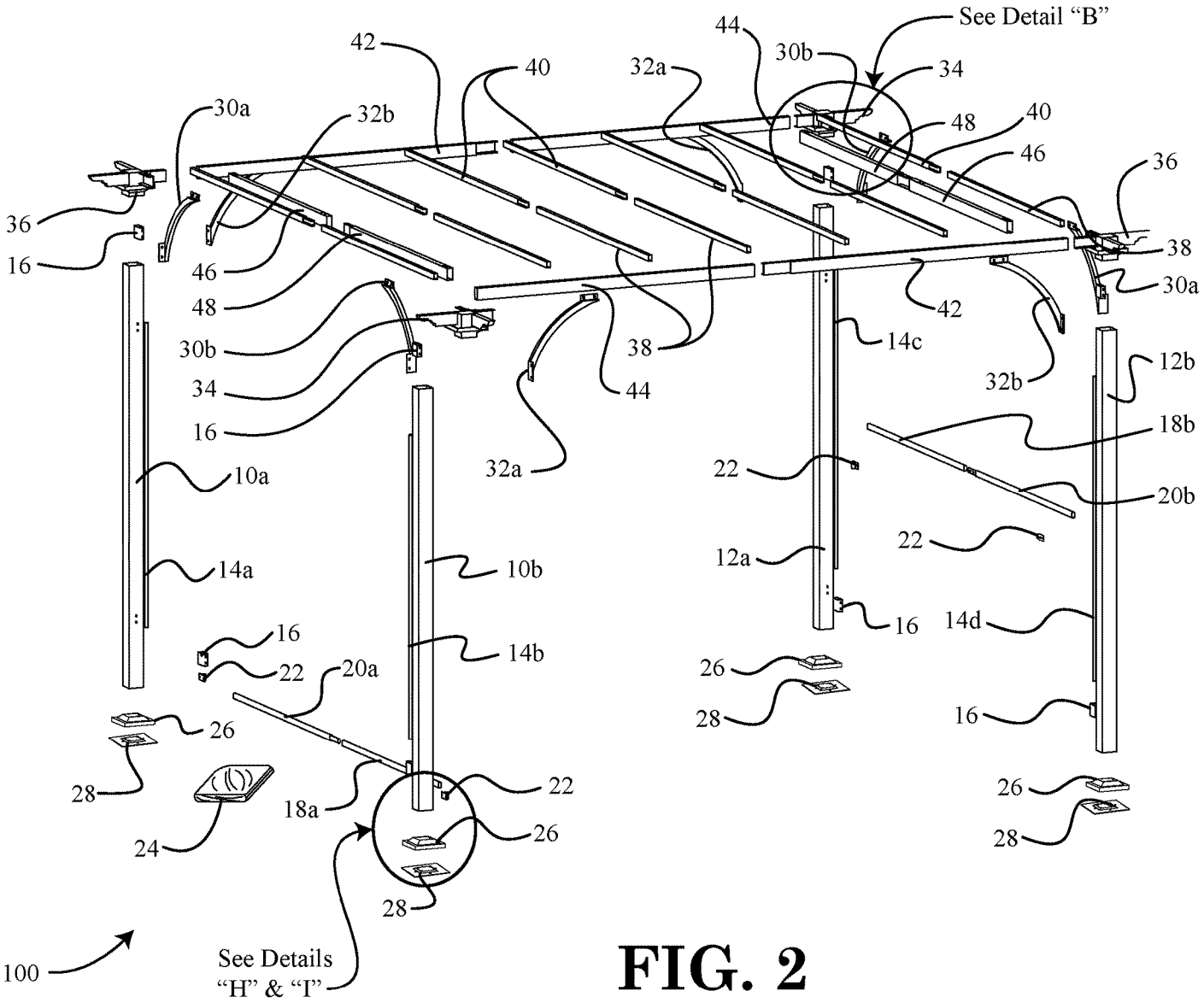
FIG. 2 is an exploded perspective view of the outdoor shelter of FIG. 1.

A first exemplary embodiment of an outdoor shelter in the form of a pergola is seen generally at 100 in FIGS. 1 and 2. Initially, referring to the exploded perspective view of FIG. 2, it can be seen that the frame system of the outdoor shelter 100 generally comprises a plurality of vertical support members (e.g., corner support post members 10*a*, 10*b*, 12*a*, 12*b*); a plurality of transverse roof beam members 38, 40, a plurality of longitudinal roof beam members 42, 44, and a plurality of end roof beam members 46, 48. As will be described hereinafter, an adjustable shade member 24 is supported on the frame system of the outdoor shelter 100 so as to partially enclose the outdoor shelter 100.

Figure 14:
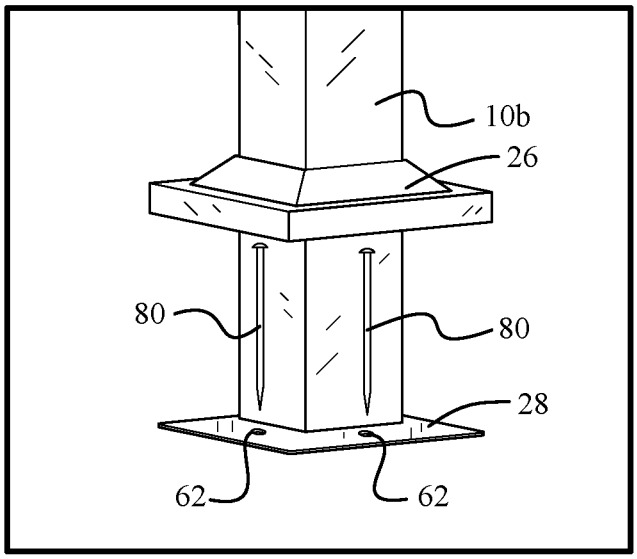
FIG. 14 is an enlarged, partial perspective view illustrating the manner in which one of the ground stake plates in FIG. 2 is secured using stakes (Detail "I")

As shown in FIGS. 1 and 2, the vertical support members of the portable shelter framing system of the illustrated embodiment are in the form of corner support post members 10*a*, 10*b*, 12*a*, 12*b*. First and second ones of the plurality of corner support post members 10*a*, 10*b* are disposed at a first longitudinal end of the outdoor shelter 100, while third and fourth ones of the plurality of corner support post members 12*a*, 12*b* are disposed at a second longitudinal end of the outdoor shelter 100. That is, a first pair of the corner support post members 10*a*, 10*b* is disposed at a first longitudinal end of the outdoor shelter 100, while a second pair of the corner support post members 12*a*, 12*b* is disposed at a second longitudinal end of the outdoor shelter 100. As shown in FIG. 1, each of the two pairs of support post members comprises spaced-apart corner support post members 10*a*, 10*b*, 12*a*, 12*b* disposed at opposite longitudinal ends of the outdoor shelter 100. With reference again to the exploded perspective view of FIG. 2, it can be seen that each corner post support member 10*a*, 10*b*, 12*a*, 12*b* has a respective corner bracket member 34, 36 mounted thereto. As will be explained in more detail hereinafter, the corner bracket members 34, 36 connect the peripheral roof frame members 42, 44, 46, 48 to the corner support post members 10*a*, 10*b*, 12*a*, 12*b*. In addition, as shown in FIG. 2, each of the corner support post members 10*a*, 10*b*, 12*a*, 12*b* is provided with a ground stake plate 28 for securely attaching the outdoor shelter 100 to the ground or a floor slab. With combined reference to detail views in FIGS. 14 and 16, it can be seen that the ground stake plate 28 is provided with a plurality of outer apertures 62 for receiving stakes 80 for anchoring the outdoor shelter 100 to the ground (e.g., to the lawn of a user). Alternatively, the outer apertures 62 may be used for receiving fasteners, such as screws or bolts, for anchoring the outdoor shelter 100 to a floor slab (e.g., to a concrete patio slab of the user). For example, as shown in FIG. 14, when the outdoor shelter 100 is anchored to the ground (e.g., to a lawn), a plurality of ground stakes 80 are used to anchor each plate 28 to the ground. Alternatively, when the outdoor shelter 100 is anchored to a floor (e.g., to a concrete slab or wood floor), a plurality of threaded fasteners (e.g., expansion bolts) may be used to anchor each plate 28 to the floor.

Figure 13:
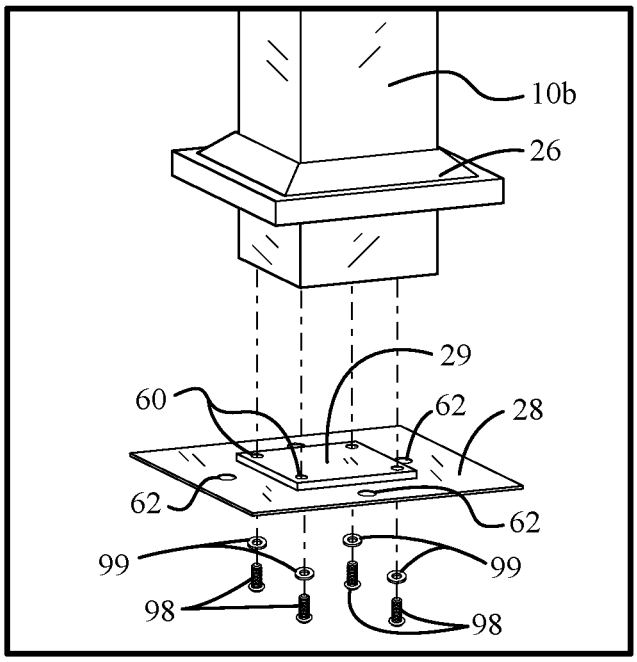
FIG. 13 is an enlarged, partial perspective view illustrating the connection between one of the corner post members and its respective ground stake plate in FIG. 2 (Detail "H")
Figure 16:
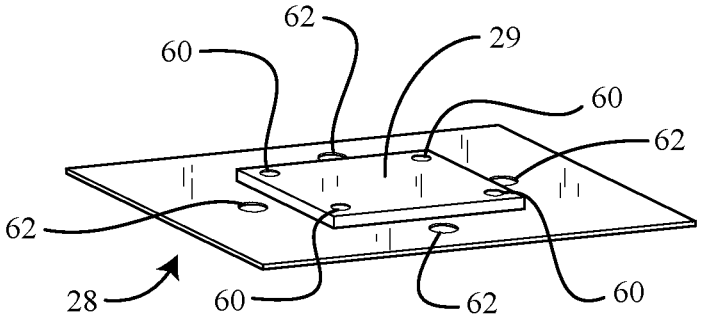
FIG. 16 is a perspective view of one of the ground stake plates of the outdoor shelter of FIG. 1.

Next, with combined reference to FIGS. 13 and 16, the manner in which each of the ground stake plates 28 are attached to their respective corner support post members 10*a*, 10*b*, 12*a*, 12*b* will be described. As shown in the illustrated embodiment of FIG. 13, the ground stake plate 28 comprises a raised central portion 29 that is received within the bottom end of the corner support post member 10*b*. The raised central portion 29 of the ground stake plate 28 comprises a plurality of fastener apertures 60 disposed therethrough that receive respective fasteners (e.g., screws 98) for securing the ground stake plate 28 to the bottom end of the corner post support member 10*b*. Also, as shown in FIG. 13, in the illustrative embodiment, each fastener 98 is provided with a respective washer 99 that is configured to be disposed between the head of the fastener 98 and the bottom surface of the plate 28. In FIGS. 13 and 16, it can be seen that the fastener apertures 60 are disposed inwardly from the stake apertures 62. In other words, the stake apertures 62 are disposed closer to a periphery of the ground stake plate 28 than the fastener apertures 60.

Figure 15:
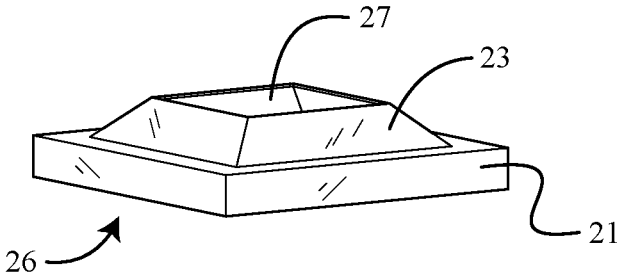
FIG. 15 is a perspective view of one of the ground plate cover members of the outdoor shelter of FIG. 1.

Also, as illustrated in FIGS. 1 and 2, each of the corner support post members 10*a*, 10*b*, 12*a*, 12*b* is provided with a respective ground plate cover member 26 to conceal each ground stake plate 28 and the stakes 80 or fasteners used to secure outdoor shelter 100 to the ground or floor. As shown in FIG. 15, the illustrated ground plate cover member 26 comprises a bottom base portion 21 that is generally in the shape of a square prism, and a top portion 23 that is generally in the shape of a truncated pyramid. The ground plate cover member 26 further comprises a central aperture 27 formed therethrough for accommodating a passage of the corner support post member 10*a*, 10*b*, 12*a*, or 12*b* through the ground plate cover member 26.

Next, with reference again to FIGS. 1 and 2, the rail system of the exemplary outdoor shelter 100 will be explained in detail. As best shown in the exploded view of FIG. 2, in the illustrative embodiment, the rail system of the exemplary outdoor shelter 100 generally includes the plurality of support post members 10*a*, 10*b*, 12*a*, 12*b* disposed at the respective corners of the outdoor shelter 100, a first guide rail member 14*a* coupled to the first one of the plurality of support post members 10*a*, a second guide rail member 14*b* coupled to the second one of the plurality of support post members 10*b*, a third guide rail member 14*c* coupled to the third one of the plurality of support post members 12*a*, a fourth guide rail member 14*d* coupled to the fourth one of the plurality of support post members 12*b*, a first shade support pole member 18*a*, 20*a* slidably coupled to the first and second guide rail members 14*a*, 14*b*, and a second shade support pole member 18*b*, 20*b* slidably coupled to the third and fourth guide rail members 14*c*, 14*d*. The first shade support pole member 18*a*, 20*a* is attached to a first end portion of a shade member 24 of the outdoor shelter (see FIGS. 1 and 2), while the second shade support pole member 18*b*, 20*b* is attached to a second end portion of the shade member 24 of the outdoor shelter 100. The first shade support pole member 18*a*, 20*a* is configured to be slidably displaced along the lengths of the first and second guide rail members 14*a*, 14*b* so as to allow an amount by which the shade member 24 overhangs a first side of the outdoor shelter 100 to be adjusted by a user. Similarly, the second shade support pole member 18*b*, 20*b* is configured to be slidably displaced along the lengths of the third and fourth guide rail members 14*c*, 14*d* so as to allow an amount by which the shade member 24 overhangs a second side of the outdoor shelter 100 to be adjusted by the user. In the illustrated embodiment, when the amount by which the shade member 24 overhangs the first side of the outdoor shelter 100 is increased by the user (e.g., by pulling on the lower end of the shade member 24 with shade support pole member 18*a*, 20*a*), the amount by which the shade member 24 overhangs the second side of the outdoor shelter 100 is decreased. In other words, pulling down on one end of the shade member 24 will raise the shade member 24 on the opposite longitudinal end of the outdoor shelter 100 because the shade member 24 has a constant overall length.

Figure 10:
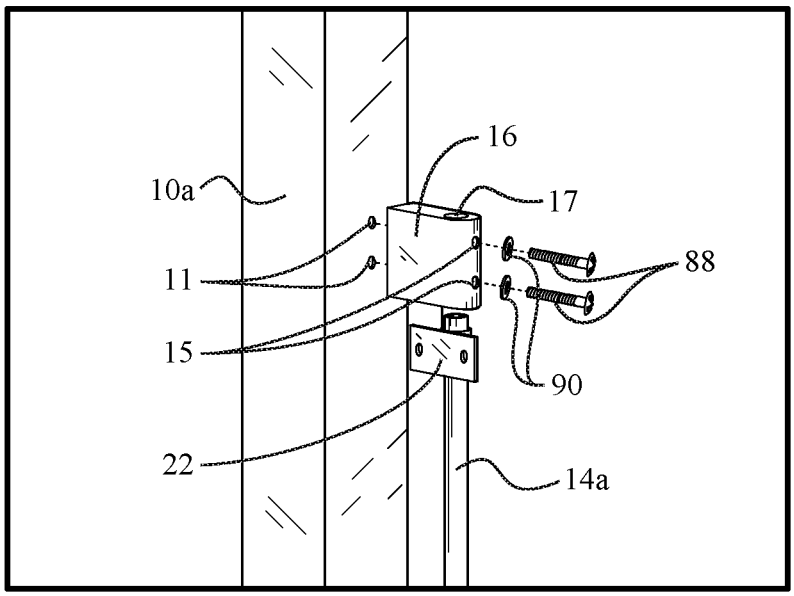
FIG. 10 is an enlarged, partial perspective view illustrating the connection between one of the guide rail connector members, one of the guide rail members, and one of the corner post members in FIG. 1 (Detail "E")
Figure 17:
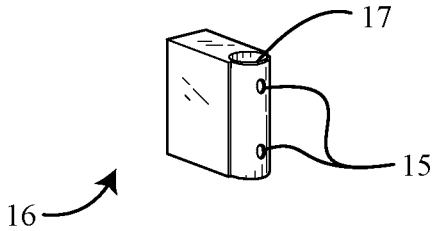
FIG. 17 is a perspective view of one of the guide rail connector members of the outdoor shelter of FIG. 1.

With continued reference to FIGS. 1 and 2, it can be seen that the first, second, third, and fourth guide rail members 14*a*, 14*b*, 14*c*, 14*d* are each coupled to respective first, second, third, and fourth ones of the corner support post members 10*a*, 10*b*, 12*a*, 12*b* by means of a pair of spaced-apart guide rail connector members 16. That is, as shown in these figures, each guide rail member 14*a*, 14*b*, 14*c*, 14*d* is supported at its longitudinal ends by oppositely disposed guide rail connector members 16. In the illustrated embodiment, each guide rail connector member 16 is in the form of a generally rectangular block with one semi-circular side (see FIG. 17). Each guide rail connector member 16 has a circular aperture 17 disposed longitudinally therethrough for receiving the cylindrical longitudinal end portion of the guide rail member 14*a*, 14*b*, 14*c*, 14*d*, which is in the form of a cylindrical rod in the illustrative embodiment. In addition, as shown in FIG. 17, each guide rail connector member 16 may be provided with a plurality of spaced-apart fastener apertures 15 for receiving fasteners (e.g., screws or bolts) for securing the guide rail connector member 16 and a respective one of the guide rail members 14*a*, 14*b*, 14*c*, or 14*d* to the side of one of the corner support post members 10*a*, 10*b*, 12*a*, or 12*b*. For example, as shown in FIG. 10, each fastener member (e.g., screw 88) is configured to pass through the guide rail connector member 16, through the guide rail member 14*a*, and into a side of the corner support post member 10*a* through a respective fastener aperture 11. Also, as shown in FIG. 10, in the illustrative embodiment, each fastener 88 is provided with a respective washer 90 that is configured to be disposed between the head of the fastener 88 and the semi-circular side of the guide rail connector member 16.

Figure 9:
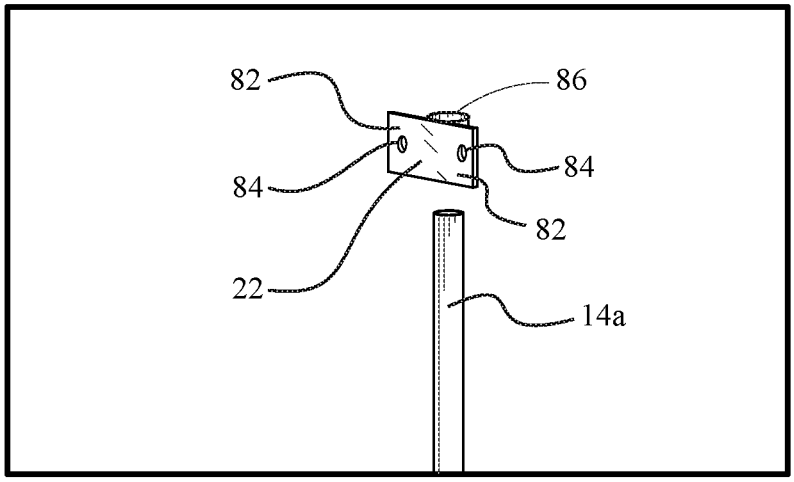
FIG. 9 is an enlarged, partial perspective view illustrating the engagement between one of the shade support pole connector members and one of the guide rail members in FIG. 1 (Detail "D")
Figure 12:
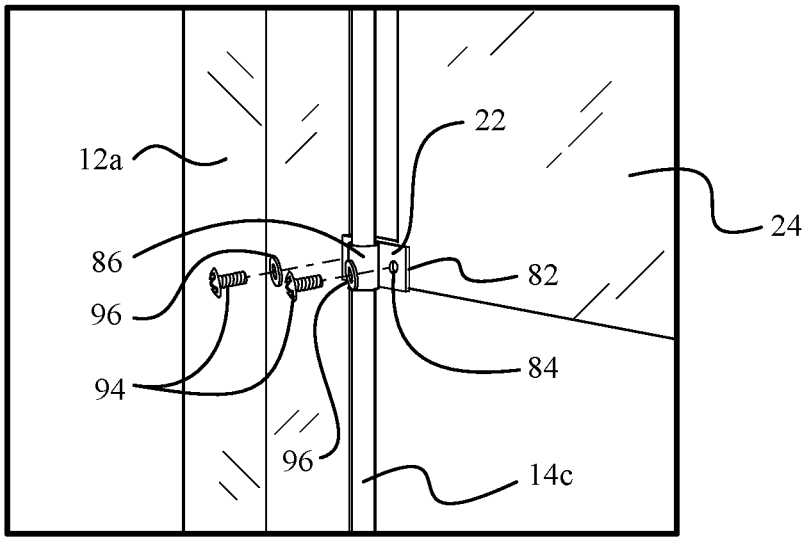
FIG. 12 is an enlarged, partial perspective view illustrating the connection between one of the shade support pole connector members and one of the shade support pole members in FIG. 1 (Detail "G")

Turning again to the illustrative embodiment of FIG. 2, the first shade support pole member 18*a*, 20*a* is slidably coupled to the first and second guide rail members 14*a*, 14*b* by means of a first pair of spaced-apart shade support pole connector members 22. Similarly, the second shade support pole member 18*b*, 20*b* is slidably coupled to the third and fourth guide rail members 14*c*, 14*d* by means of a second pair of spaced-apart shade support pole connector members 22. In the illustrative embodiment, each of the spaced-apart shade support pole connector members 22 is disposed proximate to a respective longitudinal end of the first and second shade support pole members 18*a*, 18*b*, 20*a*, 20*b*. That is, the first and second shade support pole members 18*a*, 18*b*, 20*a*, 20*b* are supported at their longitudinal ends by shade support pole connector members 22. In the illustrated embodiment, with reference to FIG. 9, each shade support pole connector member 22 is in the form of a side mount bracket with opposed flanges 82 disposed on opposite sides of a cylindrical body portion 86. The cylindrical body portion 86 of each shade support pole connector member 22 has a circular pole receiving cavity disposed longitudinally therethrough for receiving the cylindrical cross-section of a respective guide rail member 14*a*, 14*b*, 14*c*, 14*d*. In addition, each of the pair of opposed flanges 82 of each shade support pole connector member 22 may be provided with a fastener aperture 84 disposed therein for receiving a fastener (e.g., a screw or bolt) for securing the shade support pole connector member 22 to the back side of one of the shade support pole members 18*a*, 18*b*, 20*a*, 20*b* (see FIG. 12). For example, as shown in FIG. 12, each fastener member (e.g., screw 94) is configured to pass through the flange 82 of the shade support pole connector member 22, through the back side of the shade member 24, and into a back side of one of the shade support pole members 18*a*, 18*b*, 20*a*, 20*b*. Also, as shown in FIG. 12, in the illustrative embodiment, each fastener 94 is provided with a respective washer 96 that is configured to be disposed between the head of the fastener 94 and the back side of the shade member 24. By means of the shade support pole members 18*a*, 18*b*, 20*a*, 20*b*, the shade support pole connector members 22 slidably couple the opposed longitudinal ends of the shade member 24 to the guide rail members 14*a*, 14*b*, 14*c*, 14*d*. As depicted in the illustrative detail view of FIG. 9, during the assembly of the outdoor shelter 100, the shade support pole connector member 22 is slipped over the end of its respective guide rail member 14*a* prior to being attached to the shade support pole member 18*a*, 20*a*.

Figure 11:
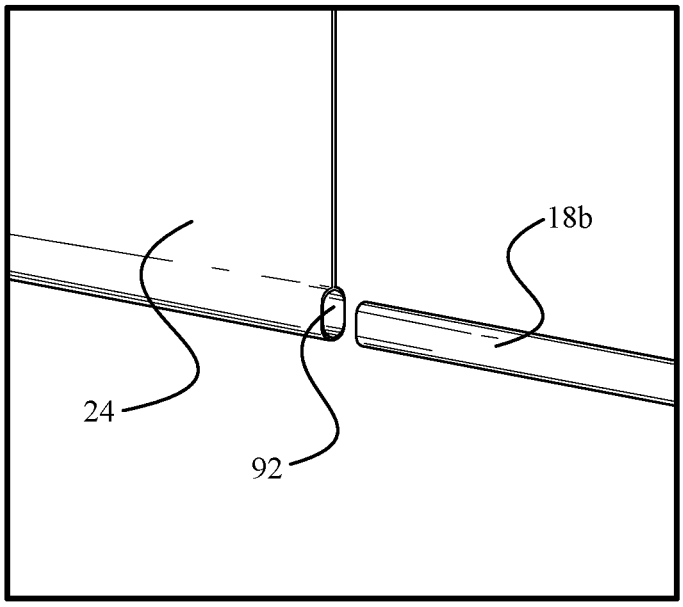
FIG. 11 is an enlarged, partial perspective view illustrating the engagement between one of the shade support pole members and the longitudinal cavity at one of the ends of the shade member in FIG. 1 (Detail "F")

Referring again to the exploded view of FIG. 2, it can be seen that, in the first illustrative embodiment, the first and second shade support pole members 18*a*, 18*b*, 20*a*, 20*b* each comprise a pair of shade support pole sections 18*a*, 20*a* and 18*b*, 20*b*. A first one 20*a*, 20*b* of each pair of shade support pole sections has an end portion of reduced cross-sectional area that is receivable within a recess of an end portion of a second one 18*a*, 18*b* of the pair of shade support pole sections. That is, the end portion of each shade support pole section 20*a*, 20*b* is received within the central recess of a respective shade support pole section 18*a*, 18*b*. Also, in the illustrated embodiment, the end portion of each shade support pole section 20*a*, 20*b* may be secured within the recess of its respective shade support pole section 18*a*, 18*b* by means of a plurality of fasteners (e.g., screws or bolts) passing through the paired shade support pole sections 18*a*, 20*a* and 18*b*, 20*b*. In the illustrative embodiment, the first and second longitudinal end portions of the shade member 24 are looped so as to form cavities 92 (or pockets) for receiving respective first and second shade support pole members 18*a*, 20*a* and 18*b*, 20*b* (refer to FIG. 11). That is, the first paired shade support pole sections 18*a*, 20*a* are inserted into the first looped longitudinal end portion of the shade member 24, and the second paired shade support pole sections 18*b*, 20*b* are inserted into the second looped longitudinal end portion of the shade member 24 before the shade support pole members 18*a*, 18*b*, 20*a*, 20*b* are secured to the guide rail members 14*a*, 14*b*, 14*c*, 14*d* by means of the shade support pole connector members 22.

In the illustrative embodiment, the shade member 24 of the outdoor shelter 100 may be formed from a fabric material. For example, in one or more exemplary embodiments, the shade member 24 may be formed from a waterproof fabric material so that the area underneath the shade member 24 of the outdoor shelter 100 remains dry during a rain storm. In addition, as shown in the overall perspective view of FIG. 1, in the illustrative embodiment, each longitudinal end portion of the shade member 24 may comprise a pair of spaced-apart, semi-circular handle cutout portions formed in the edges of the shade member 24. The handle cutout portion of the shade member 24 and a longitudinal section of the shade support pole member 18*a*, 18*b*, 20*a*, or 20*b* together define a semi-circular handle aperture 25 that is configured to receive a portion of a hand of the user so as to facilitate the grasping of the shade member 24 and the shade support pole member 18*a*, 18*b*, 20*a*, or 20*b* by the user during the adjustment of the shade member 24 (refer to FIG. 1).

Figure 3:
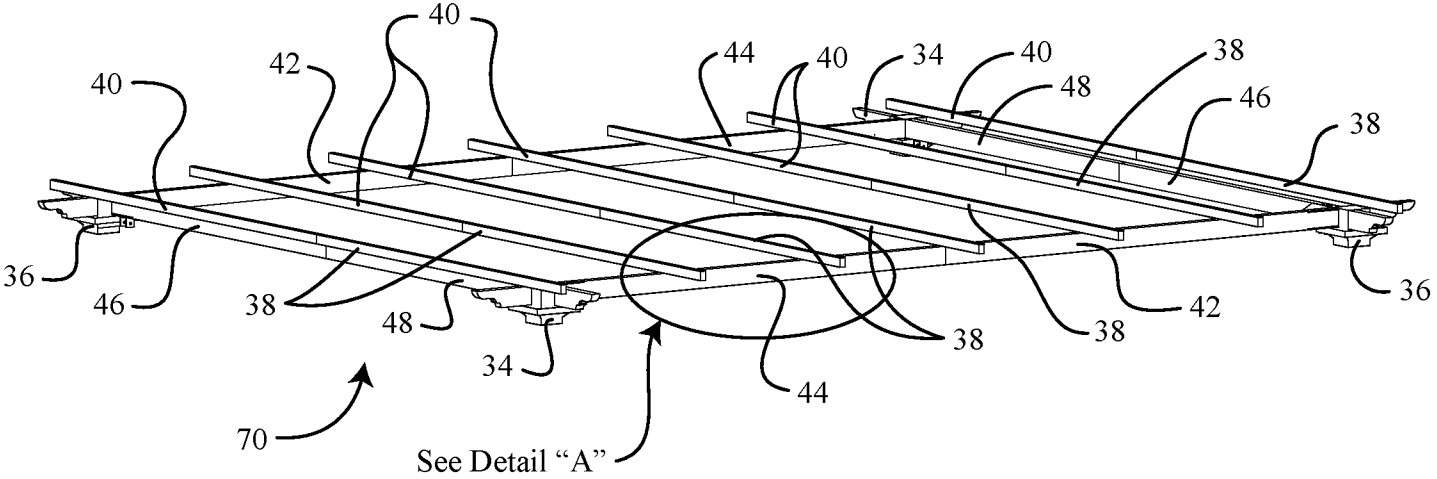
FIG. 3 is a perspective view of the roof structure of the outdoor shelter of FIG. 1.

Next, as best shown in the perspective view of FIG. 3, the roof frame assembly 70 of the outdoor shelter 100 of the illustrative embodiment will be explained. In the illustrative embodiment, the peripheral frame structure of the outdoor shelter 100 is formed by the longitudinal roof beam members 42, 44 and the end roof beam members 46, 48. The longitudinal roof beam members 42, 44 are connected to the end roof beam members 46, 48 by means of the first and second corner bracket members 34, 36 so as to form a rectangular peripheral frame structure for the roof of the outdoor shelter 100. For example, in an exemplary embodiment, the end portions of the longitudinal roof beam members 42, 44 and the end roof beam members 46, 48 may be secured to a respective one of the corner bracket members 34, 36 by means of a plurality of fasteners (e.g., screws or bolts). As best shown in FIGS. 2 and 3, the longitudinal roof beam members 42, 44 extend in a longitudinal direction between one spaced-apart pair of the plurality of corner bracket members 34, 36, while the end roof beam members 46, 48 extend in a transverse direction between another spaced-apart pair of the plurality of corner bracket members 34, 36. In addition, as shown in FIGS. 1-3, in the illustrative embodiment, each of the corner bracket members 34, 36 includes a corner cover member disposed at the base thereof. The corner cover member is configured to be disposed over a top end of one of the corner support post members 10*a*, 10*b*, 12*a*, 12*b* so as to at least partially conceal the top end of the corner support post member 10*a*, 10*b*, 12*a*, 12*b* from view. The corner cover member has a central aperture or recess formed therein for receiving the top end of the corner support post member 10*a*, 10*b*, 12*a*, or 12*b*.

Figure 5:
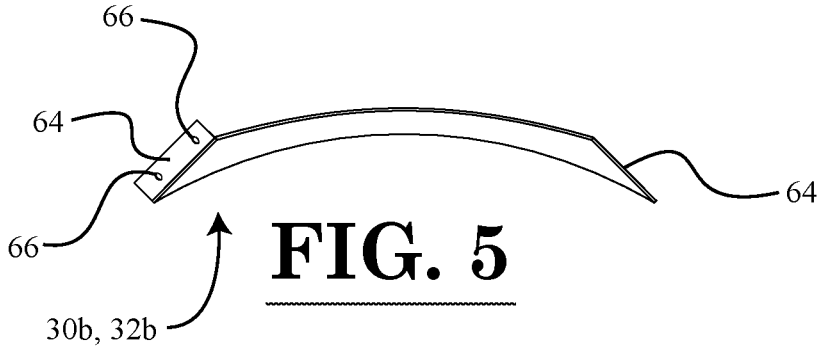
FIG. 5 is a side perspective view of a first one of the arc support members of the outdoor shelter of FIG. 1.
Figure 6:
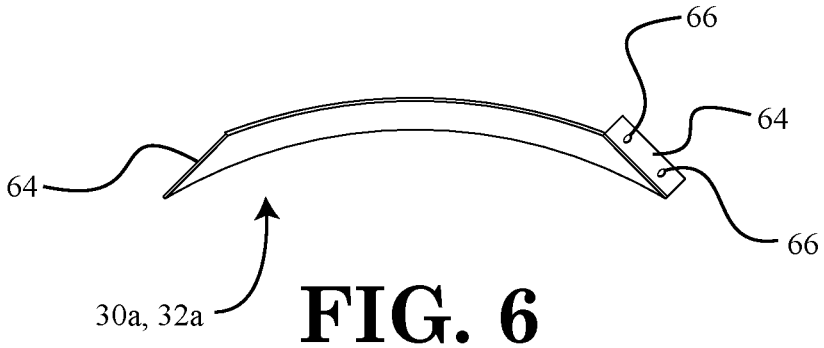
FIG. 6 is a side perspective view of a second one of the arc support members of the outdoor shelter of FIG. 1.
Figure 7:
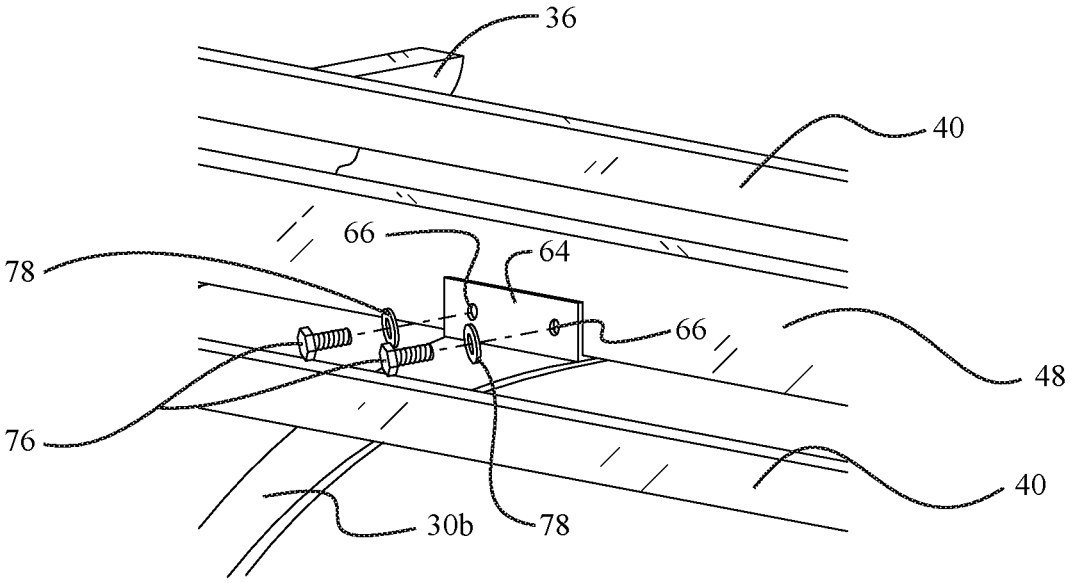
FIG. 7 is an enlarged, partial perspective view illustrating the connection between an upper end of one of the arc support members and one of the transverse roof beam members in FIG. 2 (Detail "B")
Figure 8:
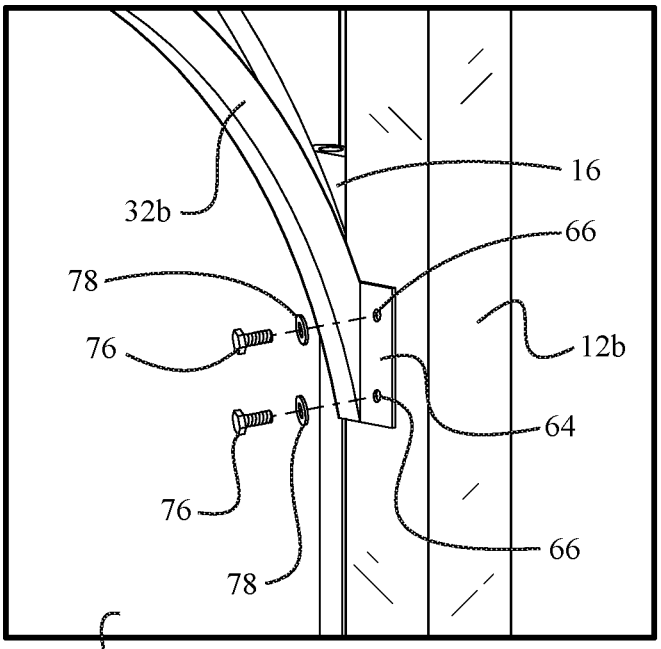
FIG. 8 is an enlarged, partial perspective view illustrating the connection between a lower end of one of the arc support members and one of the corner post members in FIG. 1 (Detail "C")

Each of the corners of the outdoor shelter 100 is reinforced by means of a pair of arc support members 30*a*, 30*b*, 32*a*, 32*b*. That is, as shown in FIG. 1, the arc support members 30*a*, 30*b*, 32*a*, 32*b* attach the roof beam members 42, 44, 46, 48 to sides of the corner support post members 10*a*, 10*b*, 12*a*, 12*b*. That is, each arc support member 30*a*, 30*b*, 32*a*, 32*b* is configured to be attached between a respective one of the corner support post members 10*a*, 10*b*, 12*a*, 12*b* and a respective one of the plurality of peripheral beam members 42, 44, 46, 48. A detail view of a first configuration of the arc support members 30*b*, 32*b* is depicted in FIG. 5, while a second configuration of the arc support members 30*a*, 32*a* is depicted in FIG. 6. The two configurations of the arc support members 30*a*, 30*b*, 32*a*, 32*b* are mounted on opposite sides of the outdoor shelter 100. As shown in FIGS. 5 and 6, each of the arc support members 30*a*, 30*b*, 32*a*, 32*b* comprises a semi-circular body portion with flange portions 64 disposed at each of the oppositely disposed ends of the semi-circular body portion. Also, as shown in FIGS. 5 and 6, each of the flange portions 64 comprises a pair of spaced-apart fastener apertures 66 for receiving fasteners (e.g., screws or bolts) for securing the arc support members 30*a*, 30*b*, 32*a*, 32*b* to either one of the roof beam members 42, 44, 46, 48 or to a side of one of the corner support post members 10*a*, 10*b*, 12*a*, 12*b*. For example, as shown in FIG. 7, each fastener member (e.g., bolt 76) is configured to pass through a respective fastener aperture 66 in the top flange portion 64 of the arc support member 30*b*, and into a side of the end roof beam member 48. Also, as shown in FIG. 7, in the illustrative embodiment, each fastener 76 is provided with a respective washer 78 that is configured to be disposed between the head of the fastener 76 and the side surface of the top flange portion 64 of the arc support member 30*b*. Similarly, turning to FIG. 8, which depicts the illustrative bottom securement of the arc support members 30*a*, 30*b*, 32*a*, 32*b*, each fastener member (e.g., bolt 76) is configured to pass through a respective fastener aperture 66 in the bottom flange portion 64 of the arc support member 32*b*, and into a side of the corner support post member 12*b*. Also, as shown in FIG. 8, and similar to that described above with regard to FIG. 7, each fastener 76 is provided with a respective washer 78 that is configured to be disposed between the head of the fastener 76 and the side surface of the bottom flange portion 64 of the arc support member 32*b*.

Also, as shown in FIGS. 1, 2, and 3, the roof frame structure 70 of the outdoor shelter 100 further comprises a plurality of transverse roof beam members 38, 40 that are mounted to the top surfaces of the longitudinal roof beam members 42, 44 or the top surfaces of the corner bracket members 34, 36 (e.g., by using fasteners, such as screws or bolts). That is, the transverse roof beam members 38, 40 located between the corner support post members 10*a*, 10*b*, 12*a*, 12*b* are supported on the top surfaces of the spaced-apart longitudinal roof beam members 42, 44 (refer to FIG. 3), while the two transverse roof beam members 38, 40 disposed outwardly from the corner support post members 10*a*, 10*b*, 12*a*, 12*b* on the longitudinal ends of the outdoor shelter 100 are supported on the top surfaces of the corner bracket members 34, 36 such that these two transverse roof beam members 38, 40 are supported in a cantilevered manner outwardly from the respective pairs of the plurality of corner support post members 10*a*, 10*b* and 12*a*, 12*b* (see FIGS. 1 and 3).

In the first illustrative embodiment, each one of the transverse roof beam members is formed by a first transverse roof beam section 38 that is affixed to a second transverse roof beam section 40 by a plurality of fasteners (e.g., screws or bolts). Also, in the illustrative embodiment, the transverse roof beam members 38, 40 are generally equally spaced apart across the top of the longitudinal roof beam members 42, 44 so as to form a supporting structure for the shade member 24. As best shown in FIG. 1, the shade member 24 is draped over the top of the middle transverse roof beam members 38, 40. That is, in the illustrative embodiment, the shade member 24 passes over the top of the middle transverse roof beam members 38, 40 when the outdoor shelter 100 is in an assembled state, but not over the two transverse roof beam members 38, 40 at the ends of the outdoor shelter 100.

Figure 4:
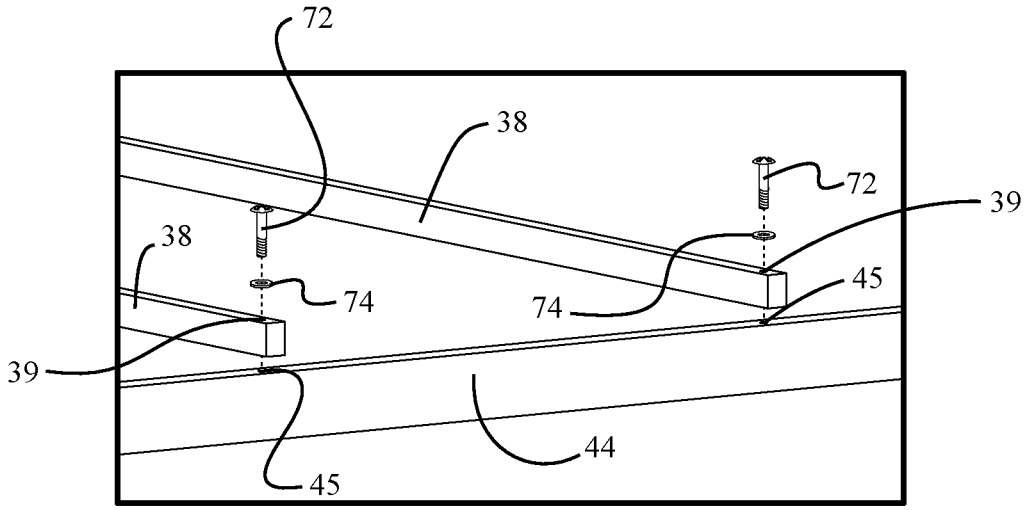
FIG. 4 is an enlarged, partial perspective view illustrating the connection between several of the transverse roof beam members and one of the longitudinal roof beam members in FIG. 3 (Detail "A")

Next, turning to the detail view of FIG. 4, an exemplary manner in which transverse roof beam members 38, 40 may be secured to the longitudinal roof beam members 42, 44 in the illustrative embodiment will be described. As shown in FIG. 4, the ends of the transverse roof beam members 38 are provided with respective fastener apertures 39 for receiving fasteners (e.g., screws or bolts) for securing the transverse roof beam members 38 to the top surface of the longitudinal roof beam member 44. For example, as shown in FIG. 4, each fastener member (e.g., screw 72) is configured to pass through a respective fastener aperture 39 in the transverse roof beam member 38, and into a respective fastener aperture 45 in the top surface of the longitudinal roof beam member 44. Also, as shown in FIG. 4, in the illustrative embodiment, each fastener 72 is provided with a respective washer 74 that is configured to be disposed between the head of the fastener 72 and the top surface of the transverse roof beam member 38. The opposite ends of the transverse roof beam members 38 are secured to the longitudinal roof beam member 42 in a similar manner to that illustrated in FIG. 4.

In one or more embodiments, the framing components of the outdoor shelter 100 (e.g., as illustrated in FIGS. 1 and 2) are formed from a suitable metallic material, such as steel.

However, those of ordinary skill in the art will appreciate that other suitable materials can be used for the various components of the outdoor shelter 100 as well. Also, each of the fastener members described in conjunction with the first embodiment may comprise a plurality of external threads disposed on the outer periphery thereof, and one or more of the fastener apertures with which the threaded fastener members are threadingly engaged may be provided with corresponding internal threads around the circumference thereof so as to obviate the need for the use of nuts (e.g., the fastener aperture that is the furthest in the axial direction from the head of the fastener member may be internally threaded).

Figure 18:
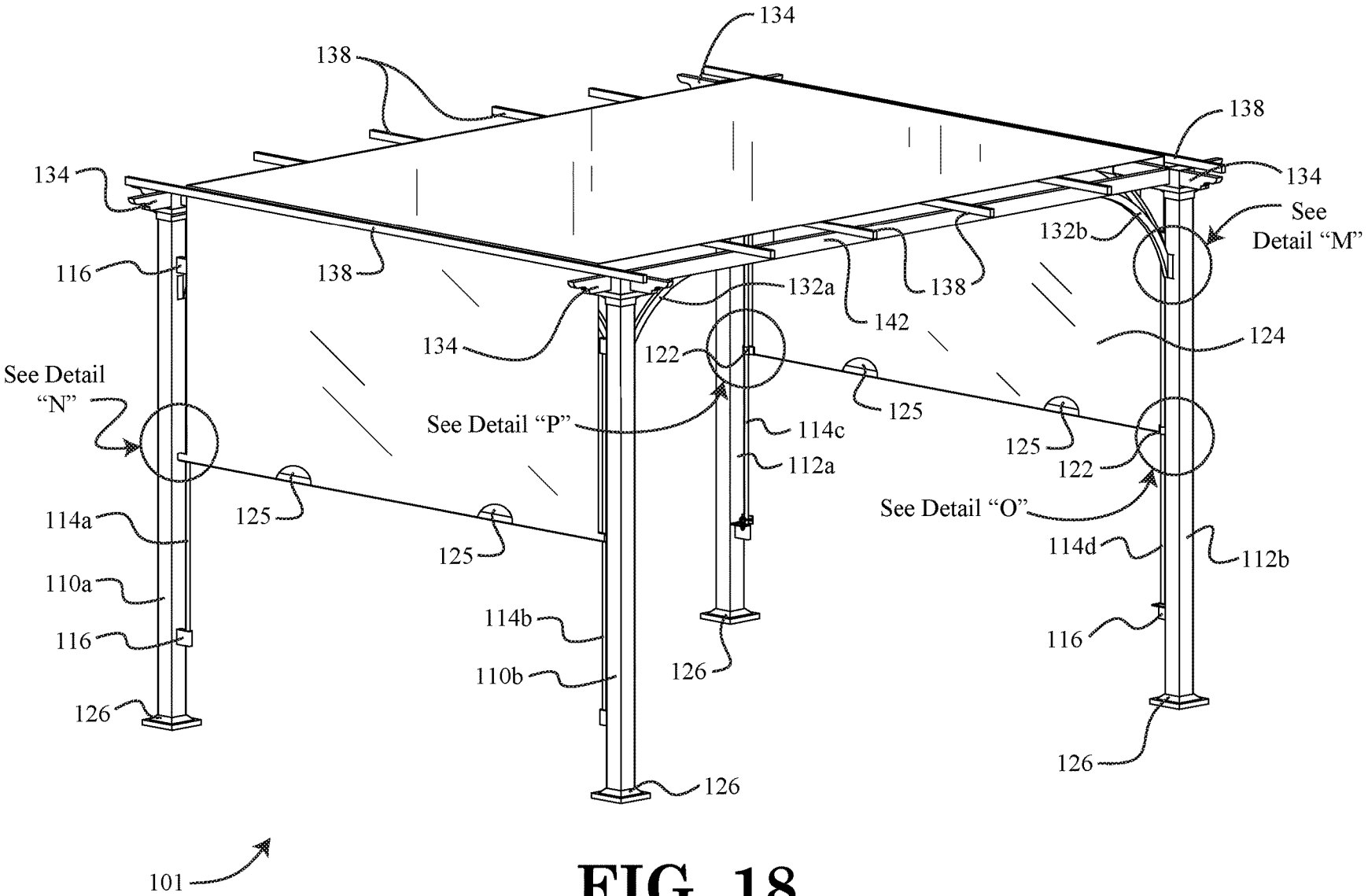
FIG. 18 is an assembled perspective view of an outdoor shelter having a rail system, according to a second embodiment of the invention.
Figure 19:
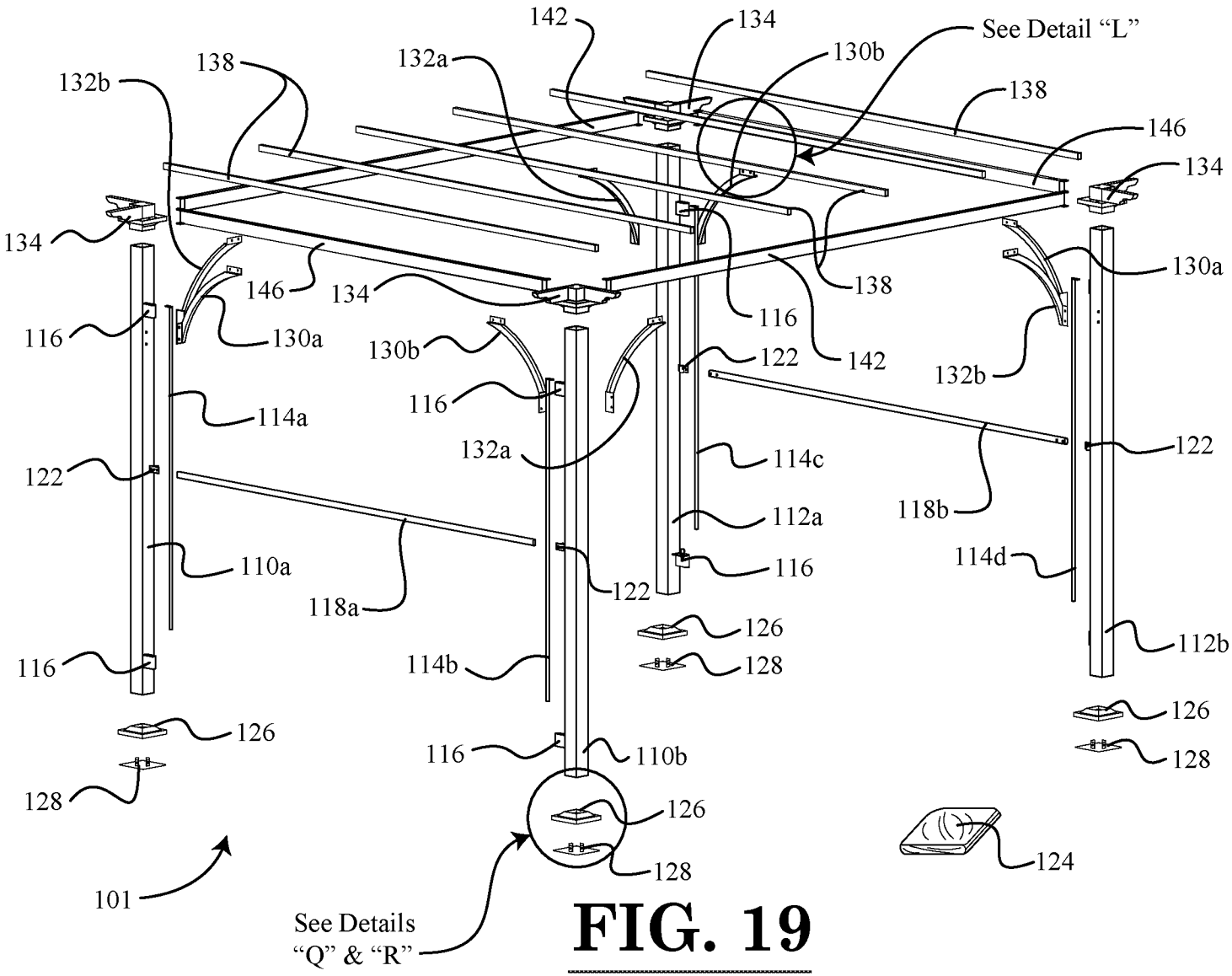
FIG. 19 is an exploded perspective view of the outdoor shelter of FIG. 18.

A second exemplary embodiment of an outdoor shelter in the form of a pergola is seen generally at 101 in FIGS. 18 and 19. Referring to these figures, it can be seen that, in most respects, the second illustrative embodiment is similar to that of the first illustrative embodiment. As such, many elements are common to both such embodiments.

The second illustrative embodiment of the outdoor shelter 101 is generally the same as the outdoor shelter 100 described above, except that the roof frame members 138, 142, 146 are single piece members that span the entire width or length of the outdoor shelter 101, rather than being formed from two sections as described above for the first embodiment. There are also other minor differences between the embodiments that will be made apparent from the description provided hereinafter.

Initially, referring to the exploded perspective view of FIG. 19, it can be seen that the frame system of the outdoor shelter 101 generally comprises a plurality of vertical support members (e.g., corner support post members 110*a*, 110*b*, 112*a*, 112*b*); a plurality of transverse roof beam members 138, a plurality of longitudinal roof beam members 142, and a plurality of end roof beam members 146. As will be described hereinafter, an adjustable shade member 124 is supported on the frame system of the outdoor shelter 101 so as to partially enclose the outdoor shelter 101.

Figure 32:
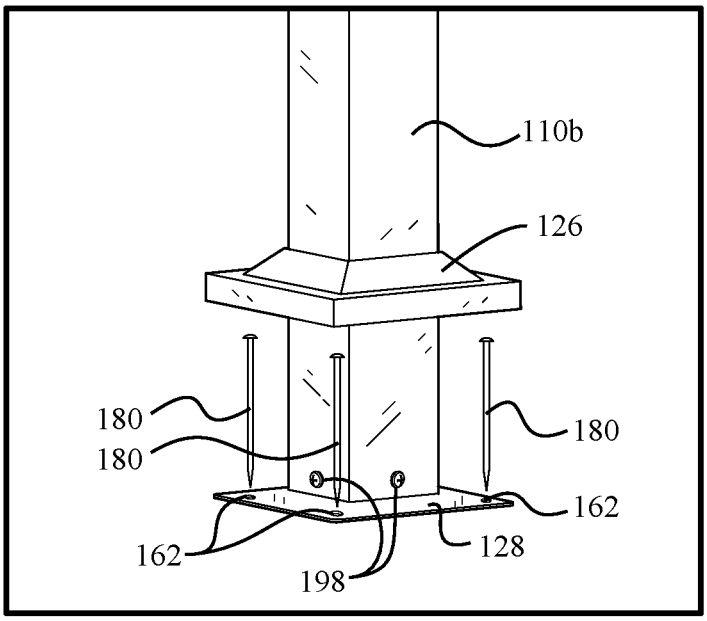
FIG. 32 is an enlarged, partial perspective view illustrating the manner in which one of the ground stake plates in FIG. 19 is secured using stakes (Detail "R")

As shown in FIGS. 18 and 19, the vertical support members of the portable shelter framing system of the illustrated embodiment are in the form of corner support post members 110*a*, 110*b*, 112*a*, 112*b*. First and second ones of the plurality of corner support post members 110*a*, 110*b* are disposed at a first longitudinal end of the outdoor shelter 101, while third and fourth ones of the plurality of corner support post members 112*a*, 112*b* are disposed at a second longitudinal end of the outdoor shelter 101. That is, a first pair of the corner support post members 110*a*, 110*b* is disposed at a first longitudinal end of the outdoor shelter 101, while a second pair of the corner support post members 112*a*, 112*b* is disposed at a second longitudinal end of the outdoor shelter 101. As shown in FIG. 18, each of the two pairs of support post members comprises spaced-apart corner support post members 110*a*, 110*b*, 112*a*, 112*b* disposed at opposite longitudinal ends of the outdoor shelter 101. With reference again to the exploded perspective view of FIG. 19, it can be seen that each corner post support member 110*a*, 110*b*, 112*a*, 112*b* has a respective corner bracket member 134 mounted thereto. As will be explained in more detail hereinafter, the corner bracket members 134 connect the peripheral roof frame members 142, 146 to the corner support post members 110*a*, 110*b*, 112*a*, 112*b*. In addition, as shown in FIG. 19, each of the corner support post members 110*a*, 110*b*, 112*a*, 112*b* is provided with a ground stake plate 128 for securely attaching the outdoor shelter 101 to the ground or a floor slab. With combined reference to detail views in FIGS. 32 and 34, it can be seen that the ground stake plate 128 is provided with a plurality of outer apertures 162 for receiving stakes 180 for anchoring the outdoor shelter 101 to the ground (e.g., to the lawn of a user). Alternatively, the outer apertures 162 may be used for receiving fasteners, such as screws or bolts, for anchoring the outdoor shelter 101 to a floor slab (e.g., to a concrete patio slab of the user). For example, as shown in FIG. 32, when the outdoor shelter 101 is anchored to the ground (e.g., to a lawn), a plurality of ground stakes 180 are used to anchor each plate 128 to the ground. Alternatively, when the outdoor shelter 101 is anchored to a floor (e.g., to a concrete slab or wood floor), a plurality of threaded fasteners (e.g., expansion bolts) may be used to anchor each plate 128 to the floor.

Figure 31:
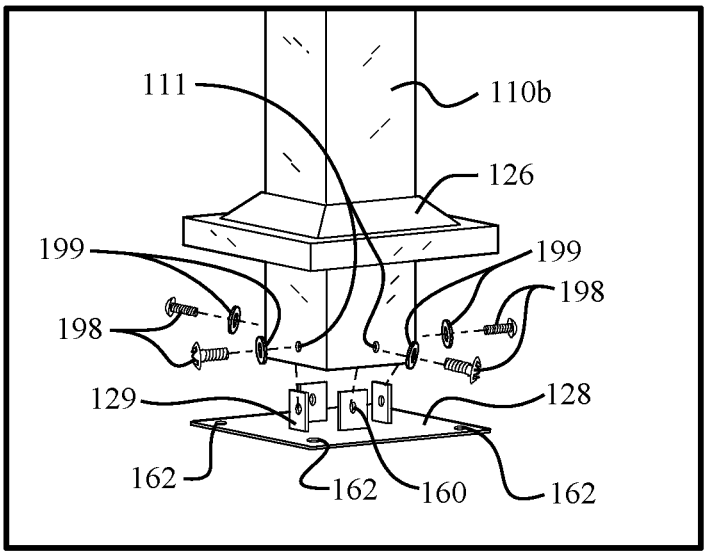
FIG. 31 is an enlarged, partial perspective view illustrating the connection between one of the corner post members and its respective ground stake plate in FIG. 19 (Detail "Q")
Figure 34:
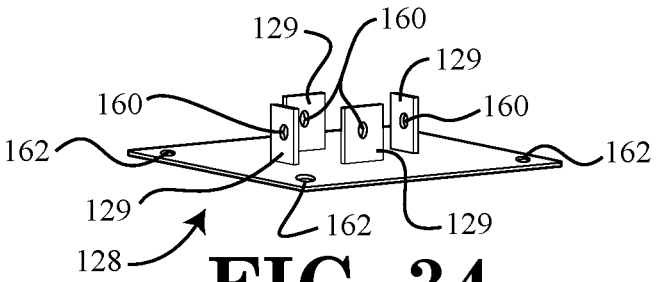
FIG. 34 is a perspective view of one of the ground stake plates of the outdoor shelter of FIG. 18.

Next, with combined reference to FIGS. 31 and 34, the manner in which each of the ground stake plates 128 are attached to their respective corner support post members 110*a*, 110*b*, 112*a*, 112*b* will be described. As shown in the illustrated embodiment of FIG. 31, the ground stake plate 128 comprises a plurality of raised portions 129 that are received within the bottom end of the corner support post member 110*b*. In the illustrative embodiment, each raised portions 129 is in the form of an upstanding attachment tab that is configured to be disposed adjacent to a respective inner side surface of the corner support post member 110*b*. Each upstanding attachment tab 129 of the ground stake plate 128 comprises a fastener aperture 160 disposed therethrough that receives a fastener (e.g., a screw 198) for securing the ground stake plate 128 to a sidewall of the bottom end portion of the corner post support member 110*b*. As shown in FIG. 31, the sidewalls of the corner post support member 110*b* are provided with fastener apertures 111 formed therein for receiving respective fasteners 198. Also, as shown in FIG. 31, in the illustrative embodiment, each fastener 198 is provided with a respective washer 199 that is configured to be disposed between the head of the fastener 198 and an outer side surface of the corner support post member 110*b*. In FIGS. 31 and 34, it can be seen that the fastener apertures 160 are disposed inwardly from the stake apertures 162 relative to a center of the ground stake plate 128. In other words, the stake apertures 162 are disposed closer to a periphery of the ground stake plate 128 than the fastener apertures 160.

Figure 33:
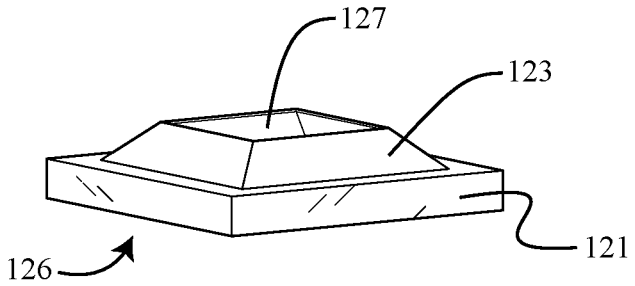
FIG. 33 is a perspective view of one of the ground plate cover members of the outdoor shelter of FIG. 18.

Also, as illustrated in FIGS. 18 and 19, each of the corner support post members 110*a*, 110*b*, 112*a*, 112*b* is provided with a respective ground plate cover member 126 to conceal each ground stake plate 128 and the stakes 180 or fasteners used to secure outdoor shelter 101 to the ground or floor. As shown in FIG. 33, the illustrated ground plate cover member 126 comprises a bottom base portion 121 that is generally in the shape of a square prism, and a top portion 123 that is generally in the shape of a truncated pyramid. The ground plate cover member 126 further comprises a central aperture 127 formed therethrough for accommodating a passage of the corner support post member 110*a*, 110*b*, 112*a*, or 112*b* through the ground plate cover member 126.

Next, with again reference to FIGS. 18 and 19, the rail system of the exemplary outdoor shelter 101 will be explained in detail. As best shown in the exploded view of FIG. 19, in the illustrative embodiment, the rail system of the exemplary outdoor shelter 101 generally includes the plurality of support post members 110*a*, 110*b*, 112*a*, 112*b* disposed at the respective corners of the outdoor shelter 101, a first guide rail member 114*a* coupled to the first one of the plurality of support post members 110*a*, a second guide rail member 114*b* coupled to the second one of the plurality of support post members 110*b*, a third guide rail member 114*c* coupled to the third one of the plurality of support post members 112*a*, a fourth guide rail member 114*d* coupled to the fourth one of the plurality of support post members 112*b*, a first shade support pole member 118*a* slidably coupled to the first and second guide rail members 114*a*, 114*b*, and a second shade support pole member 118*b* slidably coupled to the third and fourth guide rail members 114*c*, 114*d*. The first shade support pole member 118*a* is attached to a first end portion of a shade member 124 of the outdoor shelter (see FIGS. 18 and 19), while the second shade support pole member 118*b* is attached to a second end portion of the shade member 124 of the outdoor shelter 101. The first shade support pole member 118*a* is configured to be slidably displaced along the lengths of the first and second guide rail members 114*a*, 114*b* so as to allow an amount by which the shade member 124 overhangs a first side of the outdoor shelter 101 to be adjusted by a user. Similarly, the second shade support pole member 118*b* is configured to be slidably displaced along the lengths of the third and fourth guide rail members 114*c*, 114*d* so as to allow an amount by which the shade member 124 overhangs a second side of the outdoor shelter 101 to be adjusted by the user. In the illustrated embodiment, when the amount by which the shade member 124 overhangs the first side of the outdoor shelter 101 is increased by the user (e.g., by pulling on the lower end of the shade member 124 with shade support pole member 118*a*), the amount by which the shade member 124 overhangs the second side of the outdoor shelter 101 is decreased. In other words, pulling down on one end of the shade member 124 will raise the shade member 124 on the opposite longitudinal end of the outdoor shelter 101 because the shade member 124 has a constant overall length.

With continued reference to FIGS. 18 and 19, it can be seen that the first, second, third, and fourth guide rail members 114*a*, 114*b*, 114*c*, 114*d* are each coupled to respective first, second, third, and fourth ones of the corner support post members 110*a*, 110*b*, 112*a*, 112*b* by means of a pair of spaced-apart guide rail connector members 116. That is, as shown in these figures, each guide rail member 114*a*, 114*b*, 114*c*, 114*d* is supported at its longitudinal ends by oppositely disposed guide rail connector members 116. In the illustrated embodiment, each guide rail connector member 116 is in the form of a generally rectangular block with one semi-circular side (see FIG. 18). As described above for the first embodiment, each guide rail connector member 116 has a circular aperture disposed longitudinally therethrough for receiving the cylindrical longitudinal end portion of the guide rail member 114*a*, 114*b*, 114*c*, 114*d*, which is in the form of a cylindrical rod in the illustrative embodiment. Each guide rail connector member 116 attaches a respective one of the guide rail members 114*a*, 114*b*, 114*c*, or 114*d* to the side of one of the corner support post members 110*a*, 110*b*, 112*a*, or 112*b*.

Figure 28:
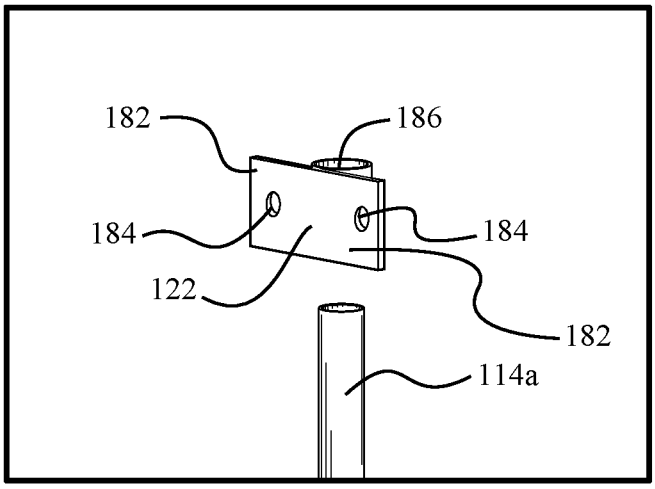
FIG. 28 is an enlarged, partial perspective view illustrating the engagement between one of the shade support pole connector members and one of the guide rail members in FIG. 18 (Detail "N")
Figure 30:
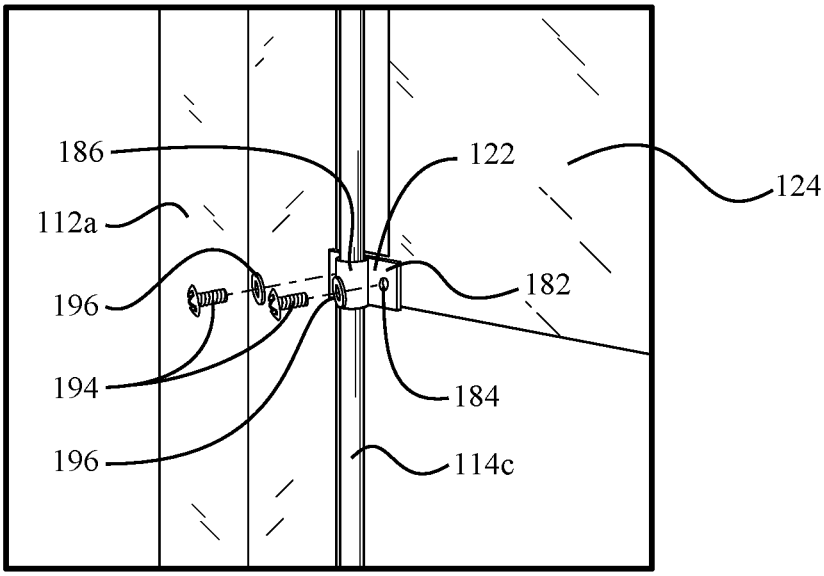
FIG. 30 is an enlarged, partial perspective view illustrating the connection between one of the shade support pole connector members and one of the shade support pole members in FIG. 18 (Detail "P")
Figure 35:
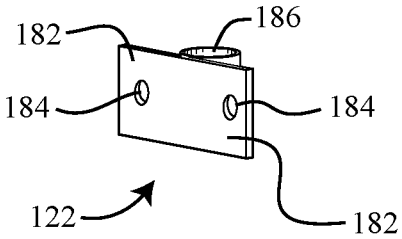
FIG. 35 is a perspective view of one of the shade support pole connector members of the outdoor shelter of FIG. 18.

Turning again to the illustrative embodiment of FIG. 19, the first shade support pole member 118*a* is slidably coupled to the first and second guide rail members 114*a*, 114*b* by means of a first pair of spaced-apart shade support pole connector members 122. Similarly, the second shade support pole member 118*b* is slidably coupled to the third and fourth guide rail members 114*c*, 114*d* by means of a second pair of spaced-apart shade support pole connector members 122. In the illustrative embodiment, each of the spaced-apart shade support pole connector members 122 is disposed proximate to a respective longitudinal end of the first and second shade support pole members 118*a*, 118*b*. That is, the first and second shade support pole members 118*a*, 118*b* are supported at their longitudinal ends by shade support pole connector members 122. In the illustrated embodiment, with reference to FIGS. 28 and 35, each shade support pole connector member 122 is in the form of a side mount bracket with opposed flanges 182 disposed on opposite sides of a cylindrical body portion 186. The cylindrical body portion 186 of each shade support pole connector member 122 has a circular pole receiving cavity disposed longitudinally therethrough for receiving the cylindrical cross-section of a respective guide rail member 114*a*, 114*b*, 114*c*, 114*d*. In addition, each of the pair of opposed flanges 182 of each shade support pole connector member 122 may be provided with a fastener aperture 184 disposed therein for receiving a fastener (e.g., a screw or bolt) for securing the shade support pole connector member 122 to the back side of one of the shade support pole members 118*a*, 118*b* (see FIG. 30). For example, as shown in FIG. 30, each fastener member (e.g., screw 194) is configured to pass through the flange 182 of the shade support pole connector member 122, through the back side of the shade member 124, and into a back side of one of the shade support pole members 118*a*, 118*b*. Also, as shown in FIG. 30, in the illustrative embodiment, each fastener 194 is provided with a respective washer 196 that is configured to be disposed between the head of the fastener 194 and the back side of the shade member 124. By means of the shade support pole members 118*a*, 118*b*, the shade support pole connector members 122 slidably couple the opposed longitudinal ends of the shade member 124 to the guide rail members 114*a*, 114*b*, 114*c*, 114*d*. As depicted in the illustrative detail view of FIG. 28, during the assembly of the outdoor shelter 101, the shade support pole connector member 122 is slipped over the end of its respective guide rail member 114*a* prior to being attached to the shade support pole member 118*a*.

Figure 23:
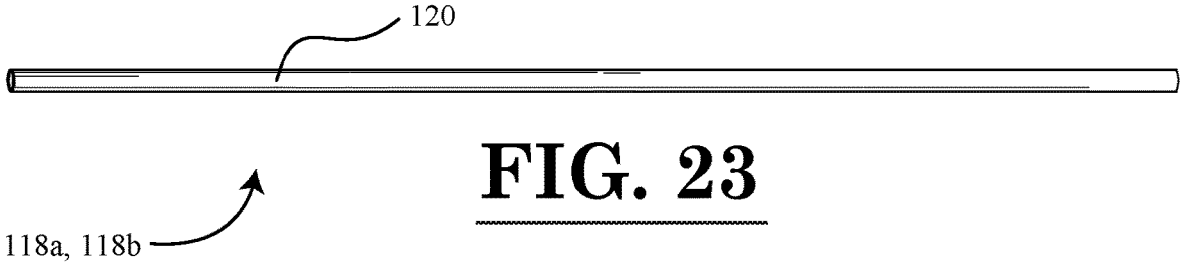
FIG. 23 is a side perspective view of one of the shade support pole members of the outdoor shelter of FIG. 18.
Figure 29:
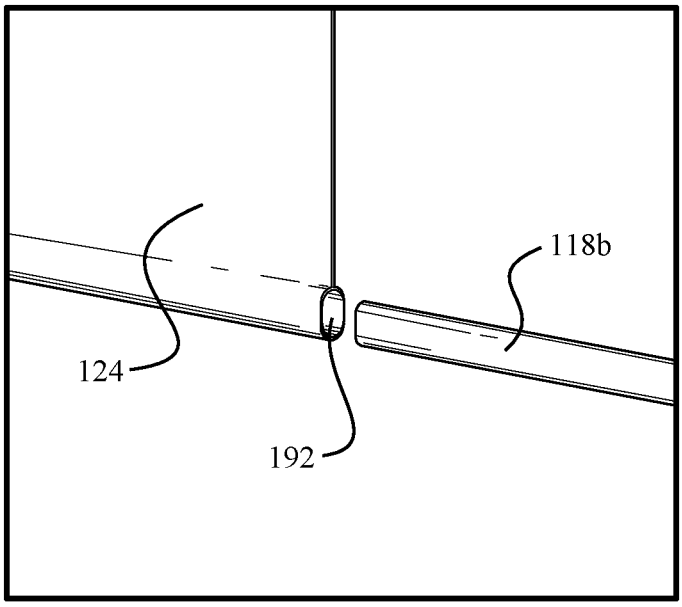
FIG. 29 is an enlarged, partial perspective view illustrating the engagement between one of the shade support pole members and the longitudinal cavity at one of the ends of the shade member in FIG. 18 (Detail "O")

Referring now to FIG. 23, it can be seen that, in the second illustrative embodiment, each of the first and second shade support pole members 118*a*, 118*b* comprises a one-piece elongate oval-shaped body portion 120, rather than the two-piece pole construction described above with respect to the first embodiment. In the second illustrative embodiment, referring to FIG. 29, the first and second longitudinal end portions of the shade member 124 are looped so as to form cavities 192 (or pockets) for receiving respective first and second shade support pole members 118*a* and 118*b*. That is, the first shade support pole member 118*a* is inserted into the first looped longitudinal end portion of the shade member 124, and the second shade support pole member 118*b* is inserted into the second looped longitudinal end portion of the shade member 124 before the shade support pole members 118*a*, 118*b* are secured to the guide rail members 114*a*, 114*b*, 114*c*, 114*d* by means of the shade support pole connector members 122.

In the illustrative embodiment, the shade member 124 of the outdoor shelter 101 may be formed from a fabric material. For example, in one or more exemplary embodiments, the shade member 124 may be formed from a waterproof fabric material so that the area underneath the shade member 124 of the outdoor shelter 101 remains dry during a rain storm. In addition, as shown in the overall perspective view of FIG. 18, in the illustrative embodiment, each longitudinal end portion of the shade member 124 may comprise a pair of spaced-apart, semi-circular handle cutout portions formed in the edges of the shade member 124. The handle cutout portion of the shade member 124 and a longitudinal section of the shade support pole member 118*a*, 118*b* together define a semi-circular handle aperture 125 that is configured to receive a portion of a hand of the user so as to facilitate the grasping of the shade member 124 and the shade support pole member 118*a*, 118*b* by the user during the adjustment of the shade member 124 (refer to FIG. 18).

Figure 22:
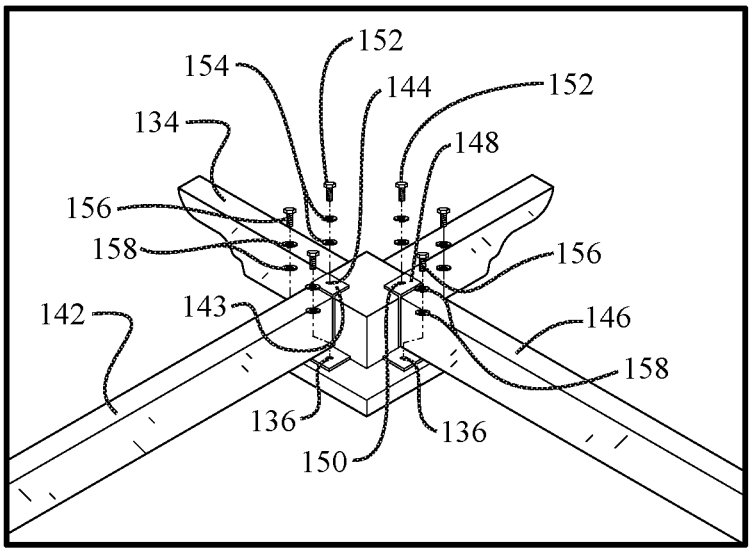
FIG. 22 is an enlarged, partial perspective view illustrating the connection between two of the peripheral roof beam members and one of the corner bracket members in FIG. 20 (Detail "K")

Next, as best shown in the perspective view of FIG. 20, the roof frame assembly 170 of the outdoor shelter 101 of the illustrative embodiment will be explained. In the illustrative embodiment, the peripheral frame structure of the outdoor shelter 101 is formed by the longitudinal roof beam members 142 and the end roof beam members 146. The longitudinal roof beam members 142 are connected to the end roof beam members 146 by means of the corner bracket members 134 so as to form a rectangular peripheral frame structure for the roof of the outdoor shelter 101. For example, in an exemplary embodiment, the end portions of the longitudinal roof beam members 142 and the end roof beam members 146 may be secured to a respective one of the corner bracket members 134 by means of a plurality of fasteners (e.g., screws or bolts—see FIG. 22). As shown in the detail view of FIG. 22, the longitudinal roof beam member 142 comprises a mounting flange 143 with a fastener aperture 144 disposed therethrough for receiving a fastener (e.g., screw 152) for securing the end of the longitudinal roof beam member 142 to the top of the corner bracket member 134. Similarly, the end roof beam member 146 comprises a mounting flange 148 with a fastener aperture 150 disposed therethrough for receiving a fastener (e.g., screw 152) for securing the end of the end roof beam member 146 to the top of the corner bracket member 134. Also, as shown in FIG. 22, in the illustrative embodiment, each fastener 152 is provided with a respective washer 154 that is configured to be disposed between the head of the fastener 152 and the top surface of the mounting flange 143 or 148. In addition, as shown in FIG. 22, the longitudinal roof beam member 142 and the end roof beam member 146 are further secured to the corner bracket member 134 by means of fasteners (e.g., screws 156) with washers 158 passing through fastener apertures 136 in lower mounting flanges of the roof beam members 142, 146, and thereby also attaching respective lower mounting flanges of the roof beam members 142, 146 to the corner bracket member 134.

Figure 20:
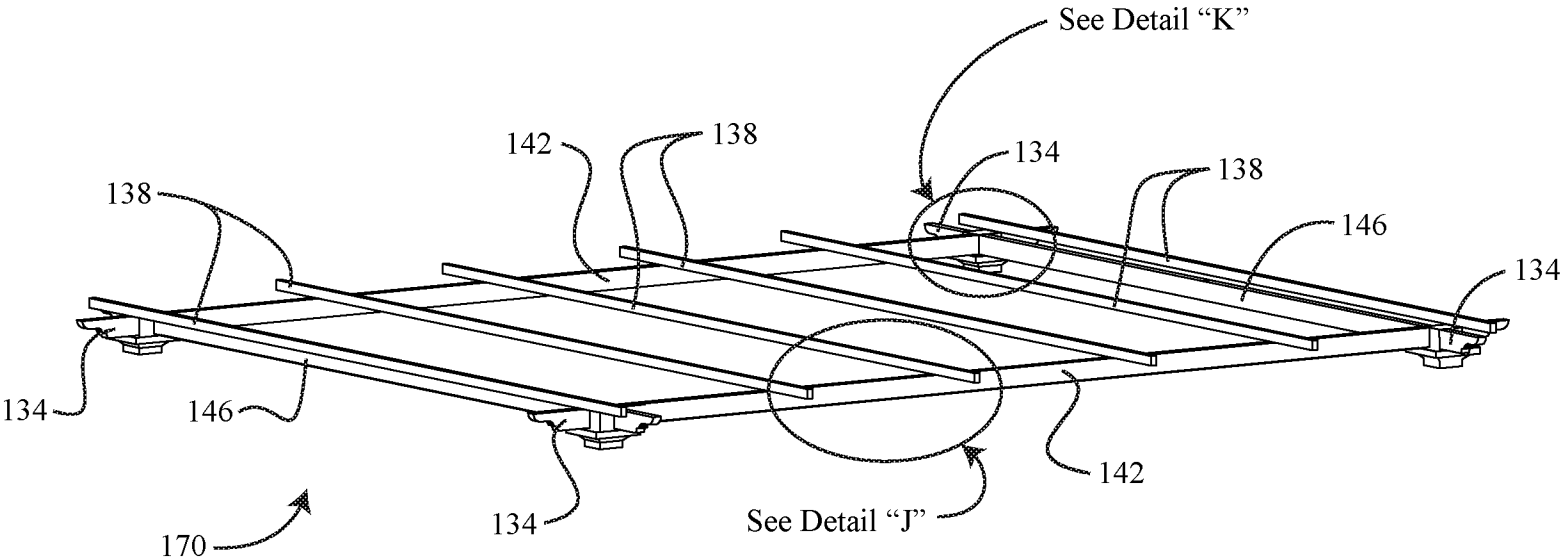
FIG. 20 is a perspective view of the roof structure of the outdoor shelter of FIG. 18.

As best shown in FIGS. 19 and 20, the longitudinal roof beam members 142 extend in a longitudinal direction between one spaced-apart pair of the plurality of corner bracket members 134, while the end roof beam members 146 extend in a transverse direction between another spaced-apart pair of the plurality of corner bracket members 134. In addition, as shown in FIGS. 18-20, in the illustrative embodiment, each of the corner bracket members 134 includes a corner cover member disposed at the base thereof. The corner cover member is configured to be disposed over a top end of one of the corner support post members 110*a*, 110*b*, 112*a*, 112*b* so as to at least partially conceal the top end of the corner support post member 110*a*, 110*b*, 112*a*, 112*b* from view. The corner cover member has a central aperture or recess formed therein for receiving the top end of the corner support post member 110*a*, 110*b*, 112*a*, or 112*b*.

Figure 24:
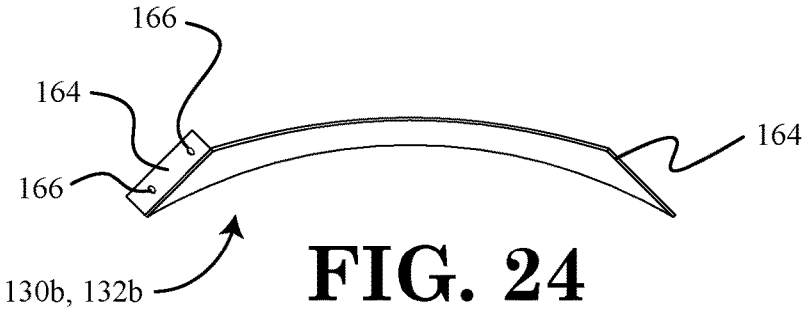
FIG. 24 is a side perspective view of a first one of the arc support members of the outdoor shelter of FIG. 18.
Figure 25:
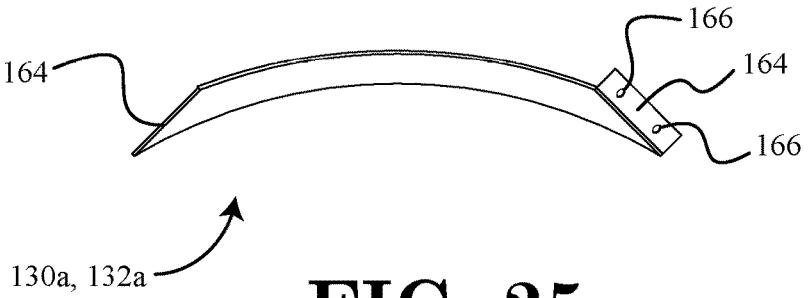
FIG. 25 is a side perspective view of a second one of the arc support members of the outdoor shelter of FIG. 18.
Figure 26:
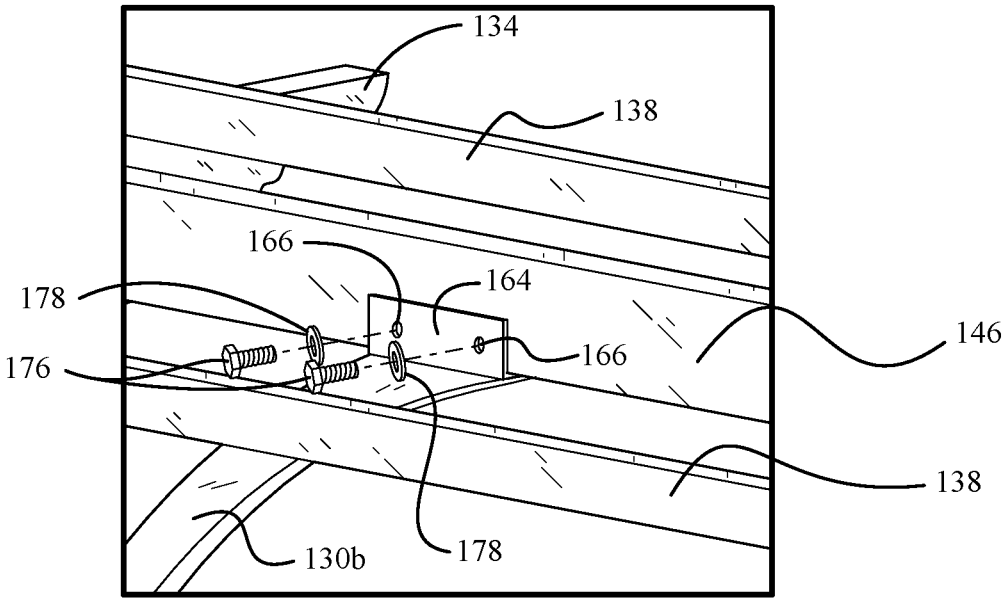
FIG. 26 is an enlarged, partial perspective view illustrating the connection between an upper end of one of the arc support members and one of the transverse roof beam members in FIG. 19 (Detail "L")
Figure 27:
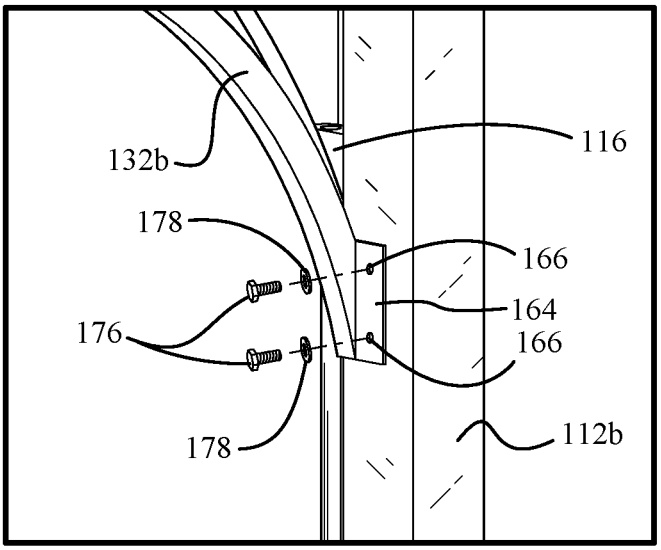
FIG. 27 is an enlarged, partial perspective view illustrating the connection between a lower end of one of the arc support members and one of the corner post members in FIG. 18 (Detail "M")

Each of the corners of the outdoor shelter 101 is reinforced by means of a pair of arc support members 130*a*, 130*b*, 132*a*, 132*b*. That is, as shown in FIG. 18, the arc support members 130*a*, 130*b*, 132*a*, 132*b* attach the roof beam members 142, 146 to sides of the corner support post members 110*a*, 110*b*, 112*a*, 112*b*. That is, each arc support member 130*a*, 130*b*, 132*a*, 132*b* is configured to be attached between a respective one of the corner support post members 110*a*, 110*b*, 112*a*, 112*b* and a respective one of the plurality of peripheral beam members 142, 146. A detail view of a first configuration of the arc support members 130*b*, 132*b* is depicted in FIG. 24, while a second configuration of the arc support members 130*a*, 132*a* is depicted in FIG. 25. The two configurations of the arc support members 130*a*, 130*b*, 132*a*, 132*b* are mounted on opposite sides of the outdoor shelter 101. As shown in FIGS. 24 and 25, each of the arc support members 130*a*, 130*b*, 132*a*, 132*b* comprises a semi-circular body portion with flange portions 164 disposed at each of the oppositely disposed ends of the semi-circular body portion. Also, as shown in FIGS. 24 and 25, each of the flange portions 164 comprises a pair of spaced-apart fastener apertures 166 for receiving fasteners (e.g., screws or bolts) for securing the arc support members 130*a*, 130*b*, 132*a*, 132*b* to either one of the roof beam members 142, 146 or to a side of one of the corner support post members 110*a*, 110*b*, 112*a*, 112*b*. For example, as shown in FIG. 26, each fastener member (e.g., bolt 176) is configured to pass through a respective fastener aperture 166 in the top flange portion 164 of the arc support member 130*b*, and into a side of the end roof beam member 146. Also, as shown in FIG. 26, in the illustrative embodiment, each fastener 176 is provided with a respective washer 178 that is configured to be disposed between the head of the fastener 176 and the side surface of the top flange portion 164 of the arc support member 130*b*. Similarly, turning to FIG. 27, which depicts the illustrative bottom securement of the arc support members 130*a*, 130*b*, 132*a*, 132*b*, each fastener member (e.g., bolt 176) is configured to pass through a respective fastener aperture 166 in the bottom flange portion 164 of the arc support member 132*b*, and into a side of the corner support post member 112*b*. Also, as shown in FIG. 27, and similar to that described above with regard to FIG. 26, each fastener 176 is provided with a respective washer 178 that is configured to be disposed between the head of the fastener 176 and the side surface of the bottom flange portion 164 of the arc support member 132*b*.

Also, as shown in FIGS. 18, 19, and 20, the roof frame structure 170 of the outdoor shelter 101 further comprises a plurality of transverse roof beam members 138 that are mounted to the top surfaces of the longitudinal roof beam members 142 or the top surfaces of the corner bracket members 134 (e.g., by using fasteners, such as screws or bolts). That is, the transverse roof beam members 138 located between the corner support post members 110*a*, 110*b*, 112*a*, 112*b* are supported on the top surfaces of the spaced-apart longitudinal roof beam members 142 (refer to FIG. 20), while the two transverse roof beam members 138 disposed outwardly from the corner support post members 110*a*, 110*b*, 112*a*, 112*b* on the longitudinal ends of the outdoor shelter 101 are supported on the top surfaces of the corner bracket members 134 such that these two transverse roof beam members 138 are supported in a cantilevered manner outwardly from the respective pairs of the plurality of corner support members 110*a*, 110*b* and 112*a*, 112*b* (see FIG. 20).

In the second illustrative embodiment, with reference to FIG. 20, it can be seen that the transverse roof beam members 138 are generally equally spaced apart across the top of the longitudinal roof beam members 142 so as to form a supporting structure for the shade member 124. As best shown in FIG. 18, the shade member 124 is draped over the top of the middle transverse roof beam members 138. That is, in the illustrative embodiment, the shade member 124 passes over the top of the middle transverse roof beam members 138 when the outdoor shelter 101 is in an assembled state, but not over the two transverse roof beam members 138 at the ends of the outdoor shelter 101.

Figure 21:
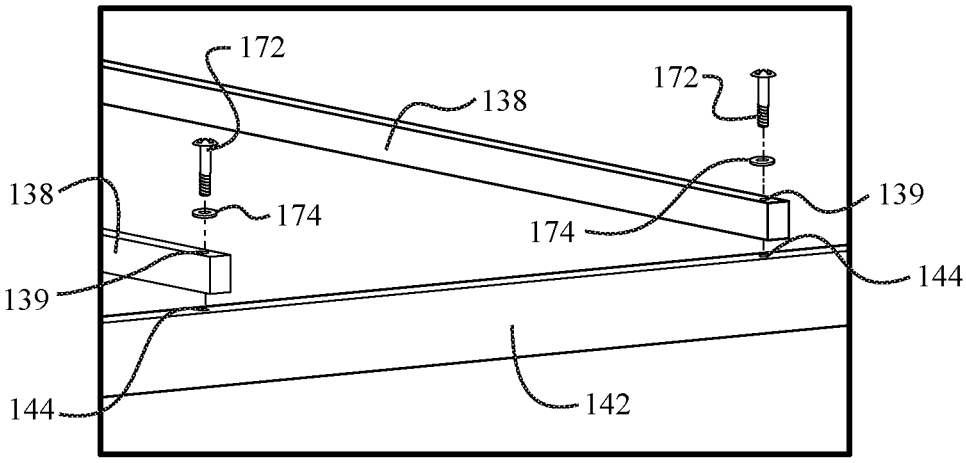
FIG. 21 is an enlarged, partial perspective view illustrating the connection between several of the transverse roof beam members and one of the longitudinal roof beam members in FIG. 20 (Detail "J")

Next, turning to the detail view of FIG. 21, an exemplary manner in which transverse roof beam members 138 may be secured to the longitudinal roof beam members 142 in the illustrative embodiment will be described. As shown in FIG. 21, the ends of the transverse roof beam members 138 are provided with respective fastener apertures 139 for receiving fasteners (e.g., screws or bolts) for securing the transverse roof beam members 138 to the top surface of the longitudinal roof beam member 142. For example, as shown in FIG. 21, each fastener member (e.g., screw 172) is configured to pass through a respective fastener aperture 139 in the transverse roof beam member 138, and into a respective fastener aperture 144 in the top surface of the longitudinal roof beam member 142. Also, as shown in FIG. 21, in the illustrative embodiment, each fastener 172 is provided with a respective washer 174 that is configured to be disposed between the head of the fastener 172 and the top surface of the transverse roof beam member 138. The opposite ends of the transverse roof beam members 138 are secured to the other longitudinal roof beam member 142 in a similar manner to that illustrated in FIG. 21.

As described above for the first embodiment, in one or more embodiments, the framing components of the outdoor shelter 101 (e.g., as illustrated in FIGS. 18 and 19) are formed from a suitable metallic material, such as steel. However, those of ordinary skill in the art will appreciate that other suitable materials can be used for the various components of the outdoor shelter 101 as well. Also, each of the fastener members described in conjunction with the second embodiment may comprise a plurality of external threads disposed on the outer periphery thereof, and one or more of the fastener apertures with which the threaded fastener members are threadingly engaged may be provided with corresponding internal threads around the circumference thereof so as to obviate the need for the use of nuts (e.g., the fastener aperture that is the furthest in the axial direction from the head of the fastener member may be internally threaded).

A third exemplary embodiment of an outdoor shelter in the form of a pergola is seen generally at 200 in FIGS. 36-44. Referring to these figures, it can be seen that, in many respects, the third illustrative embodiment is similar to that of the first and second illustrative embodiments described above. As such, many elements are common to all of these embodiments.

The third illustrative embodiment of the outdoor shelter 200 is similar to the outdoor shelters 100, 101 described above, except that the roof structure of the outdoor shelter 200 is curved, rather than generally flat as in the first two embodiments described above. There are also other minor differences between the embodiments that will be made apparent from the drawings and the description provided hereinafter.

Figure 38:
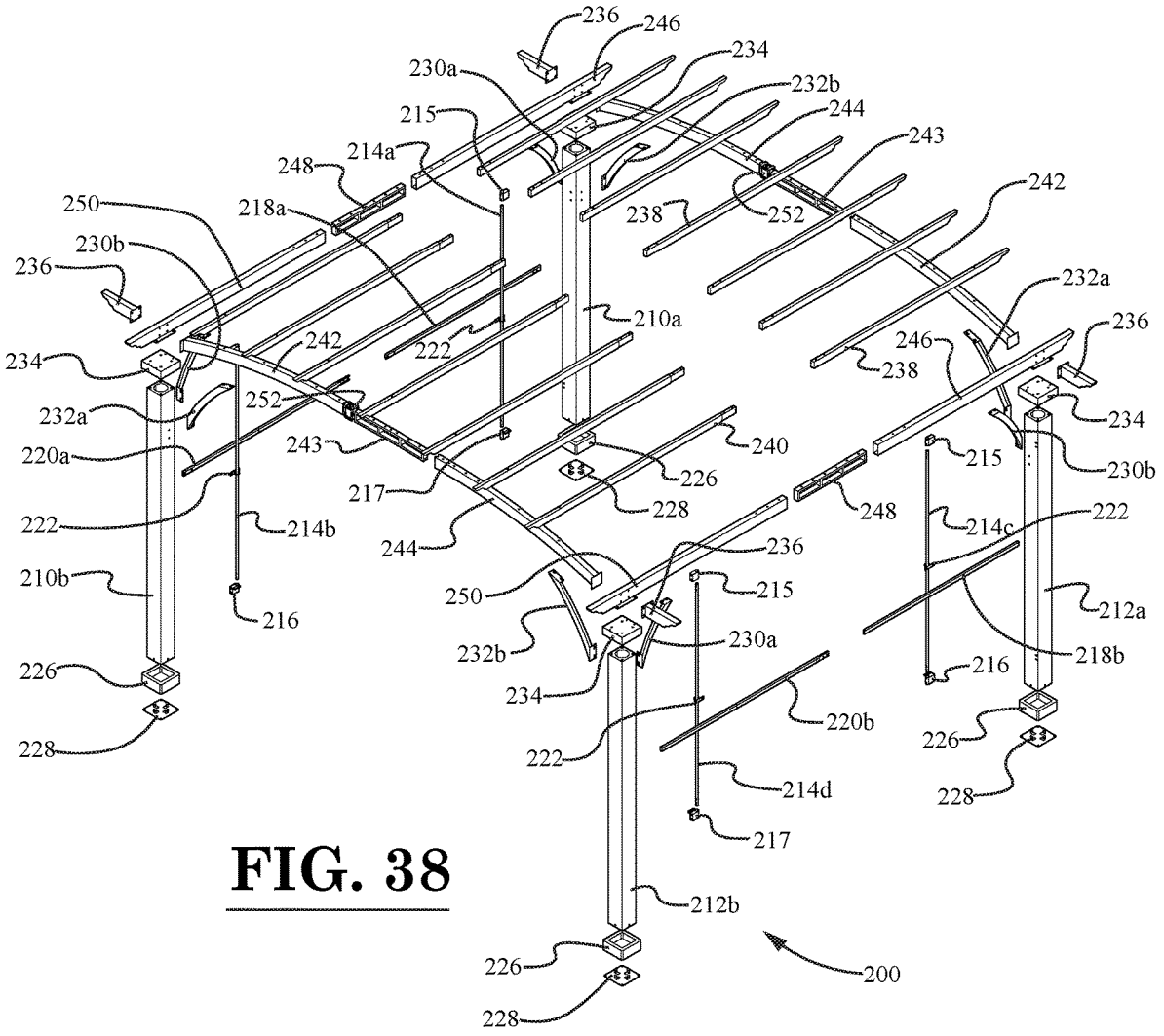
FIG. 38 is an exploded perspective view of the outdoor shelter of FIG. 36.
Figure 39:
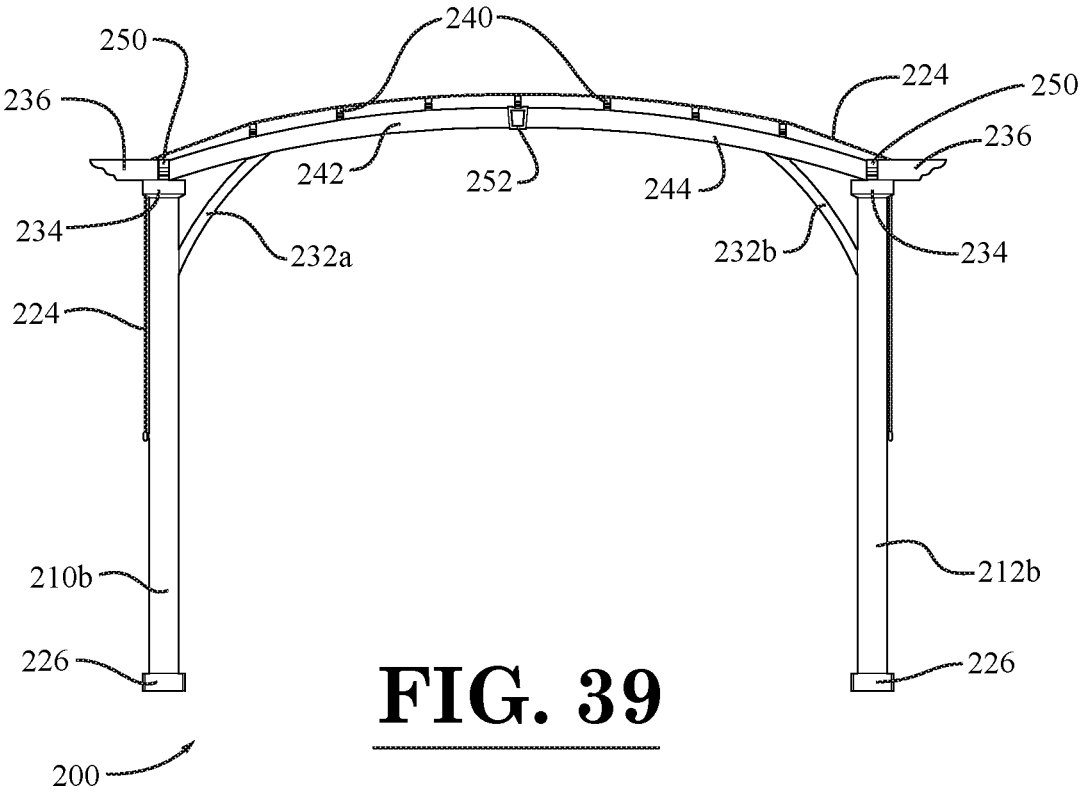
FIG. 39 is a first side elevational view of the outdoor shelter of FIG. 36.
Figure 40:
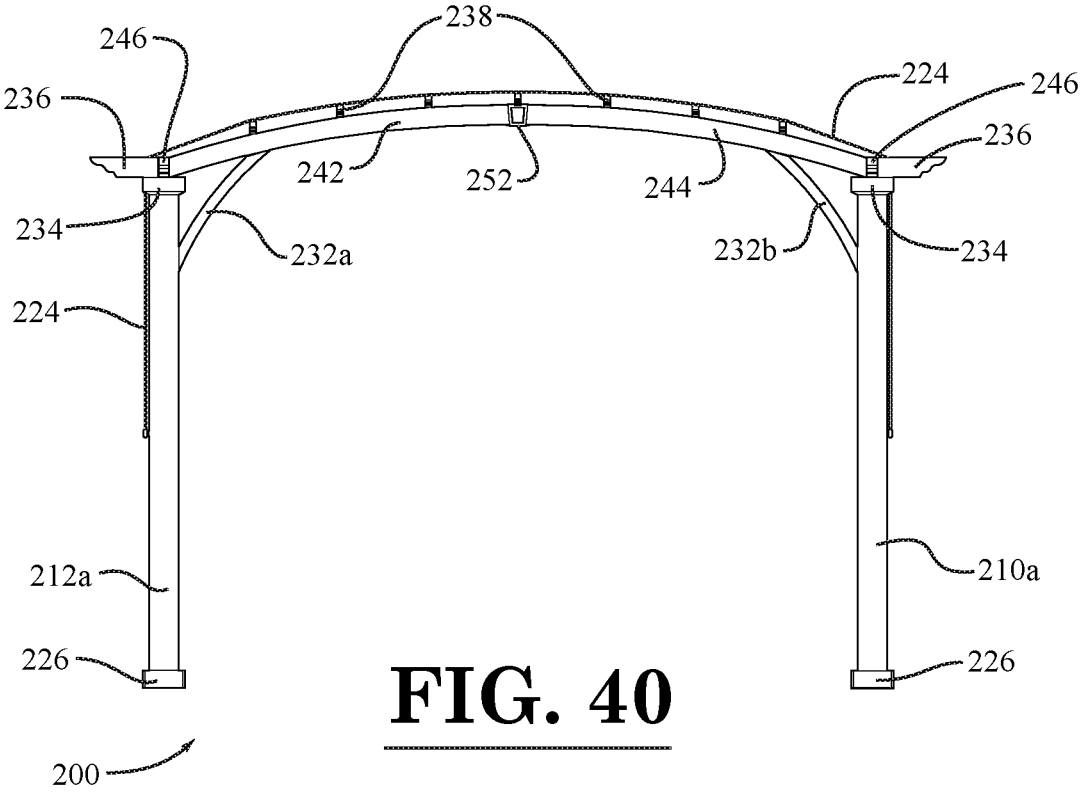
FIG. 40 is a second side elevational view of the outdoor shelter of FIG. 36.
Figure 41:
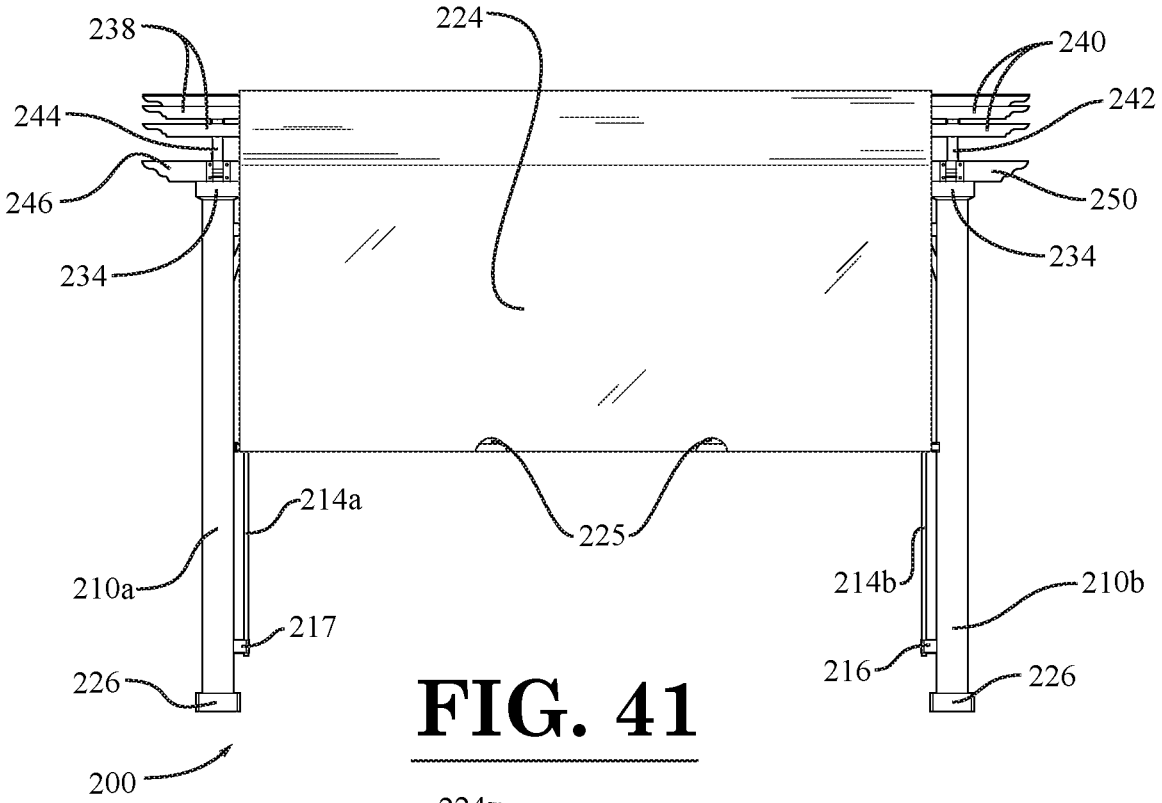
FIG. 41 is a front elevational view of the outdoor shelter of FIG. 36.
Figure 42:
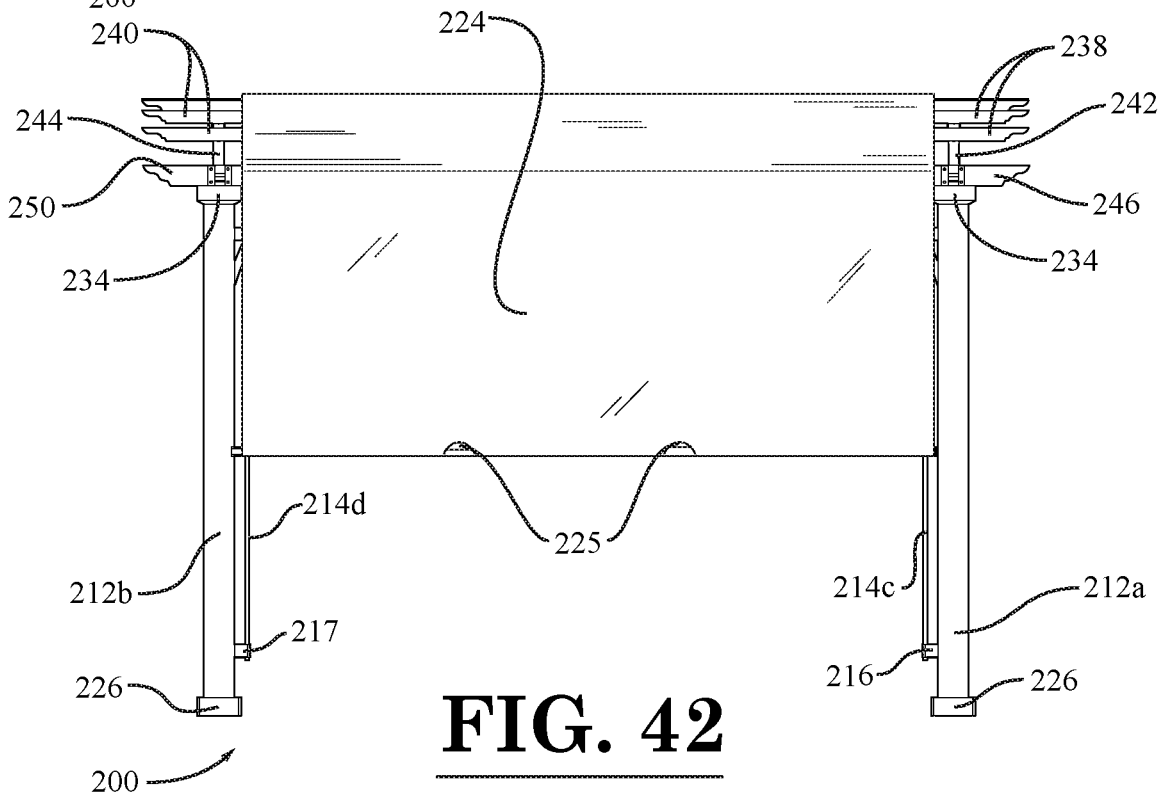
FIG. 42 is a rear elevational view of the outdoor shelter of FIG. 36.
Figure 43:
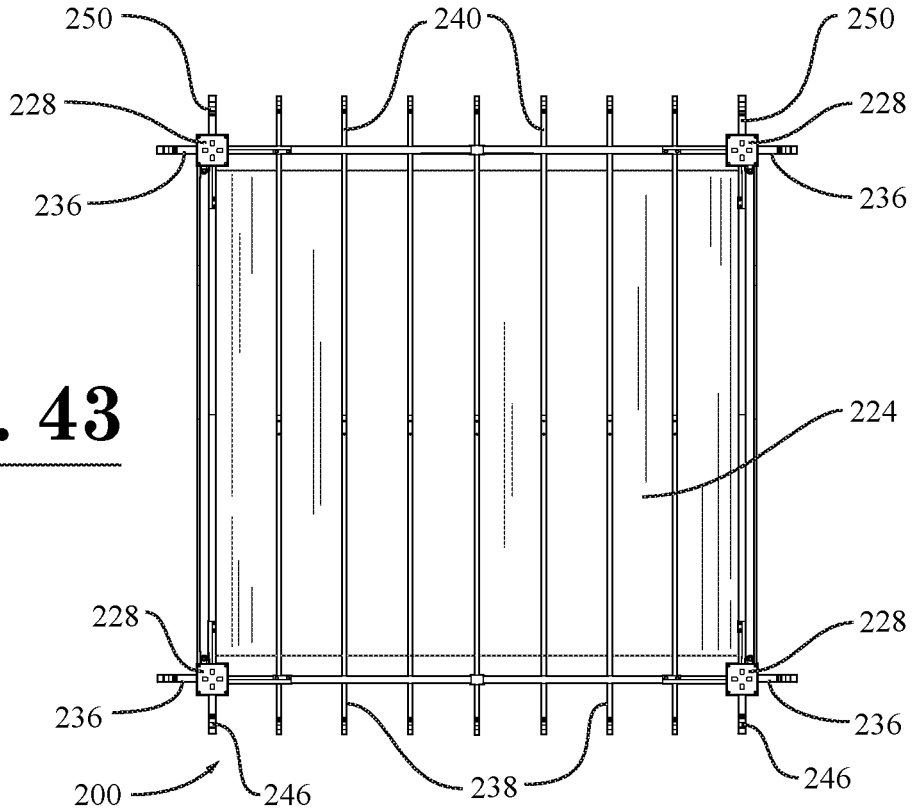
FIG. 43 is a bottom plan view of the outdoor shelter of FIG. 36.
Figure 44:
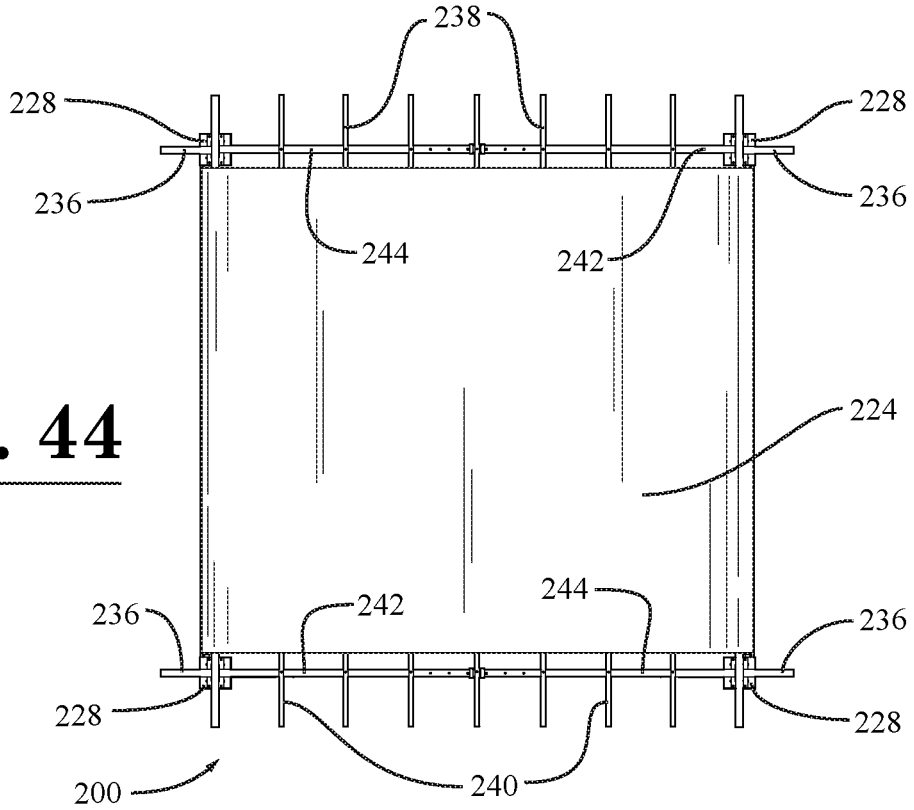
FIG. 44 is a top plan view of the outdoor shelter of FIG. 36.

Initially, referring to the exploded perspective view of FIG. 38, it can be seen that the frame system of the outdoor shelter 200 generally comprises a plurality of vertical support members (e.g., corner support post members 210*a*, 210*b*, 212*a*, 212*b*); a plurality of transverse roof beam members 238, 240, a plurality of longitudinal roof beam members 242, 244, and a plurality of end roof beam members 246, 250. As will be described hereinafter, an adjustable shade member 224 is supported on the frame system of the outdoor shelter 200 so as to partially enclose the outdoor shelter 200.

Figure 36:
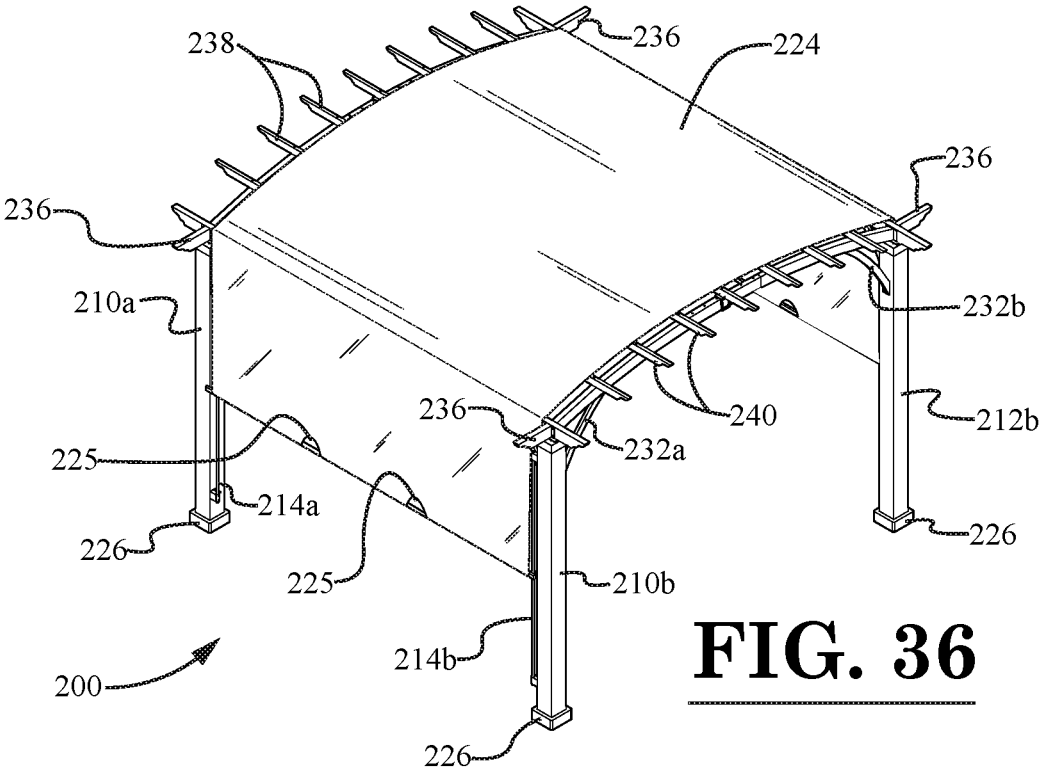
FIG. 36 is a side-top assembled perspective view of an outdoor shelter having a rail system, according to a third embodiment of the invention.
Figure 37:
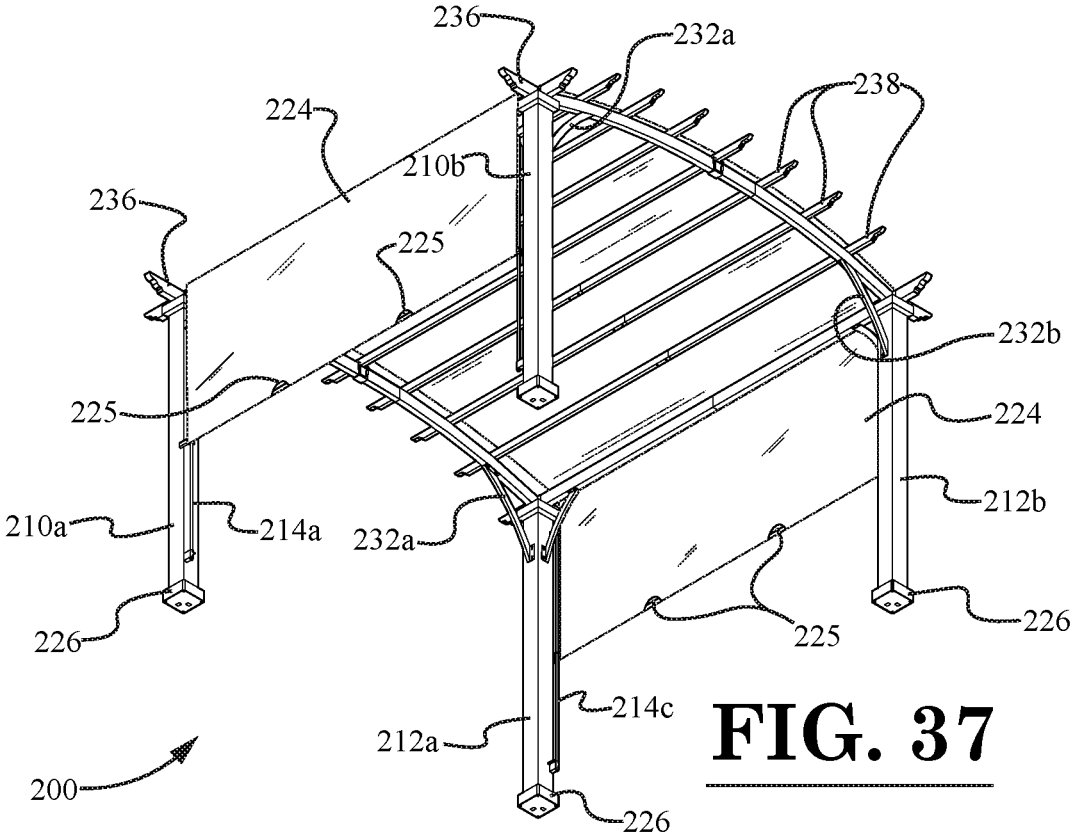
FIG. 37 is a bottom-side assembled perspective view of the outdoor shelter of FIG. 36.

As shown in FIGS. 36-38, the vertical support members of the portable shelter framing system of the illustrated embodiment are in the form of corner support post members 210*a*, 210*b*, 212*a*, 212*b*. First and second ones of the plurality of corner support post members 210*a*, 210*b* are disposed at a first longitudinal end of the outdoor shelter 200, while third and fourth ones of the plurality of corner support post members 212*a*, 212*b* are disposed at a second longitudinal end of the outdoor shelter 200. That is, a first pair of the corner support post members 210*a*, 210*b* is disposed at a first longitudinal end of the outdoor shelter 200, while a second pair of the corner support post members 212*a*, 212*b* is disposed at a second longitudinal end of the outdoor shelter 200. As shown in FIGS. 36 and 37, each of the two pairs of support post members comprises spaced-apart corner support post members 210*a*, 210*b*, 212*a*, 212*b* disposed at opposite longitudinal ends of the outdoor shelter 200. With reference again to the exploded perspective view of FIG. 38, it can be seen that each corner post support member 210*a*, 210*b*, 212*a*, 212*b* has a respective post cap member 234 mounted thereto. As will be explained in more detail hereinafter, the post cap members 234 connect the end roof beam members 246, 250 to the corner support post members 210*a*, 210*b*, 212*a*, 212*b*. In addition, as shown in FIG. 38, each of the corner support post members 210*a*, 210*b*, 212*a*, 212*b* is provided with a ground stake plate 228 for securely attaching the outdoor shelter 200 to the ground or a floor slab, as explained above in detail with regard to the first two embodiments.

Also, as illustrated in FIGS. 36-38, each of the corner support post members 210*a*, 210*b*, 212*a*, 212*b* is provided with a respective ground plate cover member 226 to conceal each ground stake plate 228 and the stakes or fasteners used to secure outdoor shelter 200 to the ground or floor. As shown in FIG. 38, the illustrated ground plate cover member 226 comprises a central aperture formed therethrough for accommodating a passage of the corner support post member 210*a*, 210*b*, 212*a*, or 212*b* through the ground plate cover member 226.

Next, with again reference to FIGS. 36-38, the rail system of the exemplary outdoor shelter 200 will be explained in detail. As best shown in the exploded view of FIG. 38, in the illustrative embodiment, the rail system of the exemplary outdoor shelter 200 generally includes the plurality of support post members 210*a*, 210*b*, 212*a*, 212*b* disposed at the respective corners of the outdoor shelter 200, a first guide rail member 214*a* coupled to the first one of the plurality of support post members 210*a*, a second guide rail member 214*b* coupled to the second one of the plurality of support post members 210*b*, a third guide rail member 214*c* coupled to the third one of the plurality of support post members 212*a*, a fourth guide rail member 214*d* coupled to the fourth one of the plurality of support post members 212*b*, a first shade support pole member 218*a*, 220*a* slidably coupled to the first and second guide rail members 214*a*, 214*b*, and a second shade support pole member 218*b*, 220*b* slidably coupled to the third and fourth guide rail members 214*c*, 214*d*. The first shade support pole member 218*a*, 220*a* is attached to a first end portion of a shade member 224 of the outdoor shelter (see FIGS. 36-38), while the second shade support pole member 218*b*, 220*b* is attached to a second end portion of the shade member 224 of the outdoor shelter 200. The first shade support pole member 218*a*, 220*a* is configured to be slidably displaced along the lengths of the first and second guide rail members 214*a*, 214*b* so as to allow an amount by which the shade member 224 overhangs a first side of the outdoor shelter 200 to be adjusted by a user. Similarly, the second shade support pole member 218*b*, 220*b* is configured to be slidably displaced along the lengths of the third and fourth guide rail members 214*c*, 214*d* so as to allow an amount by which the shade member 224 overhangs a second side of the outdoor shelter 200 to be adjusted by the user. In the illustrated embodiment, when the amount by which the shade member 224 overhangs the first side of the outdoor shelter 200 is increased by the user (e.g., by pulling on the lower end of the shade member 224 with shade support pole member 218*a*, 220*a*), the amount by which the shade member 224 overhangs the second side of the outdoor shelter 200 is decreased. In other words, pulling down on one end of the shade member 224 will raise the shade member 224 on the opposite longitudinal end of the outdoor shelter 200 because the shade member 224 has a constant overall length.

With continued reference to FIGS. 36-38, it can be seen that the first, second, third, and fourth guide rail members 214*a*, 214*b*, 214*c*, 214*d* are each coupled to respective first, second, third, and fourth ones of the corner support post members 210*a*, 210*b*, 212*a*, 212*b* by means of a pair of spaced-apart guide rail connector members 215, 216 or 215, 217. That is, as shown in these figures, each guide rail member 214*a*, 214*d* is supported at its longitudinal ends by oppositely disposed guide rail connector members 215, 217 (i.e., guide rail connector member 215 is provided at the top longitudinal end and guide rail connector member 217 is provided at the bottom longitudinal end). Each guide rail member 214*b*, 214*c* is supported at its longitudinal ends by oppositely disposed guide rail connector members 215, 216 (i.e., guide rail connector member 215 is provided at the top longitudinal end and guide rail connector member 216 is provided at the bottom longitudinal end). In the illustrated embodiment, each guide rail connector member 215, 216, 217 is in the form of a generally rectangular block with one semi-circular side (see FIG. 38). As described above for the first two embodiments, each guide rail connector member 215, 216, 217 has a circular aperture disposed longitudinally therethrough for receiving the cylindrical longitudinal end portion of the guide rail member 214*a*, 214*b*, 214*c*, 214*d*, which is in the form of a cylindrical rod in the illustrative embodiment. Each guide rail connector member 215, 216, 217 attaches a respective one of the guide rail members 214*a*, 214*b*, 214*c*, or 214*d* to the side of one of the corner support post members 210*a*, 210*b*, 212*a*, or 212*b*.

Turning again to the illustrative embodiment of FIGS. 36-38, the first shade support pole member 218*a*, 220*a* is slidably coupled to the first and second guide rail members 214*a*, 214*b* by means of a first pair of spaced-apart shade support pole connector members 222. Similarly, the second shade support pole member 218*b*, 220*b* is slidably coupled to the third and fourth guide rail members 214*c*, 214*d* by means of a second pair of spaced-apart shade support pole connector members 222. In the illustrative embodiment, each of the spaced-apart shade support pole connector members 222 is disposed proximate to a respective longitudinal end of the first and second shade support pole members 218*a*, 220*a* and 218*b*, 220*b*. That is, the first and second shade support pole members 218*a*, 220*a* and 218*b*, 220*b* are supported at their longitudinal ends by shade support pole connector members 222. In the illustrated embodiment, with reference to FIG. 38, each shade support pole connector member 222 is in the form of a side mount bracket with opposed flanges disposed on opposite sides of a cylindrical body portion. The cylindrical body portion of each shade support pole connector member 222 has a circular pole receiving cavity disposed longitudinally therethrough for receiving the cylindrical cross-section of a respective guide rail member 214*a*, 214*b*, 214*c*, 214*d*. In addition, each of the pair of opposed flanges of each shade support pole connector member 222 may be provided with a fastener aperture disposed therein for receiving a fastener (e.g., a screw or bolt) for securing the shade support pole connector member 222 to the back side of one of the shade support pole members 218*a*, 220*a* and 218*b*, 220*b* (e.g., as shown in FIG. 30). By means of the shade support pole members 218*a*, 220*a* and 218*b*, 220*b*, the shade support pole connector members 222 slidably couple the opposed longitudinal ends of the shade member 224 to the guide rail members 214*a*, 214*b*, 214*c*, 214*d*.

Referring again to the exploded view of FIG. 38, it can be seen that, in the third illustrative embodiment, the first and second shade support pole members 218*a*, 218*b*, 220*a*, 220*b* each comprise a pair of shade support pole sections 218*a*, 220*a* and 218*b*, 220*b*. A first one 220*a*, 220*b* of each pair of shade support pole sections has an end portion of reduced cross-sectional area that is receivable within a recess of an end portion of a second one 218*a*, 218*b* of the pair of shade support pole sections. That is, the end portion of each shade support pole section 220*a*, 220*b* is received within the central recess of a respective shade support pole section 218*a*, 218*b*. Also, in the illustrated embodiment, the end portion of each shade support pole section 220*a*, 220*b* may be secured within the recess of its respective shade support pole section 218*a*, 218*b* by means of a plurality of fasteners (e.g., screws or bolts) passing through the paired shade support pole sections 218*a*, 220*a* and 218*b*, 220*b*. In the illustrative embodiment, the first and second longitudinal end portions of the shade member 224 are looped so as to form cavities (or pockets) for receiving respective first and second shade support pole members 218*a*, 220*a* and 218*b*, 220*b* (see e.g., refer to FIG. 11). That is, the first paired shade support pole sections 218*a*, 220*a* are inserted into the first looped longitudinal end portion of the shade member 224, and the second paired shade support pole sections 218*b*, 220*b* are inserted into the second looped longitudinal end portion of the shade member 224 before the shade support pole members 218*a*, 218*b*, 220*a*, 220*b* are secured to the guide rail members 214*a*, 214*b*, 214*c*, 214*d* by means of the shade support pole connector members 222.

In the illustrative embodiment, the shade member 224 of the outdoor shelter 200 may be formed from a fabric material. For example, in one or more exemplary embodiments, the shade member 224 may be formed from a waterproof fabric material so that the area underneath the shade member 224 of the outdoor shelter 200 remains dry during a rain storm. In addition, as shown in the overall perspective view of FIG. 36, in the illustrative embodiment, each longitudinal end portion of the shade member 224 may comprise a pair of spaced-apart, semi-circular handle cutout portions formed in the edges of the shade member 224. The handle cutout portion of the shade member 224 and a longitudinal section of the shade support pole member 218*a*, 220*a* and 218*b*, 220*b* together define a semi-circular handle aperture 225 that is configured to receive a portion of a hand of the user so as to facilitate the grasping of the shade member 224 and the shade support pole member 218*a*, 220*a* and 218*b*, 220*b* by the user during the adjustment of the shade member 224 (refer to FIG. 36).

Next, as best shown in the perspective views of FIGS. 37 and 38, the roof frame assembly of the outdoor shelter 200 of the illustrative embodiment will be explained. In the illustrative embodiment, the peripheral frame structure of the outdoor shelter 200 is formed by the longitudinal roof beam members 242, 244 and the end roof beam members 246, 250. The longitudinal roof beam members 242, 244 are connected to the sides of the end roof beam members 246, 250 (see FIG. 38) so as to form a rectangular peripheral frame structure for the roof of the outdoor shelter 200. For example, in an exemplary embodiment, the end roof beam members 246, 250 may be provided with bottom plate members that are secured to a respective one of the post cap members 234 by means of a plurality of fasteners (e.g., screws or bolts). As best shown in FIGS. 37 and 38, the longitudinal roof beam members 242, 244 extend in a longitudinal direction between spaced-apart end roof beam members 246, 250. In the third illustrative embodiment, each one of the longitudinal roof beam members 242 is attached to a respective one of the longitudinal roof beam members 244 by a longitudinal roof beam connector 243 (see FIG. 38) that slides into the inner ends of the longitudinal roof beam members 242, 244. In the illustrative embodiment, the longitudinal roof beam connector 243 has a curvature that corresponds to the curvature of the longitudinal roof beam members 242, 244. Similarly, each one of the end roof beam members 246 is attached to a respective one of the end roof beam members 250 by an end roof beam connector 248 (see FIG. 38) that slides into the inner ends of the end roof beam members 246, 250. In addition, as best shown in the exploded view of FIG. 38, a beam trim member 236 is mounted on a side of each end roof beam member 246, 250, which is opposite to the side on which the longitudinal roof beam member 242, 244 is mounted. Also, as shown in FIG. 38, a decorative ferrule 252 is provided at the location where the inner end of each longitudinal roof beam member 242 is joined to the inner end of each longitudinal roof beam member 244.

Each of the corners of the outdoor shelter 200 is reinforced by means of a pair of arc support members 230*a*, 230*b*, 232*a*, 232*b*. That is, as shown in FIGS. 37-40, the arc support members 230*a*, 230*b*, 232*a*, 232*b* attach the roof beam members 242, 244, 246, 250 to sides of the corner support post members 210*a*, 210*b*, 212*a*, 212*b*. That is, each arc support member 230*a*, 230*b*, 232*a*, 232*b* is configured to be attached between a respective one of the corner support post members 210*a*, 210*b*, 212*a*, 212*b* and a respective one of the plurality of peripheral beam members 242, 244, 246, 250 by means of fasteners (e.g., screws or bolts).

Also, as shown in FIGS. 37 and 38, the roof frame structure of the outdoor shelter 200 further comprises a plurality of transverse roof beam members 238, 240 that are mounted to the top surfaces of the longitudinal roof beam members 242, 244 (e.g., by using fasteners, such as screws or bolts). The transverse roof beam members 238, 240 are located between the corner support post members 210*a*, 210*b*, 212*a*, 212*b*, and are supported on the top surfaces of the spaced-apart longitudinal roof beam members 242, 244 (refer to FIGS. 37 and 38).

In the third illustrative embodiment, each one of the transverse roof beam members is formed by a first transverse roof beam section 238 that is affixed to a second transverse roof beam section 240 by a plurality of fasteners (e.g., screws or bolts). Also, in the illustrative embodiment, the transverse roof beam members 238, 240 are generally equally spaced apart across the top of the longitudinal roof beam members 242, 244 so as to form a supporting structure for the shade member 224. As best shown in FIGS. 36 and 37, the shade member 224 is draped over the top of the transverse roof beam members 238, 240. That is, in the illustrative embodiment, the shade member 224 passes over the top of the transverse roof beam members 238, 240 when the outdoor shelter 200 is in an assembled state.

In one or more embodiments, the framing components of the outdoor shelter 200 (e.g., as illustrated in FIGS. 37 and 38) are formed from a suitable metallic material, such as steel. However, those of ordinary skill in the art will appreciate that other suitable materials can be used for the various components of the outdoor shelter 200 as well. Also, each of the fastener members described in conjunction with the third embodiment may comprise a plurality of external threads disposed on the outer periphery thereof, and one or more of the fastener apertures with which the threaded fastener members are threadingly engaged may be provided with corresponding internal threads around the circumference thereof so as to obviate the need for the use of nuts (e.g., the fastener aperture that is the furthest in the axial direction from the head of the fastener member may be internally threaded).

A fourth exemplary embodiment of an outdoor shelter in the form of a pergola is seen generally at 300 in FIGS. 45-53. Referring to these figures, it can be seen that, in most respects, the fourth illustrative embodiment is similar to that of the third illustrative embodiment. As such, many elements are common to both such embodiments.

The fourth illustrative embodiment of the outdoor shelter 300 is generally the same as the outdoor shelter 200 described above, except that several of the side-specific components of the outdoor shelter 200 have a more universal configuration in the outdoor shelter 300 (e.g., components 315, 316, 317, 330*a*, 330*b*, 332*a*, 332*b*, 342, 344, 346, 350) so that they are able to be interchangeably used on multiple sides of the outdoor shelter 300, thereby advantageously reducing the number of unique parts required for the assembly of the outdoor shelter 300. For example, to form the guide rail connector members 315, 316, 317, a universal guide rail connector member may be used. There are also other minor differences between the embodiments that will be made apparent from the drawings and the description provided hereinafter.

Figure 47:
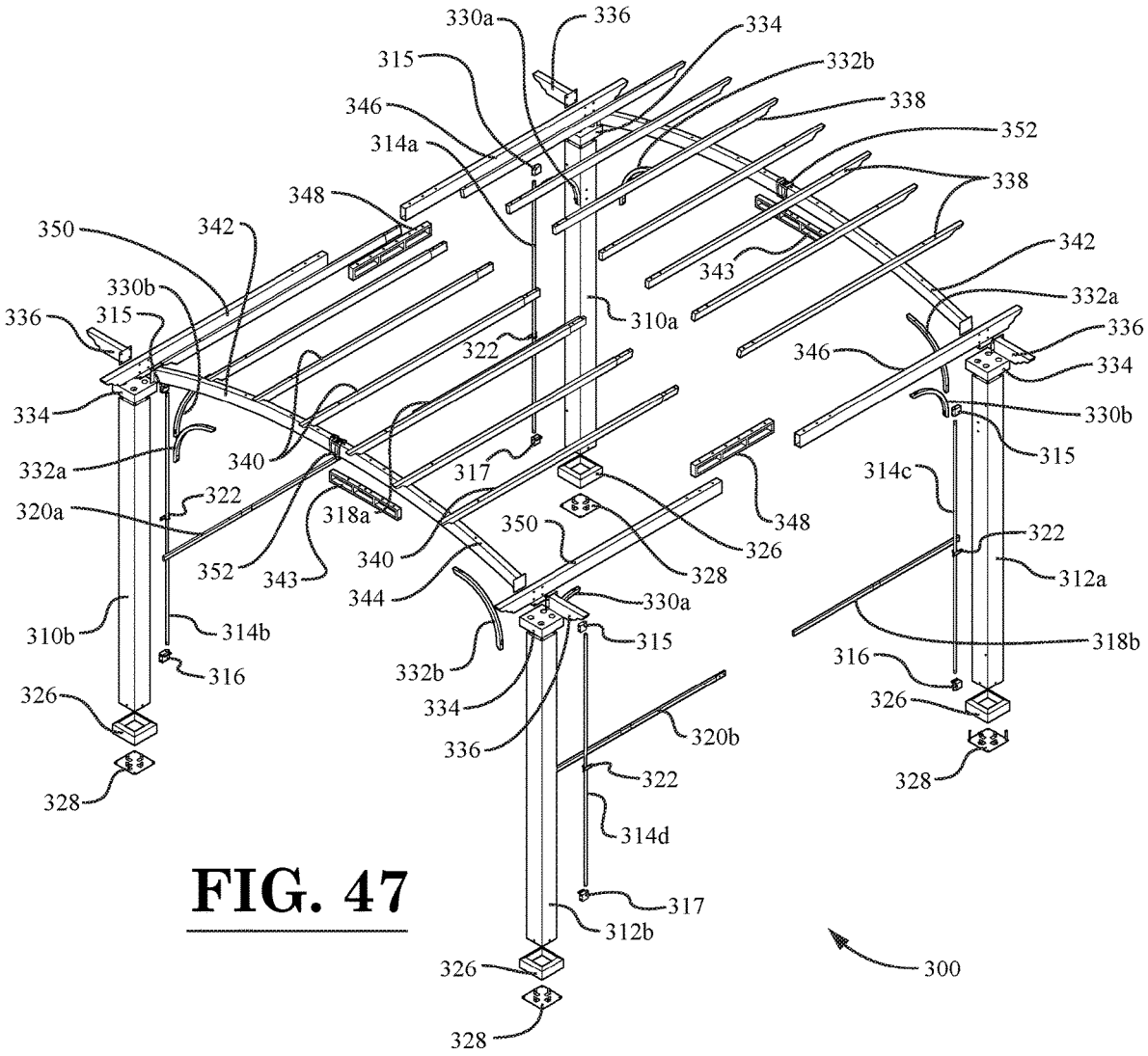
FIG. 47 is an exploded perspective view of the outdoor shelter of FIG. 45.
Figure 48:
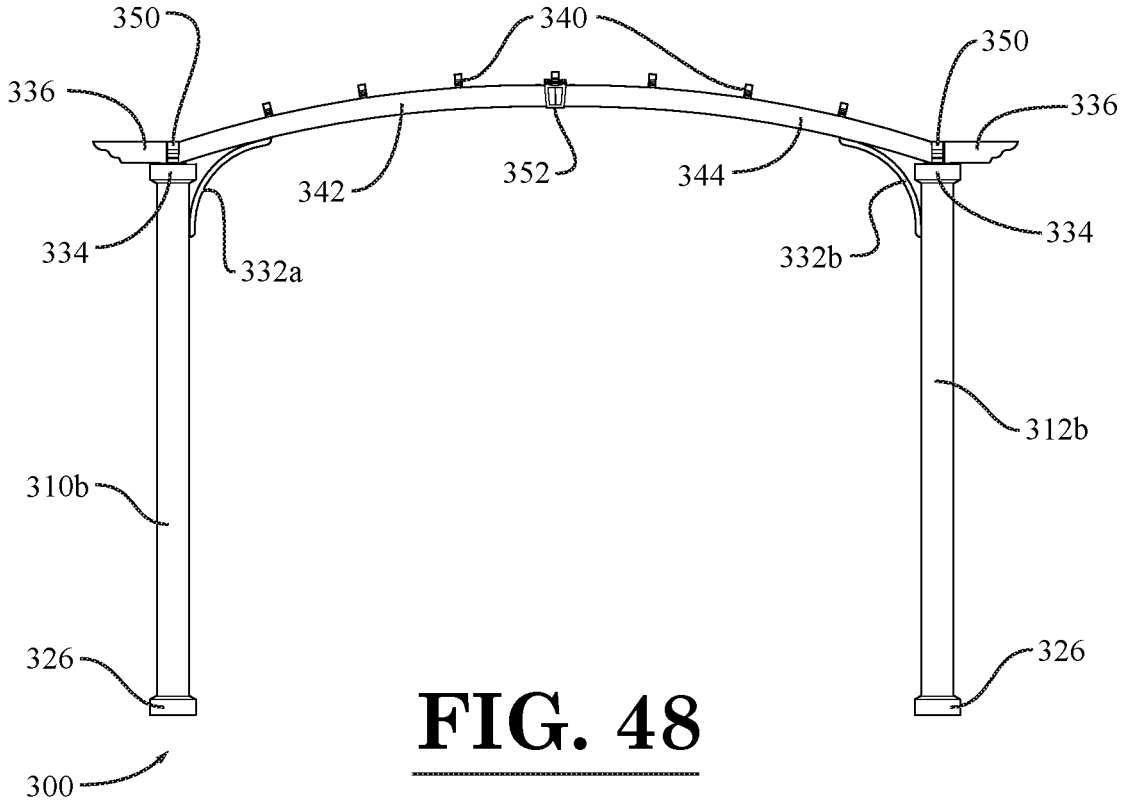
FIG. 48 is a first side elevational view of the outdoor shelter of FIG. 45.
Figure 49:
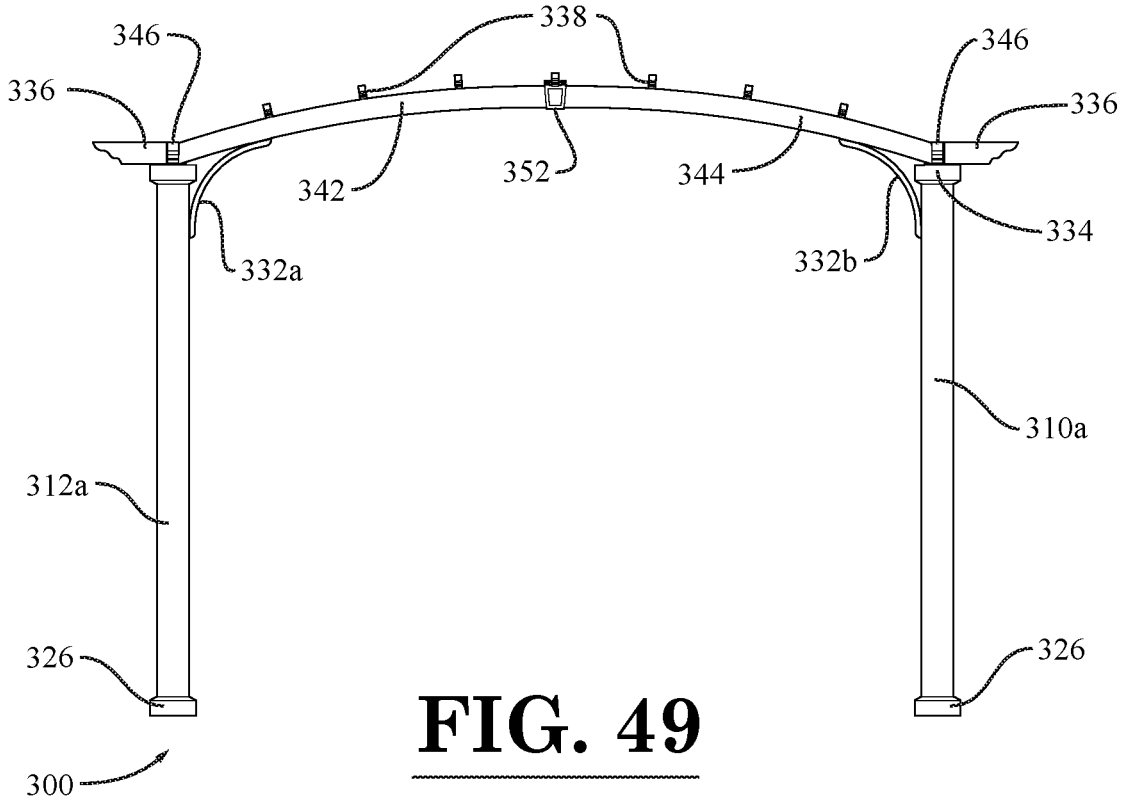
FIG. 49 is a second side elevational view of the outdoor shelter of FIG. 45.
Figure 50:
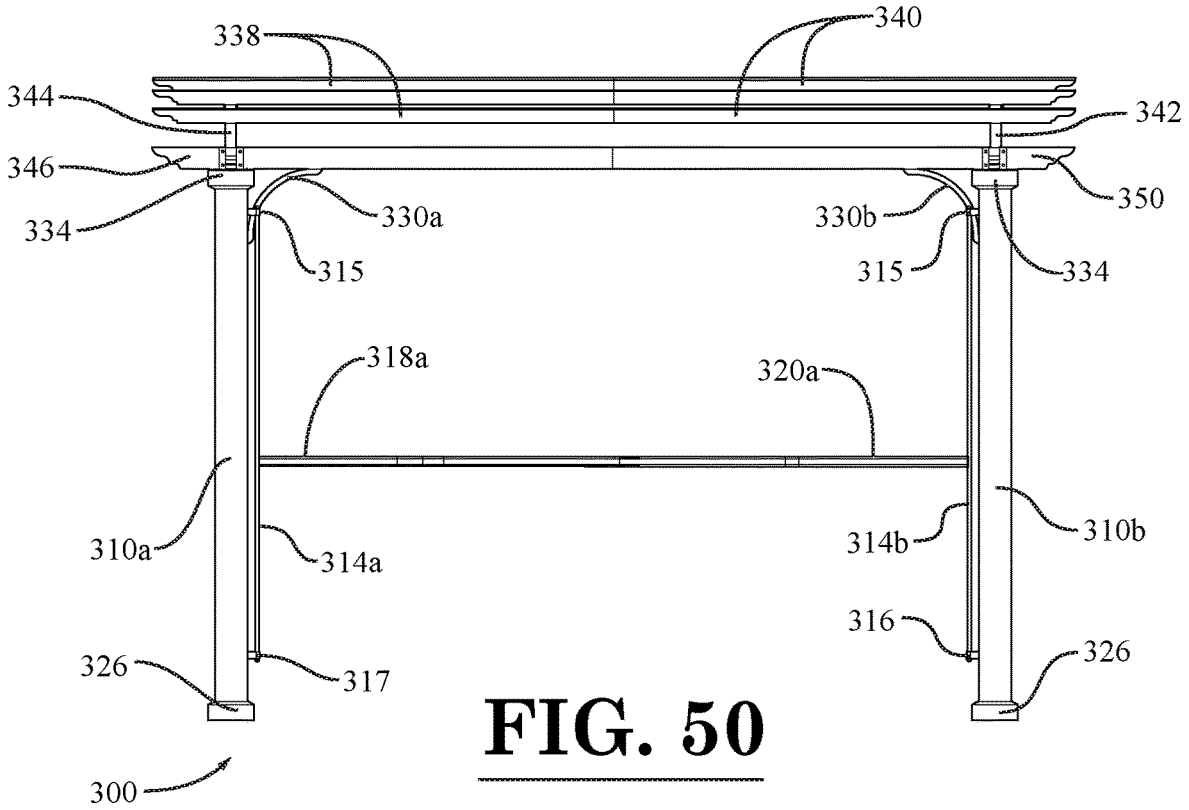
FIG. 50 is a front elevational view of the outdoor shelter of FIG. 45.
Figure 51:
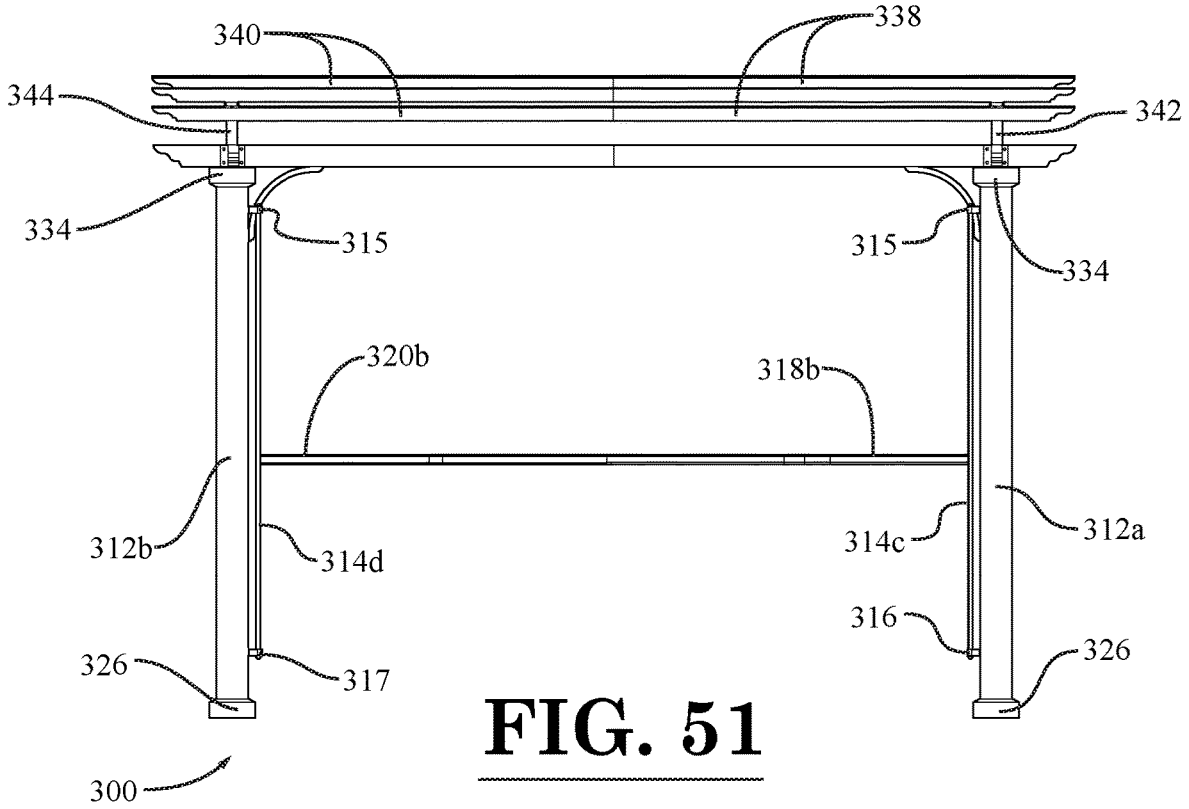
FIG. 51 is a rear elevational view of the outdoor shelter of FIG. 45.
Figure 52:
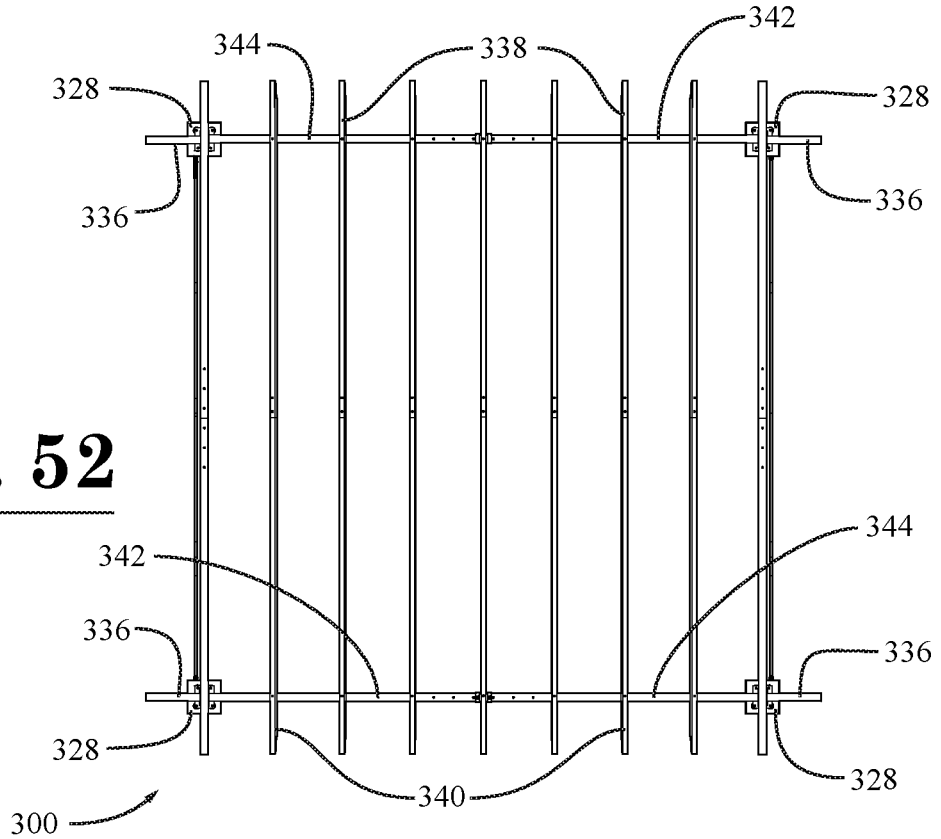
FIG. 52 is a top plan view of the outdoor shelter of FIG. 45.
Figure 53:
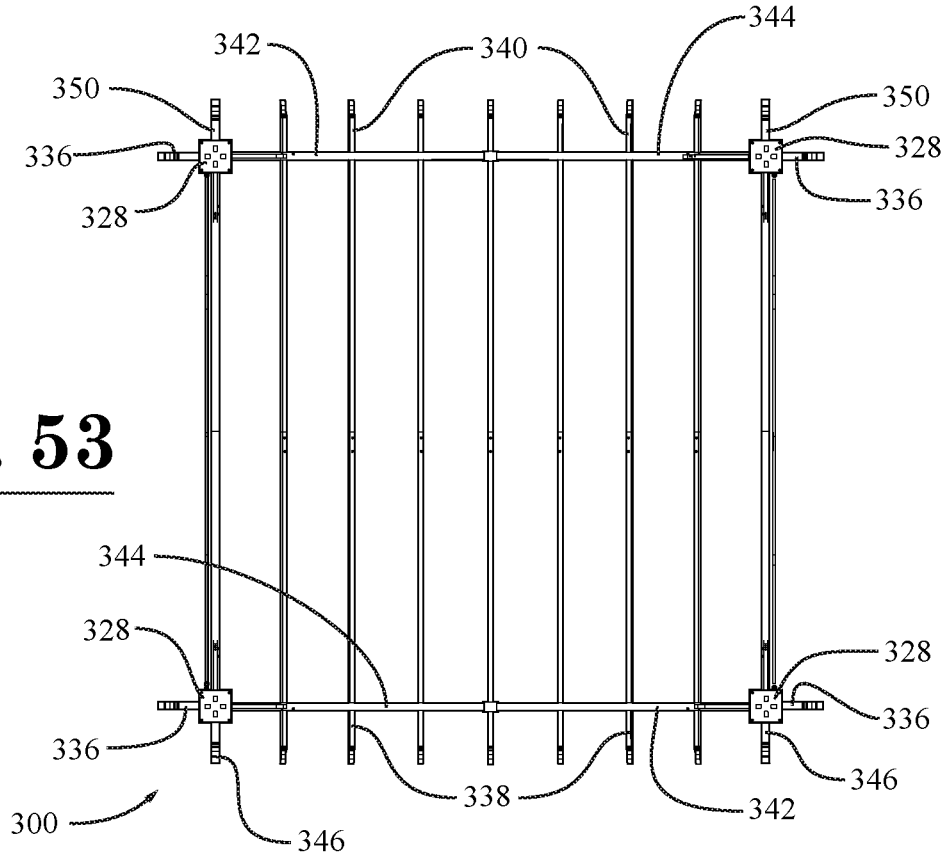
FIG. 53 is a bottom plan view of the outdoor shelter of FIG. 45.

Initially, referring to the exploded perspective view of FIG. 47, it can be seen that the frame system of the outdoor shelter 300 generally comprises a plurality of vertical support members (e.g., corner support post members 310*a*, 310*b*, 312*a*, 312*b*); a plurality of transverse roof beam members 338, 340, a plurality of longitudinal roof beam members 342, 344, and a plurality of end roof beam members 346, 350. Similar to that described above for the outdoor shelter 200, an adjustable shade member may be supported on the frame system of the outdoor shelter 300 so as to partially enclose the outdoor shelter 300.

Figure 45:
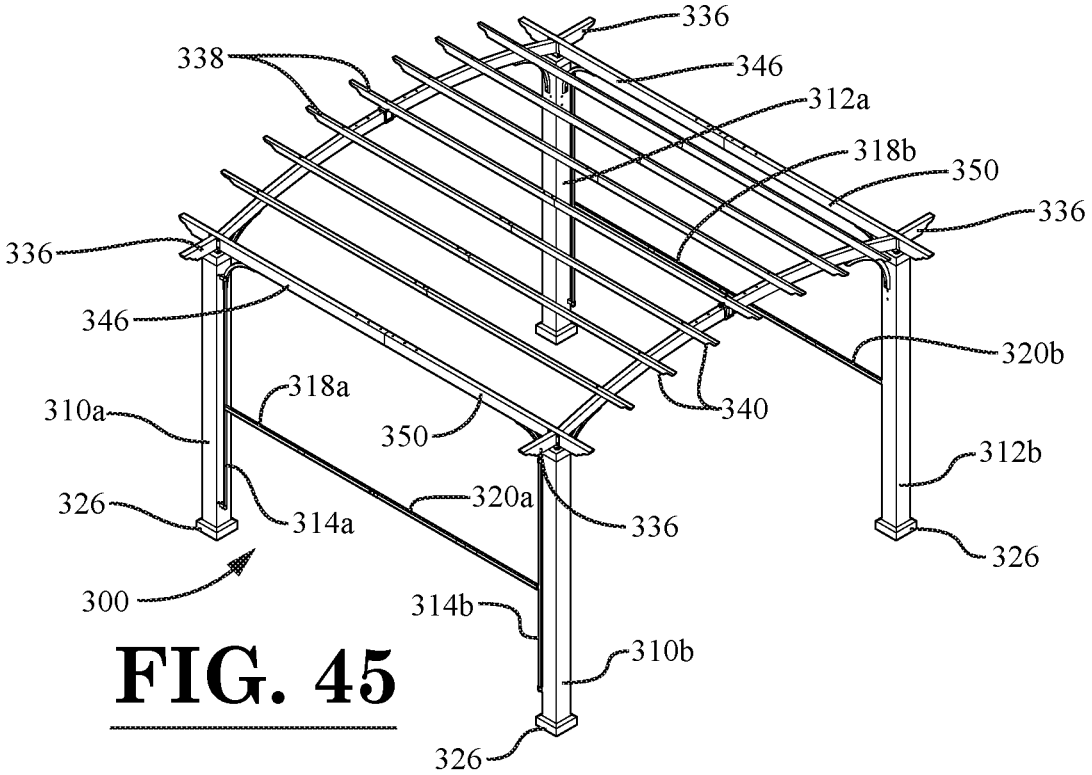
FIG. 45 is a side-top assembled perspective view of an outdoor shelter having a rail system, according to a fourth embodiment of the invention.
Figure 46:
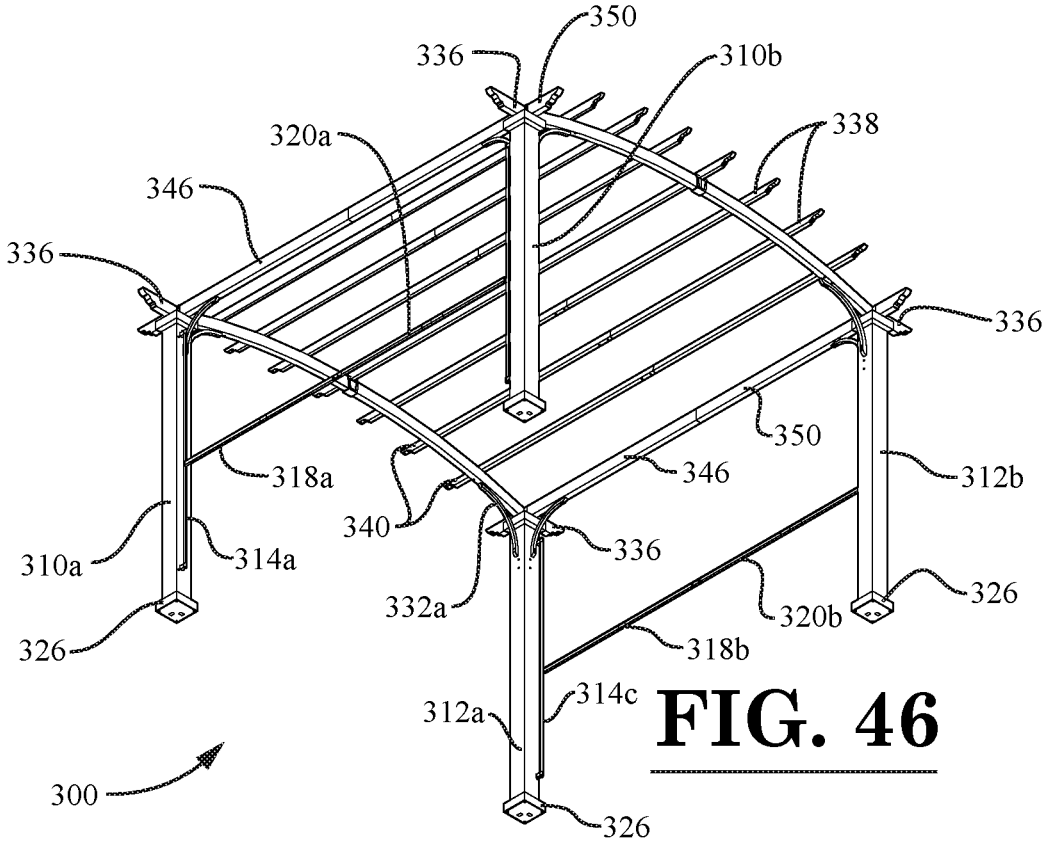
FIG. 46 is a bottom-side assembled perspective view of the outdoor shelter of FIG. 45.

As shown in FIGS. 45-47, the vertical support members of the portable shelter framing system of the illustrated embodiment are in the form of corner support post members 310*a*, 310*b*, 312*a*, 312*b*. First and second ones of the plurality of corner support post members 310*a*, 310*b* are disposed at a first longitudinal end of the outdoor shelter 300, while third and fourth ones of the plurality of corner support post members 312*a*, 312*b* are disposed at a second longitudinal end of the outdoor shelter 300. That is, a first pair of the corner support post members 310*a*, 310*b* is disposed at a first longitudinal end of the outdoor shelter 300, while a second pair of the corner support post members 312*a*, 312*b* is disposed at a second longitudinal end of the outdoor shelter 300. As shown in FIGS. 45 and 46, each of the two pairs of support post members comprises spaced-apart corner support post members 310*a*, 310*b*, 312*a*, 312*b* disposed at opposite longitudinal ends of the outdoor shelter 300. With reference again to the exploded perspective view of FIG. 47, it can be seen that each corner post support member 310*a*, 310*b*, 312*a*, 312*b* has a respective post cap member 334 mounted thereto. As will be explained in more detail hereinafter, the post cap members 334 connect the end roof beam members 346, 350 to the corner support post members 310*a*, 310*b*, 312*a*, 312*b*. In addition, as shown in FIG. 47, each of the corner support post members 310*a*, 310*b*, 312*a*, 312*b* is provided with a ground stake plate 328 for securely attaching the outdoor shelter 300 to the ground or a floor slab, as explained above in detail with regard to the first two embodiments.

Also, as illustrated in FIGS. 45-47, each of the corner support post members 310*a*, 310*b*, 312*a*, 312*b* is provided with a respective ground plate cover member 326 to conceal each ground stake plate 328 and the stakes or fasteners used to secure outdoor shelter 300 to the ground or floor. As shown in FIG. 47, the illustrated ground plate cover member 326 comprises a central aperture formed therethrough for accommodating a passage of the corner support post member 310*a*, 310*b*, 312*a*, or 312*b* through the ground plate cover member 326.

Next, with again reference to FIGS. 45-47, the rail system of the exemplary outdoor shelter 300 will be explained in detail. As best shown in the exploded view of FIG. 47, in the illustrative embodiment, the rail system of the exemplary outdoor shelter 300 generally includes the plurality of support post members 310*a*, 310*b*, 312*a*, 312*b* disposed at the respective corners of the outdoor shelter 300, a first guide rail member 314*a* coupled to the first one of the plurality of support post members 310*a*, a second guide rail member 314*b* coupled to the second one of the plurality of support post members 310*b*, a third guide rail member 314*c* coupled to the third one of the plurality of support post members 312*a*, a fourth guide rail member 314*d* coupled to the fourth one of the plurality of support post members 312*b*, a first shade support pole member 318*a*, 320*a* slidably coupled to the first and second guide rail members 314*a*, 314*b*, and a second shade support pole member 318*b*, 320*b* slidably coupled to the third and fourth guide rail members 314*c*, 314*d*. The first shade support pole member 318*a*, 320*a* is configured to be attached to a first end portion of a shade member (not shown) of the outdoor shelter 300, while the second shade support pole member 318*b*, 320*b* is configured to be attached to a second end portion of the shade member of the outdoor shelter 300. The first shade support pole member 318*a*, 320*a* is configured to be slidably displaced along the lengths of the first and second guide rail members 314*a*, 314*b* so as to allow an amount by which the shade member overhangs a first side of the outdoor shelter 300 to be adjusted by a user. Similarly, the second shade support pole member 318*b*, 320*b* is configured to be slidably displaced along the lengths of the third and fourth guide rail members 314*c*, 314*d* so as to allow an amount by which the shade member overhangs a second side of the outdoor shelter 300 to be adjusted by the user. In the illustrated embodiment, when the amount by which the shade member overhangs the first side of the outdoor shelter 300 is increased by the user (e.g., by pulling on the lower end of the shade member with shade support pole member 318*a*, 320*a*), the amount by which the shade member overhangs the second side of the outdoor shelter 300 is decreased. In other words, pulling down on one end of the shade member will raise the shade member on the opposite longitudinal end of the outdoor shelter 300 because the shade member has a constant overall length.

With continued reference to FIGS. 45-47, it can be seen that the first, second, third, and fourth guide rail members 314*a*, 314*b*, 314*c*, 314*d* are each coupled to respective first, second, third, and fourth ones of the corner support post members 310*a*, 310*b*, 312*a*, 312*b* by means of a pair of spaced-apart guide rail connector members 315, 316 or 315, 317. That is, as shown in these figures, each guide rail member 314*a*, 314*d* is supported at its longitudinal ends by oppositely disposed guide rail connector members 315, 317 (i.e., guide rail connector member 315 is provided at the top longitudinal end and guide rail connector member 317 is provided at the bottom longitudinal end). Each guide rail member 314*b*, 314*c* is supported at its longitudinal ends by oppositely disposed guide rail connector members 315, 316 (i.e., guide rail connector member 315 is provided at the top longitudinal end and guide rail connector member 316 is provided at the bottom longitudinal end). In the illustrated embodiment, each guide rail connector member 315, 316, 317 is in the form of a generally rectangular block with one semi-circular side (see FIG. 47). As described above for the first three embodiments, each guide rail connector member 315, 316, 317 has a circular aperture disposed longitudinally therethrough for receiving the cylindrical longitudinal end portion of the guide rail member 314*a*, 314*b*, 314*c*, 314*d*, which is in the form of a cylindrical rod in the illustrative embodiment. Each guide rail connector member 315, 316, 317 attaches a respective one of the guide rail members 314*a*, 314*b*, 314*c*, or 314*d* to the side of one of the corner support post members 310*a*, 310*b*, 312*a*, or 312*b*.

Turning again to the illustrative embodiment of FIGS. 45-47, the first shade support pole member 318*a*, 320*a* is slidably coupled to the first and second guide rail members 314*a*, 314*b* by means of a first pair of spaced-apart shade support pole connector members 322. Similarly, the second shade support pole member 318*b*, 320*b* is slidably coupled to the third and fourth guide rail members 314*c*, 314*d* by means of a second pair of spaced-apart shade support pole connector members 322. In the illustrative embodiment, each of the spaced-apart shade support pole connector members 322 is disposed proximate to a respective longitudinal end of the first and second shade support pole members 318*a*, 320*a* and 318*b*, 320*b*. That is, the first and second shade support pole members 318*a*, 320*a* and 318*b*, 320*b* are supported at their longitudinal ends by shade support pole connector members 322. In the illustrated embodiment, with reference to FIG. 47, each shade support pole connector member 322 is in the form of a side mount bracket with opposed flanges disposed on opposite sides of a cylindrical body portion. The cylindrical body portion of each shade support pole connector member 322 has a circular pole receiving cavity disposed longitudinally therethrough for receiving the cylindrical cross-section of a respective guide rail member 314*a*, 314*b*, 314*c*, 314*d*. In addition, each of the pair of opposed flanges of each shade support pole connector member 322 may be provided with a fastener aperture disposed therein for receiving a fastener (e.g., a screw or bolt) for securing the shade support pole connector member 322 to the back side of one of the shade support pole members 318*a*, 320*a* and 318*b*, 320*b* (e.g., as shown in FIG. 30). By means of the shade support pole members 318*a*, 320*a* and 318*b*, 320*b*, the shade support pole connector members 322 slidably couple the opposed longitudinal ends of the shade member to the guide rail members 314*a*, 314*b*, 314*c*, 314*d*.

Referring again to the exploded view of FIG. 47, it can be seen that, in the fourth illustrative embodiment, the first and second shade support pole members 318*a*, 318*b*, 320*a*, 320*b* each comprise a pair of shade support pole sections 318*a*, 320*a* and 318*b*, 320*b*. A first one 320*a*, 320*b* of each pair of shade support pole sections has an end portion of reduced cross-sectional area that is receivable within a recess of an end portion of a second one 318*a*, 318*b* of the pair of shade support pole sections. That is, the end portion of each shade support pole section 320*a*, 320*b* is received within the central recess of a respective shade support pole section 318*a*, 318*b*. Also, in the illustrated embodiment, the end portion of each shade support pole section 320*a*, 320*b* may be secured within the recess of its respective shade support pole section 318*a*, 318*b* by means of a plurality of fasteners (e.g., screws or bolts) passing through the paired shade support pole sections 318*a*, 320*a* and 318*b*, 320*b*. In the illustrative embodiment, the first and second longitudinal end portions of the shade member (not shown) are looped so as to form cavities (or pockets) for receiving respective first and second shade support pole members 318*a*, 320*a* and 318*b*, 320*b* (see e.g., refer to FIG. 11). That is, the first paired shade support pole sections 318*a*, 320*a* are inserted into the first looped longitudinal end portion of the shade member, and the second paired shade support pole sections 318*b*, 320*b* are inserted into the second looped longitudinal end portion of the shade member before the shade support pole members 318*a*, 318*b*, 320*a*, 320*b* are secured to the guide rail members 314*a*, 314*b*, 314*c*, 314*d* by means of the shade support pole connector members 322.

Next, as best shown in the perspective views of FIGS. 46 and 47, the roof frame assembly of the outdoor shelter 300 of the illustrative embodiment will be explained. In the illustrative embodiment, the peripheral frame structure of the outdoor shelter 300 is formed by the longitudinal roof beam members 342, 344 and the end roof beam members 346, 350. The longitudinal roof beam members 342, 344 are connected to the sides of the end roof beam members 346, 350 (see FIG. 47) so as to form a rectangular peripheral frame structure for the roof of the outdoor shelter 300. For example, in an exemplary embodiment, the end roof beam members 346, 350 may be provided with bottom plate members that are secured to a respective one of the post cap members 334 by means of a plurality of fasteners (e.g., screws or bolts). As best shown in FIGS. 46 and 47, the longitudinal roof beam members 342, 344 extend in a longitudinal direction between spaced-apart end roof beam members 346, 350. In the fourth illustrative embodiment, each one of the longitudinal roof beam members 342 is attached to a respective one of the longitudinal roof beam members 344 by a longitudinal roof beam connector 343 (see FIG. 47) that slides into the inner ends of the longitudinal roof beam members 342, 344. In the illustrative embodiment, the longitudinal roof beam connector 343 has a curvature that corresponds to the curvature of the longitudinal roof beam members 342, 344. Similarly, each one of the end roof beam members 346 is attached to a respective one of the end roof beam members 350 by an end roof beam connector 348 (see FIG. 47) that slides into the inner ends of the end roof beam members 346, 350. In addition, as best shown in the exploded view of FIG. 47, a beam trim member 336 is mounted on a side of each end roof beam member 346, 350, which is opposite to the side on which the longitudinal roof beam member 342, 344 is mounted. Also, as shown in FIG. 47, a decorative ferrule 352 is provided at the location where the inner end of each longitudinal roof beam member 342 is joined to the inner end of each longitudinal roof beam member 344.

Each of the corners of the outdoor shelter 300 is reinforced by means of a pair of arc support members 330*a*, 330*b*, 332*a*, 332*b*. That is, as shown in FIGS. 46-51, the arc support members 330*a*, 330*b*, 332*a*, 332*b* attach the roof beam members 342, 344, 346, 350 to sides of the corner support post members 310*a*, 310*b*, 312*a*, 312*b*. That is, each arc support member 330*a*, 330*b*, 332*a*, 332*b* is configured to be attached between a respective one of the corner support post members 310*a*, 310*b*, 312*a*, 312*b* and a respective one of the plurality of peripheral beam members 342, 344, 346, 350 by means of fasteners (e.g., screws or bolts).

Also, as shown in FIGS. 46 and 47, the roof frame structure of the outdoor shelter 300 further comprises a plurality of transverse roof beam members 338, 340 that are mounted to the top surfaces of the longitudinal roof beam members 342, 344 (e.g., by using fasteners, such as screws or bolts). The transverse roof beam members 338, 340 are located between the corner support post members 310*a*, 310*b*, 312*a*, 312*b*, and are supported on the top surfaces of the spaced-apart longitudinal roof beam members 342, 344 (refer to FIGS. 46 and 47).

In the fourth illustrative embodiment, each one of the transverse roof beam members is formed by a first transverse roof beam section 338 that is affixed to a second transverse roof beam section 340 by a plurality of fasteners (e.g., screws or bolts). Also, in the illustrative embodiment, the transverse roof beam members 338, 340 are generally equally spaced apart across the top of the longitudinal roof beam members 342, 344 so as to form a supporting structure for the shade member (not shown). In the illustrative embodiment, the shade member passes over the top of the transverse roof beam members 338, 340 when the outdoor shelter 300 is in an assembled state.

In one or more embodiments, the framing components of the outdoor shelter 300 (e.g., as illustrated in FIGS. 46 and 47) are formed from a suitable metallic material, such as steel. However, those of ordinary skill in the art will appreciate that other suitable materials can be used for the various components of the outdoor shelter 300 as well. Also, each of the fastener members described in conjunction with the fourth embodiment may comprise a plurality of external threads disposed on the outer periphery thereof, and one or more of the fastener apertures with which the threaded fastener members are threadingly engaged may be provided with corresponding internal threads around the circumference thereof so as to obviate the need for the use of nuts (e.g., the fastener aperture that is the furthest in the axial direction from the head of the fastener member may be internally threaded).

A fifth exemplary embodiment of an outdoor shelter in the form of a pergola is seen generally at 400 in FIGS. 54-62. Referring to these figures, it can be seen that, in many respects, the fifth illustrative embodiment is similar to that of the preceding illustrative embodiments described above. As such, many elements are common to all of these embodiments.

The fifth illustrative embodiment of the outdoor shelter 400 is similar to the outdoor shelters 200, 300 described above, except that the roof support structure and the corner support post members of the outdoor shelter 400 have a somewhat different structure from the embodiments described above. There are also other minor differences between the embodiments that will be made apparent from the drawings and the description provided hereinafter.

Figure 56:
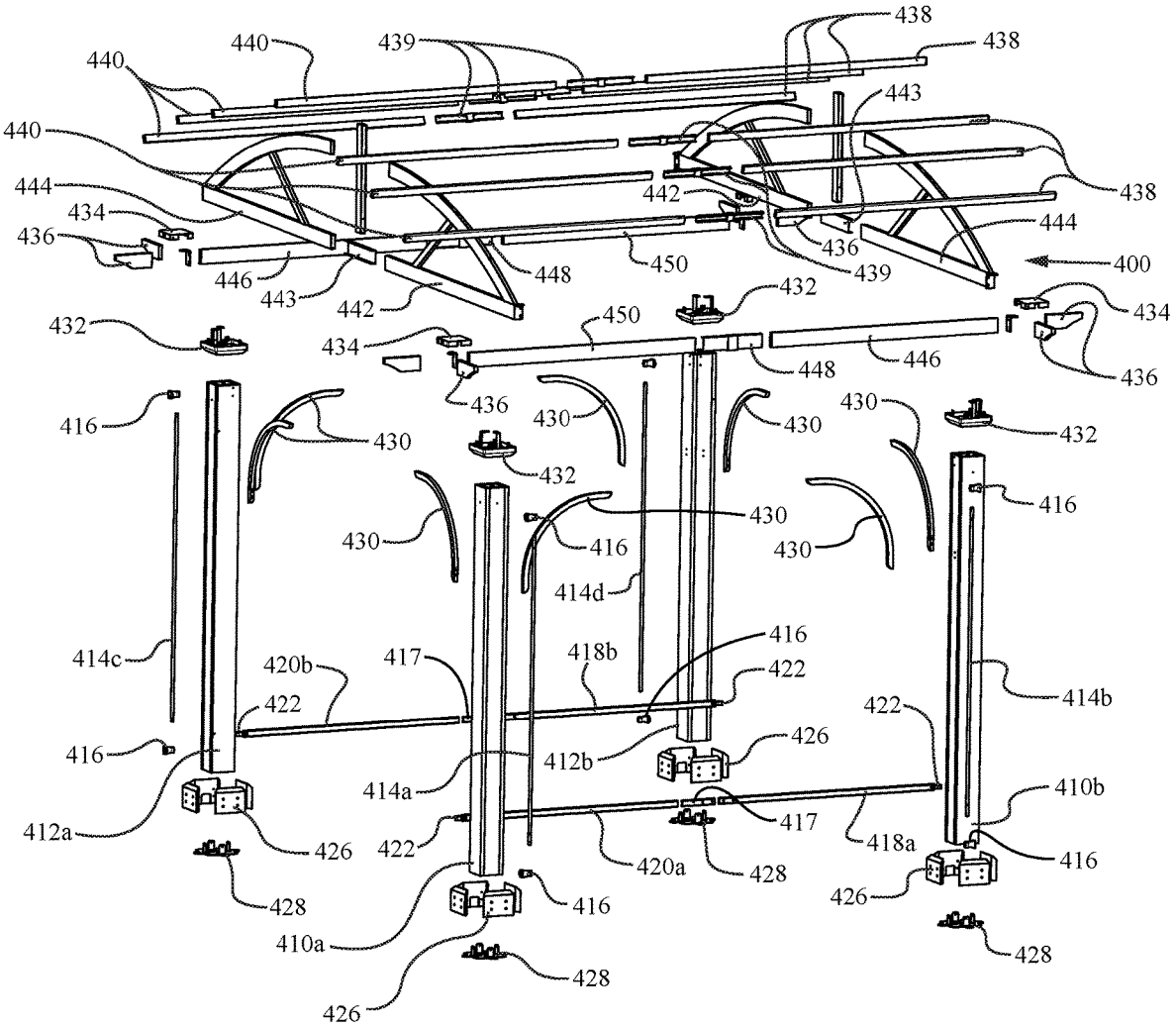
FIG. 56 is an exploded perspective view of the outdoor shelter of FIG. 54.

Initially, referring to the exploded perspective view of FIG. 56, it can be seen that the frame system of the outdoor shelter 400 generally comprises a plurality of vertical support members (e.g., corner support post members 410*a*, 410*b*, 412*a*, 412*b*); a plurality of transverse roof beam members 438, 440, a plurality of longitudinal roof beam members 442, 444, and a plurality of end roof beam members 446, 450. As will be described hereinafter, an adjustable shade member 424 is supported on the frame system of the outdoor shelter 400 so as to partially enclose the outdoor shelter 400.

Figure 54:
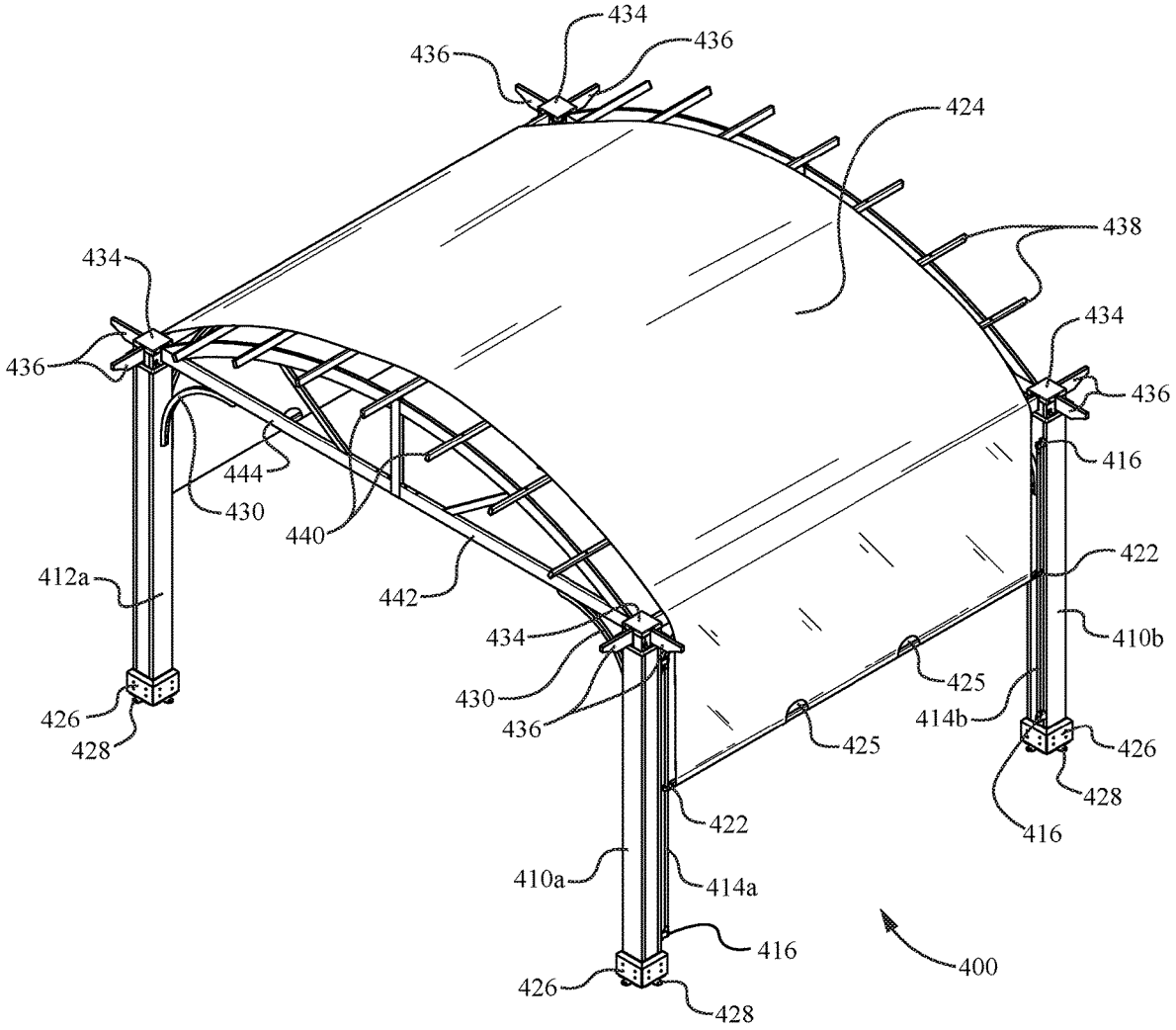
FIG. 54 is a side-top assembled perspective view of an outdoor shelter having a rail system, according to a fifth embodiment of the invention.
Figure 55:
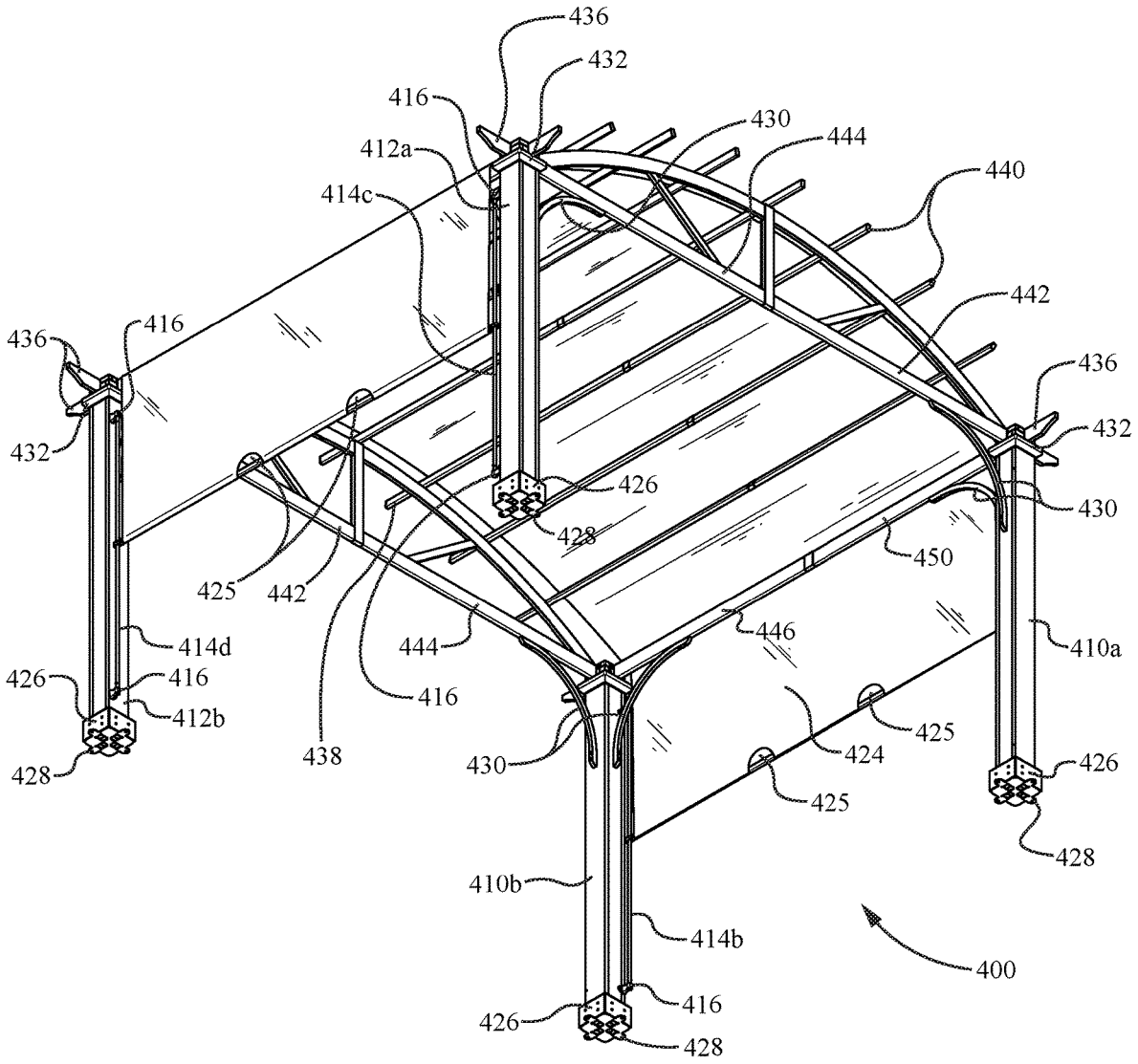
FIG. 55 is a bottom-side assembled perspective view of the outdoor shelter of FIG. 54.

As shown in FIGS. 54 and 55, the vertical support members of the portable shelter framing system of the illustrated embodiment are in the form of corner support post members 410*a*, 410*b*, 412*a*, 412*b*. First and second ones of the plurality of corner support post members 410*a*, 410*b* are disposed at a first longitudinal end of the outdoor shelter 400, while third and fourth ones of the plurality of corner support post members 412*a*, 412*b* are disposed at a second longitudinal end of the outdoor shelter 400. That is, a first pair of the corner support post members 410*a*, 410*b* is disposed at a first longitudinal end of the outdoor shelter 400, while a second pair of the corner support post members 412*a*, 412*b* is disposed at a second longitudinal end of the outdoor shelter 400. As shown in FIGS. 54 and 55, each of the two pairs of support post members comprises spaced-apart corner support post members 410*a*, 410*b*, 412*a*, 412*b* disposed at opposite longitudinal ends of the outdoor shelter 400. With reference again to the exploded perspective view of FIG. 56, it can be seen that each corner post support member 410*a*, 410*b*, 412*a*, 412*b* has a respective post top cap member 434 mounted thereto. In addition, as shown in FIG. 56, each of the corner support post members 410*a*, 410*b*, 412*a*, 412*b* is provided with a base stake plate 428 for securely attaching the outdoor shelter 400 to the ground or a floor slab, as explained above in detail with regard to the preceding embodiments.

Also, as illustrated in FIGS. 54-56, each of the corner support post members 410*a*, 410*b*, 412*a*, 412*b* is provided with a plurality of base cover members 426 to conceal a portion of each base stake plate 428 (e.g., four (4) base cover members 426 per corner support post member 410*a*, 410*b*, 412*a*, 412*b*). As shown in FIG. 56, the illustrated base cover members 426 are provided on each of the four (4) sides of the corner support post member 410*a*, 410*b*, 412*a*, 412*b*.

Next, with again reference to FIGS. 54-56, the rail system of the exemplary outdoor shelter 400 will be explained in detail. As best shown in the exploded view of FIG. 56, in the illustrative embodiment, the rail system of the exemplary outdoor shelter 400 generally includes the plurality of support post members 410*a*, 410*b*, 412*a*, 412*b* disposed at the respective corners of the outdoor shelter 400, a first guide rail member 414*a* coupled to the first one of the plurality of support post members 410*a*, a second guide rail member 414*b* coupled to the second one of the plurality of support post members 410*b*, a third guide rail member 414*c* coupled to the third one of the plurality of support post members 412*a*, a fourth guide rail member 414*d* coupled to the fourth one of the plurality of support post members 412*b*, a first shade support pole member 418*a*, 420*a* slidably coupled to the first and second guide rail members 414*a*, 414*b*, and a second shade support pole member 418*b*, 420*b* slidably coupled to the third and fourth guide rail members 414*c*, 414*d*. The first shade support pole member 418*a*, 420*a* is attached to a first end portion of a shade member 424 of the outdoor shelter (see FIGS. 54-56), while the second shade support pole member 418*b*, 420*b* is attached to a second end portion of the shade member 424 of the outdoor shelter 400. The first shade support pole member 418*a*, 420*a* is configured to be slidably displaced along the lengths of the first and second guide rail members 414*a*, 414*b* so as to allow an amount by which the shade member 424 overhangs a first side of the outdoor shelter 400 to be adjusted by a user. Similarly, the second shade support pole member 418*b*, 420*b* is configured to be slidably displaced along the lengths of the third and fourth guide rail members 414*c*, 414*d* so as to allow an amount by which the shade member 424 overhangs a second side of the outdoor shelter 400 to be adjusted by the user. In the illustrated embodiment, when the amount by which the shade member 424 overhangs the first side of the outdoor shelter 400 is increased by the user (e.g., by pulling on the lower end of the shade member 424 with shade support pole member 418*a*, 420*a*), the amount by which the shade member 424 overhangs the second side of the outdoor shelter 400 is decreased. In other words, pulling down on one end of the shade member 424 will raise the shade member 424 on the opposite longitudinal end of the outdoor shelter 400 because the shade member 424 has a constant overall length.

With continued reference to FIGS. 54-56, it can be seen that the first, second, third, and fourth guide rail members 414*a*, 414*b*, 414*c*, 414*d* are each coupled to respective first, second, third, and fourth ones of the corner support post members 410*a*, 410*b*, 412*a*, 412*b* by means of a pair of spaced-apart guide rail connector members 416. That is, as shown in these figures, each guide rail member 414*a*, 414*b*, 414*c*, 414*d* is supported at its longitudinal ends by oppositely disposed guide rail connector members 416 (i.e., a guide rail connector member 416 is provided at the top longitudinal end and a guide rail connector member 416 is provided at the bottom longitudinal end). In the illustrated embodiment, each guide rail connector member 416 has one semi-circular side facing the shade member 424. As described above for the preceding embodiments, each guide rail connector member 416 has a circular aperture 452 (see FIG. 63) disposed longitudinally therethrough for receiving the cylindrical longitudinal end portion of the guide rail member 414*a*, 414*b*, 414*c*, 414*d*, which is in the form of a cylindrical rod in the illustrative embodiment. Each pair of guide rail connector members 416 attaches a respective one of the guide rail members 414*a*, 414*b*, 414*c*, or 414*d* to the side of one of the corner support post members 410*a*, 410*b*, 412*a*, or 412*b*.

Figure 63:
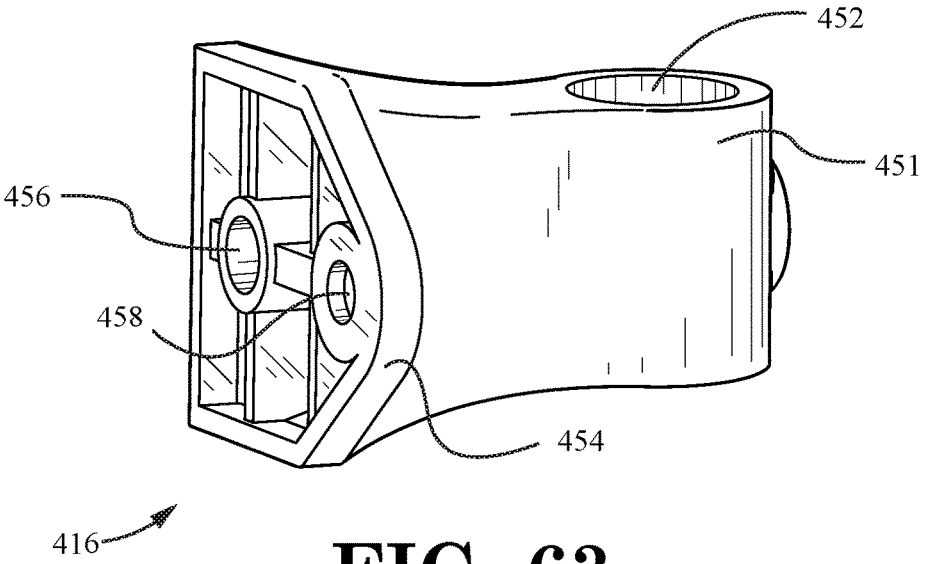
FIG. 63 is a perspective view of one of the guide rail connector members of the outdoor shelter of FIG. 54.

In the illustrated embodiment, with reference to FIG. 63, each guide rail connector member 416 has a body portion 451 with the rail circular aperture 452 and a flange portion 454 extending outwardly from the base of the body portion 451. In addition, as shown in FIG. 63, each guide rail connector member 416 may be provided with a first fastener aperture 456 for receiving a first fastener (e.g., a screw or bolt) for securing the guide rail connector member 416 and a respective one of the guide rail members 414*a*, 414*b*, 414*c*, or 414*d* to the side of one of the corner support post members 410*a*, 410*b*, 412*a*, or 412*b*. Each guide rail connector member 416 also may be provided with a second fastener aperture 458 disposed through the flange portion 454 thereof for receiving a second fastener (e.g., a screw or bolt) for further securing the guide rail connector member 416 to the side of one of the corner support post members 410*a*, 410*b*, 412*a*, or 412*b*.

Figure 64:
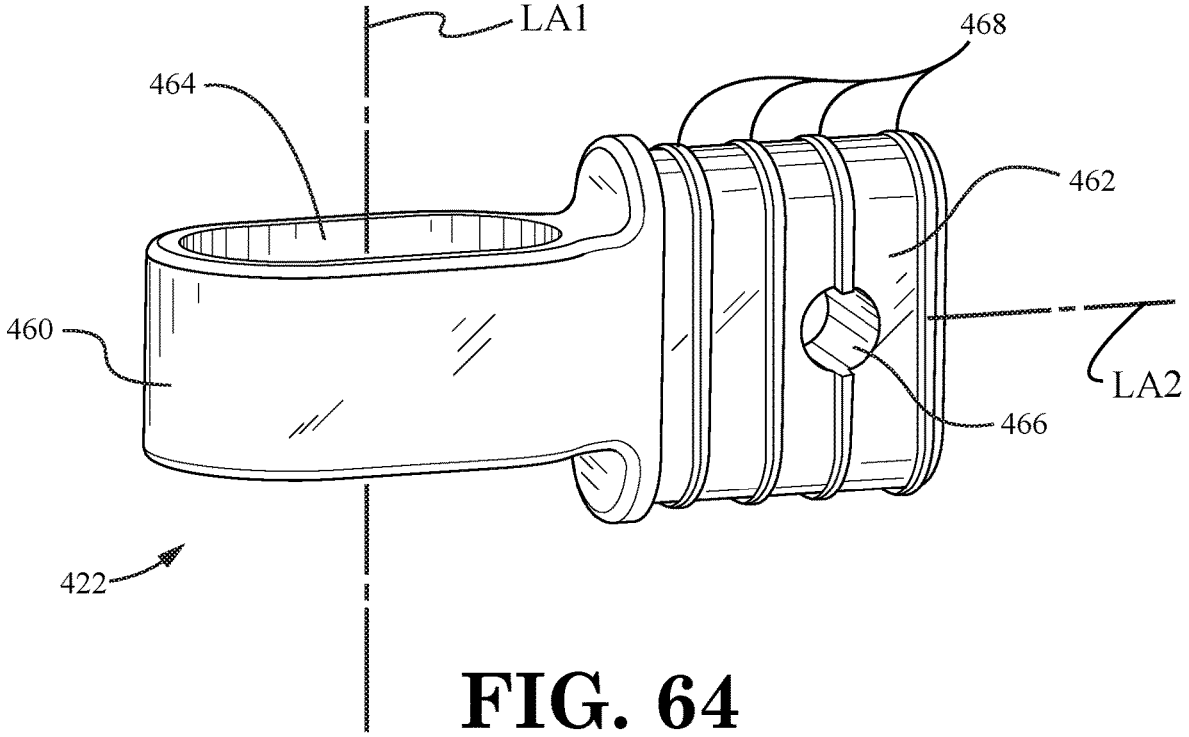
FIG. 64 is a perspective view of one of the shade support pole connector members of the outdoor shelter of FIG. 54.

Turning again to the illustrative embodiment of FIGS. 54-56, the first shade support pole member 418*a*, 420*a* is slidably coupled to the first and second guide rail members 414*a*, 414*b* by means of a first pair of spaced-apart shade support pole connector members 422. Similarly, the second shade support pole member 418*b*, 420*b* is slidably coupled to the third and fourth guide rail members 414*c*, 414*d* by means of a second pair of spaced-apart shade support pole connector members 422. In the illustrative embodiment, each of the spaced-apart shade support pole connector members 422 is disposed proximate to a respective longitudinal end of the first and second shade support pole members 418*a*, 420*a* and 418*b*, 420*b*. That is, the first and second shade support pole members 418*a*, 420*a* and 418*b*, 420*b* are supported at their longitudinal ends by shade support pole connector members 422. In the illustrated embodiment, with reference to FIGS. 56 and 64, each shade support pole connector member 422 is in the form of a pole end cap with a flange portion 462 that is inserted into the open end of one of the first and second shade support pole members 418*a*, 420*a* and 418*b*, 420*b*. In the illustrated embodiment, each shade support pole connector member 422 further comprises a tubular body portion 460 that is connected to, and extends outwardly from the flange portion 462. The tubular body portion 460 of each shade support pole connector member 422 has an oval-shaped pole receiving aperture 464 disposed longitudinally therethrough for receiving the cylindrical cross-section of a respective guide rail member 414*a*, 414*b*, 414*c*, 414*d* (see FIG. 64). In the illustrated embodiment, the longitudinal central axis LA1 of the oval-shaped pole receiving aperture 464 of each shade support pole connector member 422 is disposed perpendicular or generally perpendicular to the longitudinal extending axis LA2 of the flange portion 462 of the each shade support pole connector member 422. In addition, in the illustrated embodiment, the flange portion 462 of each shade support pole connector member 422 may be provided with a plurality of barbs 468 that retain the shade support pole connector member 422 in the open end of the first or second shade support pole member 418*a*, 420*a*, 418*b*, 420*b*. As shown in FIG. 64, in the illustrated embodiment, the flange portion 462 of each shade support pole connector member 422 also may be provided with a fastener aperture 466 for receiving a fastener (e.g., a screw or bolt) that secures the shade support pole connector member 422 within the open end of the first or second shade support pole member 418*a*, 420*a*, 418*b*, 420*b*. By means of the shade support pole members 418*a*, 420*a* and 418*b*, 420*b*, the shade support pole connector members 422 slidably couple the opposed longitudinal ends of the shade member 424 to the guide rail members 414*a*, 414*b*, 414*c*, 414*d*.

Referring again to the exploded view of FIG. 56, it can be seen that, in the fifth illustrative embodiment, the first and second shade support pole members 418*a*, 418*b*, 420*a*, 420*b* each comprise a pair of shade support pole sections 418*a*, 420*a* and 418*b*, 420*b*. In the fifth illustrative embodiment, each of the shade support pole sections 418*a*, 418*b* is attached to a respective one of the shade support pole sections 420*a*, 420*b* by a shade support pole coupling member 417 (see FIG. 56) that slides into the inner ends of the shade support pole sections 418*a*, 418*b*, 420*a*, 420*b*. In the illustrative embodiment, the first and second longitudinal end portions of the shade member 424 are looped so as to form cavities (or pockets) for receiving respective first and second shade support pole members 418*a*, 420*a* and 418*b*, 420*b* (see e.g., refer to FIGS. 54, 55, 59, and 60). That is, the first paired shade support pole sections 418*a*, 420*a* are inserted into the first looped longitudinal end portion of the shade member 424, and the second paired shade support pole sections 418*b*, 420*b* are inserted into the second looped longitudinal end portion of the shade member 424 before the shade support pole members 418*a*, 418*b*, 420*a*, 420*b* are secured to the guide rail members 414*a*, 414*b*, 414*c*, 414*d* by means of the shade support pole connector members 422.

In the illustrative embodiment, the shade member 424 of the outdoor shelter 400 may be formed from a fabric material. For example, in one or more exemplary embodiments, the shade member 424 may be formed from a waterproof fabric material so that the area underneath the shade member 424 of the outdoor shelter 400 remains dry during a rain storm. In addition, as shown in the overall perspective view of FIG. 54, in the illustrative embodiment, each longitudinal end portion of the shade member 424 may comprise a pair of spaced-apart, semi-circular handle cutout portions formed in the edges of the shade member 424. The handle cutout portion of the shade member 424 and a longitudinal section of the shade support pole member 418*a*, 420*a* and 418*b*, 420*b* together define a semi-circular handle aperture 425 that is configured to receive a portion of a hand of the user so as to facilitate the grasping of the shade member 424 and the shade support pole member 418*a*, 420*a* and 418*b*, 420*b* by the user during the adjustment of the shade member 424 (refer to FIG. 54).

Next, as best shown in the perspective views of FIGS. 55 and 56, the roof frame assembly of the outdoor shelter 400 of the illustrative embodiment will be explained. In the illustrative embodiment, the peripheral frame structure of the outdoor shelter 400 is formed by the curved roof frame members 442, 444 and the end roof beam members 446, 450. The curved roof frame members 442, 444 are connected to one pair of sides of the support post members 410*a*, 410*b*, 412*a*, 412*b* and the end roof beam members 446, 450 are connected to another pair of sides of the support post members 410*a*, 410*b*, 412*a*, 412*b* (see FIGS. 55 and 56) so as to form a rectangular peripheral frame structure for the roof of the outdoor shelter 400. For example, in an exemplary embodiment, the ends of the curved roof frame members 442, 444 and the ends of the end roof beam members 446, 450 may be provided with L-shaped bracket members that are secured to sides of the support post members 410*a*, 410*b*, 412*a*, 412*b* by means of a plurality of fasteners (e.g., screws or bolts). As best shown in FIGS. 55 and 56, the curved roof frame members 442, 444 extend in a longitudinal direction between spaced-apart support post members 410*a*, 410*b*, 412*a*, 412*b*. In the fifth illustrative embodiment, each one of the curved roof frame members 442 is attached to a respective one of the curved roof frame members 444 by a longitudinal roof frame connector 443 (see FIG. 56) that slides into the inner ends of the curved roof frame members 442, 444. In the illustrative embodiment, each of the curved roof frame members 444 comprises a straight bottom chord, a curved top chord, and a diagonal brace member extending between the straight bottom chord and the curved top chord (see FIG. 56). In the illustrative embodiment, the longitudinal roof frame connector 443 connects the bottom chords of the curved roof frame members 442, 444 to one another. Similarly, each one of the end roof beam members 446 is attached to a respective one of the end roof beam members 450 by an end roof beam connector 448 (see FIG. 56) that slides into the inner ends of the end roof beam members 446, 450. In addition, as shown in FIGS. 54-56, a beam trim member 436 is mounted on a side of each support post member 410*a*, 410*b*, 412*a*, 412*b*, which is opposite to the side on which the curved roof frame member 442, 444 is mounted. Also, a beam trim member 436 is mounted on a side of each support post member 410*a*, 410*b*, 412*a*, 412*b*, which is opposite to the side on which the end roof beam member 446, 450 is mounted.

Figure 57:
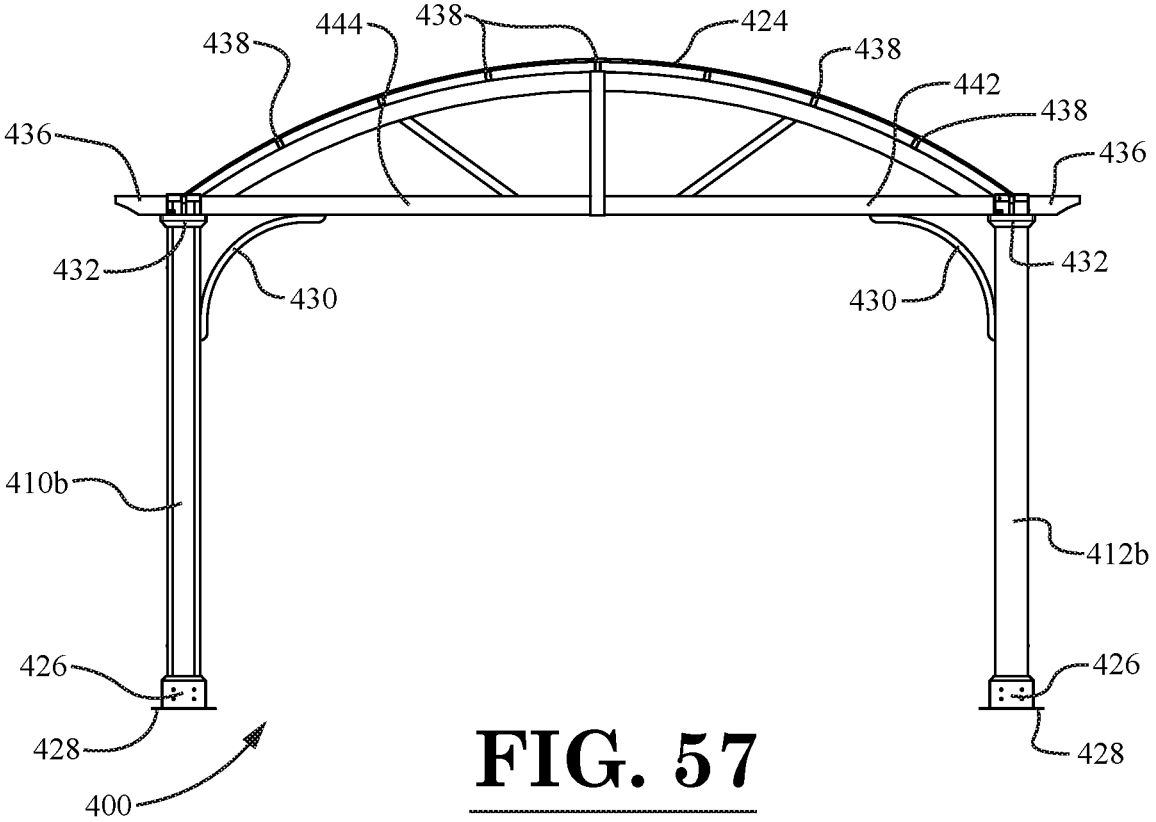
FIG. 57 is a first side elevational view of the outdoor shelter of FIG. 54.
Figure 58:
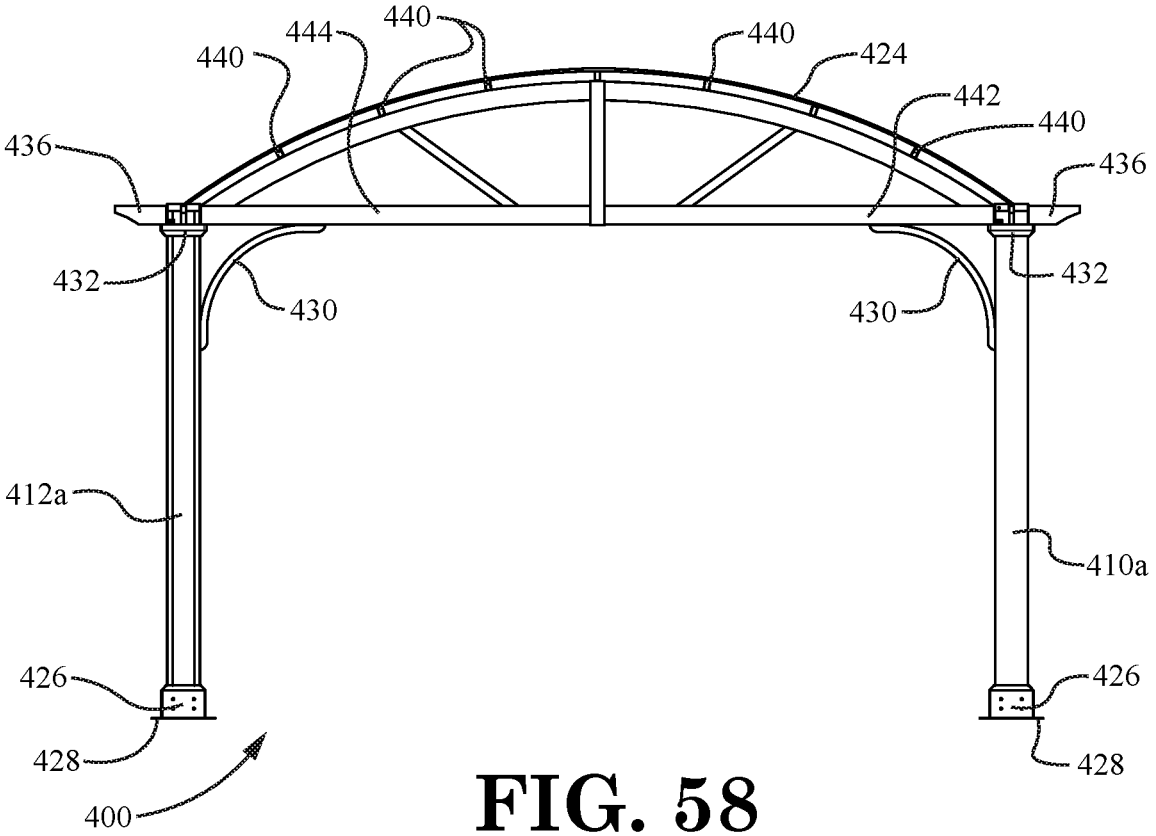
FIG. 58 is a second side elevational view of the outdoor shelter of FIG. 54.
Figure 59:
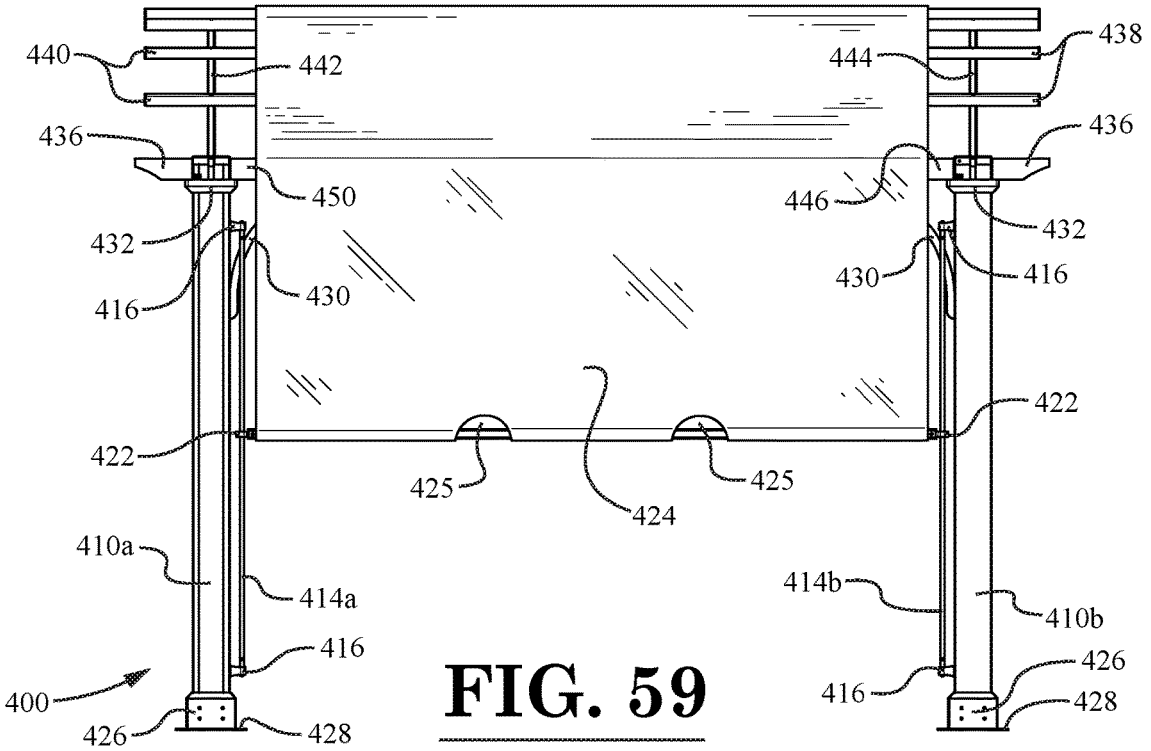
FIG. 59 is a front elevational view of the outdoor shelter of FIG. 54.
Figure 60:
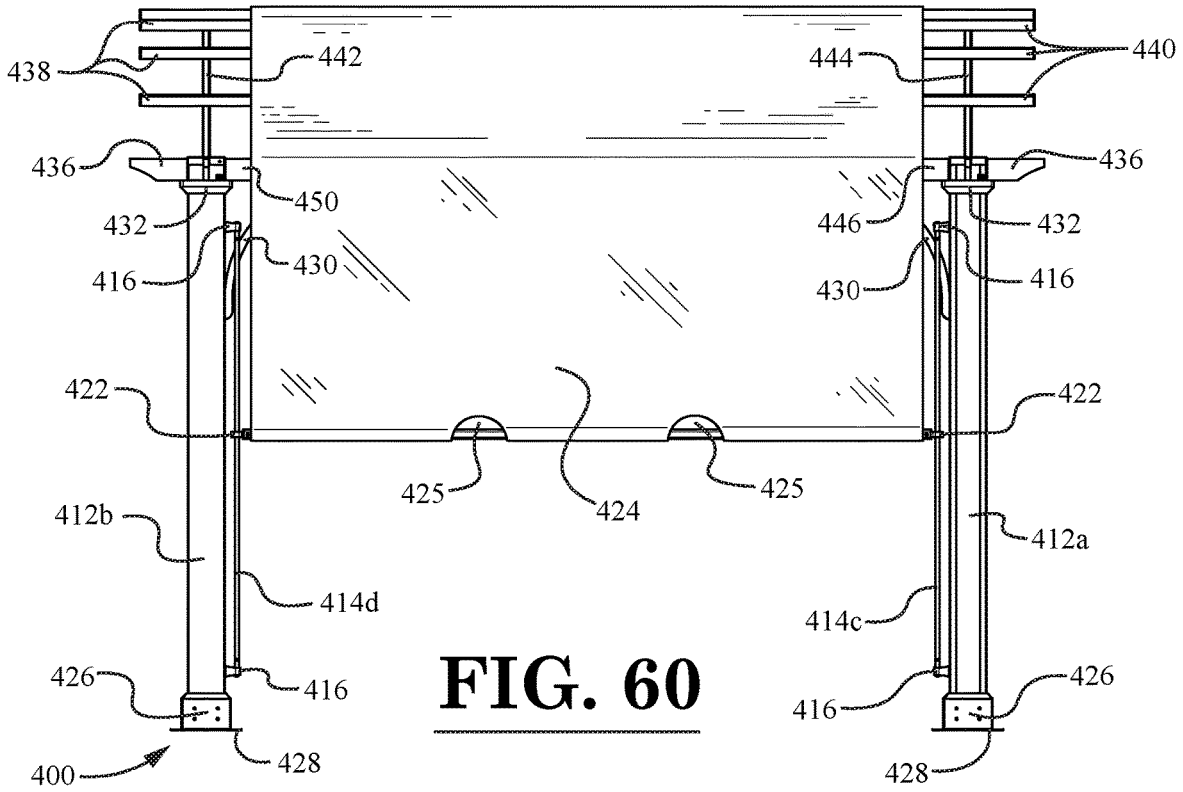
FIG. 60 is a rear elevational view of the outdoor shelter of FIG. 54.
Figure 61:
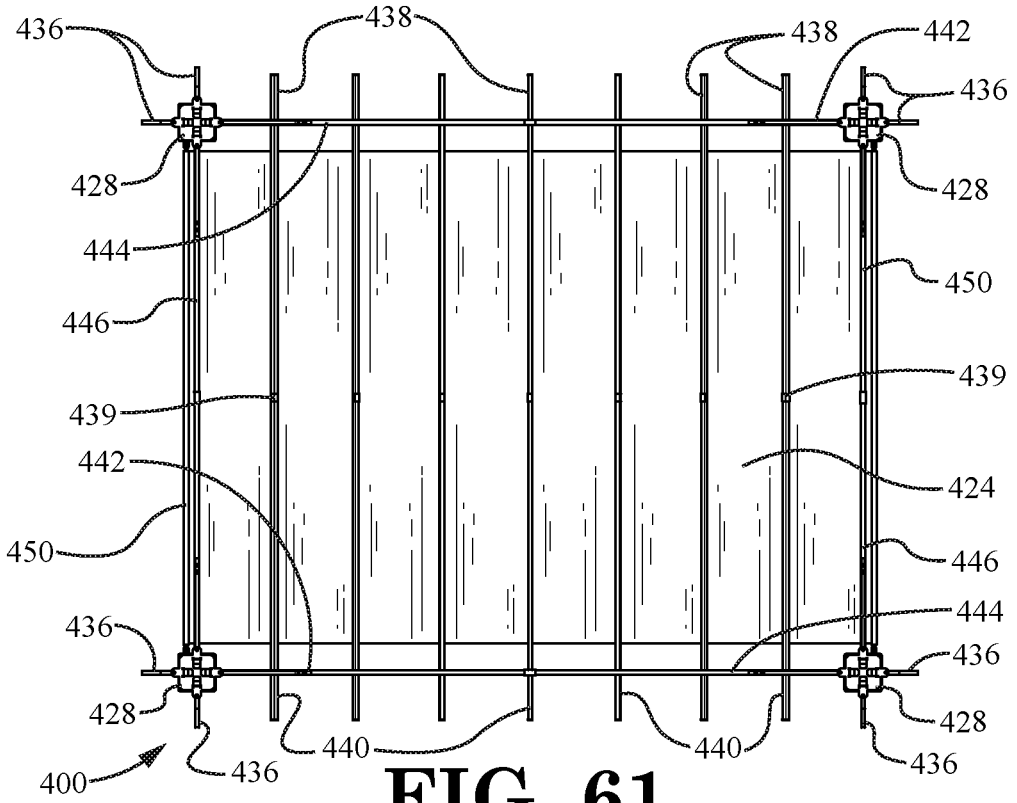
FIG. 61 is a bottom plan view of the outdoor shelter of FIG. 54.
Figure 62:
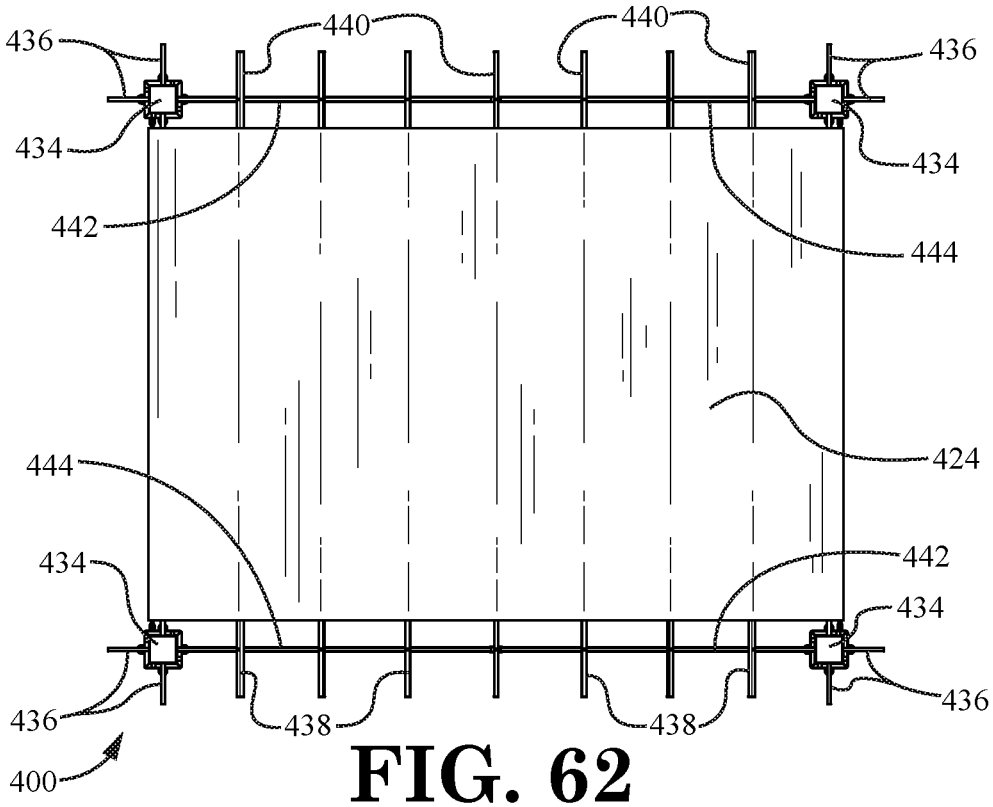
FIG. 62 is a top plan view of the outdoor shelter of FIG. 54.

Also, as illustrated in FIGS. 55-57, each of the corner support post members 410*a*, 410*b*, 412*a*, 412*b* may be provided with a decorative top cover member 432 near an upper end of the corner support post member 410*a*, 410*b*, 412*a*, 412*b*.

Each of the corners of the outdoor shelter 400 is reinforced by means of a pair of arc support members 430. That is, as shown in FIGS. 55-58, the arc support members 430 attach the curved roof frame members 442, 444 and the end roof beam members 446, 450 to sides of the corner support post members 410*a*, 410*b*, 412*a*, 412*b*. That is, each arc support member 430 is configured to be attached between a respective one of the corner support post members 410*a*, 410*b*, 412*a*, 412*b* and a respective one of the curved roof frame members 442, 444 or the end roof beam members 446, 450 by means of fasteners (e.g., screws or bolts).

Also, as shown in FIGS. 55 and 56, the roof frame structure of the outdoor shelter 400 further comprises a plurality of transverse roof beam members 438, 440 that are mounted to the top surfaces of the curved top chords of the curved roof frame members 442, 444 (e.g., by using fasteners, such as screws or bolts). The transverse roof beam members 438, 440 are located between the corner support post members 410*a*, 410*b*, 412*a*, 412*b*, and are supported on the top surfaces of the spaced-apart curved roof frame members 442, 444 (refer to FIGS. 55 and 56).

In the fifth illustrative embodiment, each one of the transverse roof beam members is formed by a first transverse roof beam section 438 that is affixed to a second transverse roof beam section 440 by a transverse roof beam connector 439 (see FIG. 56) that slides into the inner ends of the transverse roof beam members 438, 440, and are attached to the inner ends of the transverse roof beam members 438, 440 by a plurality of fasteners (e.g., screws or bolts). Also, in the illustrative embodiment, the transverse roof beam members 438, 440 are generally equally spaced apart across the top of the spaced-apart curved roof frame members 442, 444 so as to form a supporting structure for the shade member 424. As best shown in FIGS. 54 and 55, the shade member 424 is draped over the top of the transverse roof beam members 438, 440. That is, in the illustrative embodiment, the shade member 424 passes over the top of the transverse roof beam members 438, 440 when the outdoor shelter 400 is in an assembled state.

In one or more embodiments, the framing components of the outdoor shelter 400 (e.g., as illustrated in FIGS. 55 and 56), except for the corner support post members 410*a*, 410*b*, 412*a*, 412*b*, are formed from a suitable metallic material, such as steel. The corner support post members 410*a*, 410*b*, 412*a*, 412*b* and the base cover members 426 may be made of wood (e.g., cedar or another suitable wood). However, those of ordinary skill in the art will appreciate that other suitable materials can be used for the various components of the outdoor shelter 400 as well. Also, each of the fastener members described in conjunction with the fifth embodiment may comprise a plurality of external threads disposed on the outer periphery thereof, and one or more of the fastener apertures with which the threaded fastener members are threadingly engaged may be provided with corresponding internal threads around the circumference thereof so as to obviate the need for the use of nuts (e.g., the fastener aperture that is the furthest in the axial direction from the head of the fastener member may be internally threaded).

It is readily apparent that the aforedescribed outdoor shelter 100, 101, 200, 300, 400 with a shade member rail system offers numerous advantages. First of all, the rail system of the outdoor shelter 100, 101, 200, 300, 400 described herein enables the shade member 24, 124, 224, 424 of the outdoor shelter 100, 101, 200, 300, 400 to be readily adjusted by a user so as to permit the shading qualities of the outdoor shelter 100, 101, 200, 300, 400 to be modified. Secondly, the aforedescribed rail system of the outdoor shelter 100, 101, 200, 300, 400 allows the shade member 24, 124, 224, 424 of the outdoor shelter 100, 101, 200, 300, 400 to be easily adjusted for the directional differences in the sunlight entering the outdoor shelter 100, 101, 200, 300, 400 throughout the course of the day.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. An outdoor shelter, comprising:

at least one pair of support post members, each pair of support post members comprising a first support post member being spaced apart from a second support post member;

a first guide rail member coupled to the first support post member;

a guide rail connector member coupling the first guide rail member to the first support post member, the guide rail connector member comprising a body portion extending outwardly from a side of the first support post member, and the guide rail connector member further comprising a fastener aperture disposed transversely therethrough, the fastener aperture configured to receive a fastener member for securing the guide rail connector member and the first guide rail member to the side of the first support post member, the fastener member being configured to pass through the guide rail connector member, through the first guide rail member, and into the side of the first support post member;

a second guide rail member coupled to the second support post member; and a shade support pole member slidably coupled to the first and second guide rail members, the shade support pole member being coupled to an end portion of a shade member of the outdoor shelter, and the shade support pole member configured to be slidably displaced along the lengths of the first and second guide rail members so as to allow an amount by which the shade member overhangs a side of the outdoor shelter to be adjusted by a user.

2. The outdoor shelter according to claim 1, wherein the body portion of the guide rail connector member further comprises a guide rail aperture extending longitudinally therein, the guide rail aperture configured to receive a longitudinal section of the first guide rail member.

3. The outdoor shelter according to claim 1, wherein the shade support pole member is slidably coupled to the first and second guide rail members by a pair of spaced-apart shade support pole connector members, at least one of the pair of spaced-apart shade support pole connector members being disposed proximate to a longitudinal end of the shade support pole member.

4. The outdoor shelter according to claim 3, wherein at least one of the pair of spaced-apart shade support pole connector members comprises a tubular portion and a flange portion, the tubular portion of the shade support pole connector member having a pole receiving cavity formed therein for slidably engaging a respective one of the first and second guide rail members, and the flange portion of the shade support pole connector member extending outwardly from the tubular portion of the shade support pole connector member.

5. The outdoor shelter according to claim 1, further comprising at least one peripheral beam member, the at least one peripheral beam member configured to be disposed between a first pair of the support post members and a second pair of the support post members, the at least one peripheral beam member having a curved configuration such that a center portion of the at least one peripheral beam member is disposed higher than end portions of the at least one peripheral beam member.

6. The outdoor shelter according to claim 1, wherein the end portion of the shade member is looped so as to form a longitudinal cavity for receiving the shade support pole member.

7. The outdoor shelter according to claim 1, wherein the end portion of the shade member comprises at least one handle cutout portion formed in an edge thereof, the at least one handle cutout portion and a longitudinal section of the shade support pole member together defining a handle aperture configured to receive a portion of a hand of the user so as to facilitate the grasping of the shade member and the shade support pole member by the user during the adjustment of the shade member.

8. A rail system for an outdoor shelter, comprising:

a plurality of support post members disposed at respective corners of the outdoor shelter, the plurality of support post members comprising a first support post member and a second support post member disposed at a first longitudinal end of the outdoor shelter, the plurality of support post members further comprising a third support post member and a fourth support post member disposed at a second longitudinal end of the outdoor shelter;

a first guide rail member coupled to the first support post member;

one or more guide rail connector members coupling the first guide rail member to the first support post member, each of the one or more guide rail connector members comprising a body portion extending outwardly from a side of the first support post member, and each of the one or more guide rail connector members further comprising a fastener aperture disposed transversely therethrough, the fastener aperture configured to receive a fastener member for securing the guide rail connector member and the first guide rail member to the side of the first support post member, the fastener member being configured to pass through the guide rail connector member, through the first guide rail member, and into the side of the first support post member;

a second guide rail member coupled to the second support post member;

a third guide rail member coupled to the third support post member;

a fourth guide rail member coupled to the fourth support post member;

a first shade support pole member slidably coupled to the first and second guide rail members, the first shade support pole member being coupled to a first end portion of a shade member of the outdoor shelter, the first shade support pole member configured to be slidably displaced along the lengths of the first and second guide rail members so as to allow an amount by which the shade member overhangs a first side of the outdoor shelter to be adjusted by a user; and a second shade support pole member slidably coupled to the third and fourth guide rail members, the second shade support pole member being coupled to a second end portion of the shade member of the outdoor shelter, the second shade support pole member configured to be slidably displaced along the lengths of the third and fourth guide rail members so as to allow an amount by which the shade member overhangs a second side of the outdoor shelter to be adjusted by the user;

wherein, when the amount by which the shade member overhangs the first side of the outdoor shelter is increased by the user, the amount by which the shade member overhangs the second side of the outdoor shelter is decreased.

9. The rail system according to claim 8, wherein the second, third, and fourth guide rail members are respectively coupled to the second, third, and fourth support post members by one or more additional guide rail connector members.

10. The rail system according to claim 8, wherein the first shade support pole member is slidably coupled to the first and second guide rail members by a first pair of spaced-apart shade support pole connector members, the second shade support pole member is slidably coupled to the third and fourth guide rail members by a second pair of spaced-apart shade support pole connector members, at least one of the spaced-apart shade support pole connector members being disposed proximate to a longitudinal end of the first and second shade support pole members.

11. An outdoor shelter, comprising:

a plurality of corner support members disposed at respective corners of the outdoor shelter, the plurality of corner support members comprising a first corner support member and a second corner support member disposed at a first longitudinal end of the outdoor shelter, the plurality of corner support members further comprising a third corner support member and a fourth corner support member disposed at a second longitudinal end of the outdoor shelter;

a plurality of peripheral beam members, a first one of the plurality of peripheral beam members configured to extend in a longitudinal direction between the first and third corner support members, the first one of the plurality of peripheral beam members extending to, and being connected to top ends of the first and third corner support members, and a second one of the plurality of peripheral beam members configured to extend in a transverse direction between the first and second corner support members, the second one of the plurality of peripheral beam members extending to, and being connected to top ends of the first and second corner support members;

at least one arc support member configured to be attached between a side surface of a respective one of the plurality of corner support members and a bottom surface of a respective one of the plurality of peripheral beam members, a middle portion of the at least one arc support member configured to be spaced apart from the respective one of the plurality of corner support members and the respective one of the plurality of peripheral beam members so as to define a gap between the at least one arc support member, the respective one of the plurality of corner support members, and the respective one of the plurality of peripheral beam members; and a shade member, the shade member disposed above at least one of the first and second ones of the plurality of peripheral beam members and the at least one arc support member.

12. The outdoor shelter according to claim 11, wherein the first one of the plurality of peripheral beam members has a curved configuration such that a center portion of the first one of the plurality of peripheral beam members is disposed higher than end portions of the first one of the plurality of peripheral beam members.

13. The outdoor shelter according to claim 11, further comprising at least one ground stake plate having at least one fastener aperture and at least one ground stake aperture formed therein, the at least one fastener aperture being disposed through a raised portion of the ground stake plate, the at least one ground stake aperture being disposed closer to a periphery of the ground stake plate than the at least one fastener aperture, the at least one fastener aperture configured to receive a fastener member for securing the ground stake plate to a bottom end of one of the plurality of corner support members, and the at least one ground stake aperture configured to receive a ground stake for securing the one of the plurality of corner support members to the ground.

14. The outdoor shelter according to claim 13, further comprising at least one ground plate cover member configured to be disposed over a peripheral portion of the at least one ground stake plate so as to at least partially conceal the peripheral portion of the at least one ground stake plate from view, the at least one ground plate cover member having a central aperture formed therethrough for accommodating a passage of the corner support member through the ground plate cover member.

15. The outdoor shelter according to claim 11, further comprising at least one shade support pole member coupled to an end portion of the shade member of the outdoor shelter.

16. The outdoor shelter according to claim 15, wherein the end portion of the shade member is looped so as to form a longitudinal cavity for receiving the at least one shade support pole member.

* * * * *